US009753385B2

(12) United States Patent
Ito et al.

(10) Patent No.: US 9,753,385 B2
(45) Date of Patent: Sep. 5, 2017

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Daisuke Miura, Tokyo (JP); Shoma Hinata, Mishima (JP); Hiroyuki Tomono, Numazu (JP); Takashi Anezaki, Hiratsuka (JP); Tatsuya Yamaai, Yokohama (JP); Kazumichi Sugiyama, Numazu (JP); Masataka Kawahara, Mishima (JP); Hirotoshi Uesugi, Mishima (JP); Akihiro Maruyama, Mishima (JP); Hirofumi Kumoi, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/054,017

(22) Filed: Feb. 25, 2016

(65) Prior Publication Data

US 2016/0252830 A1 Sep. 1, 2016

(30) Foreign Application Priority Data

Feb. 27, 2015 (JP) ..... 2015-039429
Feb. 15, 2016 (JP) ..... 2016-026328

(51) Int. Cl.

| | |
|---|---|
| ***G03G 5/00*** | (2006.01) |
| ***G03G 5/05*** | (2006.01) |
| ***G03G 5/047*** | (2006.01) |
| ***G03G 5/147*** | (2006.01) |

(52) U.S. Cl.

CPC ..... *G03G 5/0564* (2013.01); *G03G 5/047* (2013.01); *G03G 5/0525* (2013.01); *G03G 5/14756* (2013.01)

(58) Field of Classification Search

CPC ..... G03G 5/0564; G03G 5/14756
See application file for complete search history.

(56) References Cited

U.S. PATENT DOCUMENTS

2010/0209136 A1 8/2010 Mizushima

FOREIGN PATENT DOCUMENTS

| | | | |
|---|---|---|---|
| JP | H04-149557 | A | 5/1992 |
| JP | H05-113680 | A | 5/1993 |
| JP | H06-011877 | A | 1/1994 |
| JP | 2005-338446 | A | 12/2005 |
| JP | 2011-026574 | A | 2/2011 |

*Primary Examiner* — Mark A Chapman
(74) *Attorney, Agent, or Firm* — Canon U.S.A., Inc. IP Division

(57) ABSTRACT

An electrophotographic photosensitive member has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B (groups A and B defined in the disclosure).

8 Claims, 5 Drawing Sheets

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a method for manufacturing this electrophotographic photosensitive member, and a process cartridge and an electrophotographic apparatus incorporating this electrophotographic photosensitive member.

Description of the Related Art

Electrophotographic photosensitive members having a charge transport layer as a surface layer are required to be resistant to wear enough to withstand repeated use. To improve the wear resistance of the charge transport layer, researchers have been studying the structure of resins that are used as binders in the charge transport layer, polycarbonate resins in particular (Japanese Patent Laid-Open Nos. 2011-26574, 5-113680, 4-149557, 6-11877, and 2005-338446)

SUMMARY OF THE INVENTION

An aspect of the invention provides an electrophotographic photosensitive member with which fog can be very effectively reduced. Some other aspects of the invention provide a method for manufacturing such an electrophotographic photosensitive member and a process cartridge and an electrophotographic apparatus incorporating such an electrophotographic photosensitive member.

An electrophotographic photosensitive member according to an aspect of the invention has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B.

The group A includes structural units represented by formulae (101) and (102).

(101)

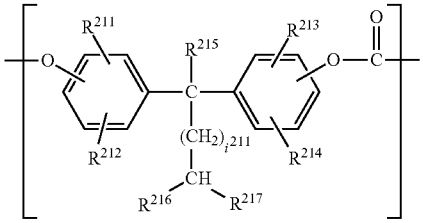

(In formula (101), $R^{211}$ to $R^{214}$ each independently represent a hydrogen atom or an alkyl, aryl, or alkoxy group. $R^{213}$ represents an alkyl, aryl, or alkoxy group. $R^{216}$ and $R^{217}$ each independently represent an alkyl group containing 1 to 9 carbon atoms. $i^{211}$ represents an integer of 0 to 3. $R^{215}$ and $(CH_2)_iCHR^{216}R^{217}$ are different groups.)

(102)

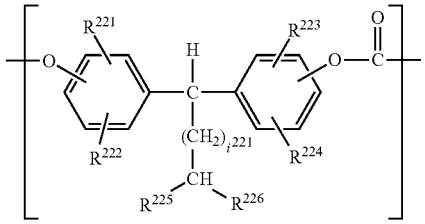

(In formula (102), $R^{221}$ to $R^{224}$ each independently represent a hydrogen atom or an alkyl, aryl, or alkoxy group. $R^{225}$ and $R^{226}$ each independently represent an alkyl group containing 1 to 9 carbon atoms. $R^{225}$ and $R^{226}$ are different groups. $i^{221}$ represents and integer of 0 to 3.)

The group b includes structural units represented by formulae (104), (105), and (106).

(104)

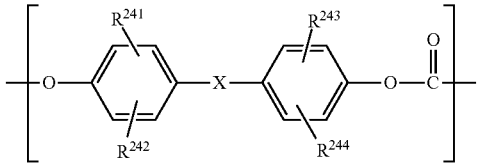

(In formula (104), $R^{241}$ to $R^{244}$ each independently represent a hydrogen atom or an alkyl, aryl, or alkoxy group. X represents a single bond, an oxygen atom, a sulfur atom, or a sulfonyl group.)

(105)

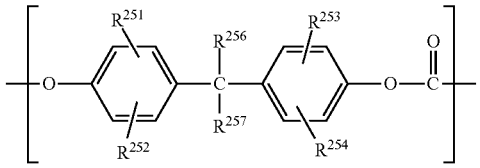

(In formula (105), $R^{251}$ to $R^{254}$ each independently represent a hydrogen atom or an alkyl, aryl, or alkoxy group. $R^{236}$ and $R^{237}$ each independently represent a hydrogen atom or an alkyl, aryl, or halogenated alkyl group.)

(106)

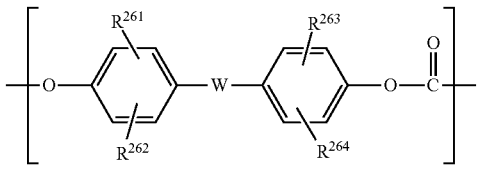

(In formula (106), $R^{261}$ to $R^{264}$ each independently represent a hydrogen atom or an alkyl, aryl, or alkoxy group. W represents a cycloalkylidene group containing 5 to 12 carbon atoms.)

Further features of the present invention will become apparent from the following description of exemplary embodiments with reference to the attached drawings.

DESCRIPTION OF THE EMBODIMENTS

Figure 1:
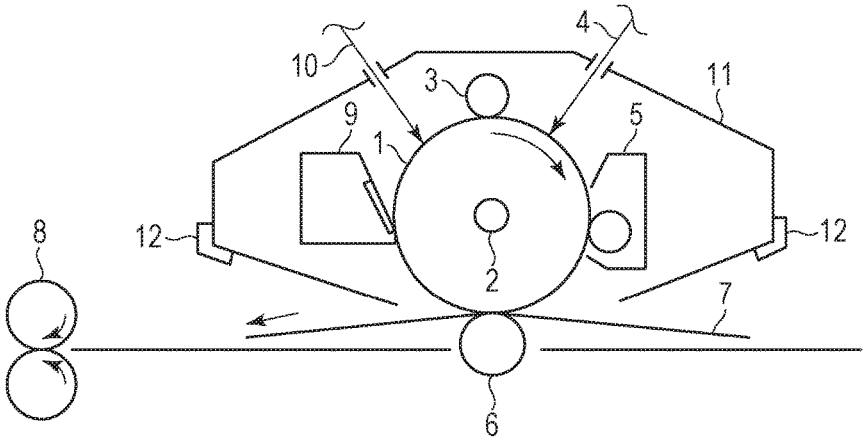
FIG. 1 illustrates an example of a schematic structure of an electrophotographic apparatus installed with a process cartridge that incorporates an electrophotographic photosensitive member.

Through research, the inventors found the following fact. That is, when an electrophotographic photosensitive member having a charge transport layer as a surface, layer is used repeatedly, the charge transport layer becomes thinner due to wear. This leads to increased electric field intensity, causing the technical problem called "fog" on images, i.e., a defect whereby a small amount of toner is developed in unintended areas of the images.

The known electrophotographic photosensitive members according to the aforementioned publications, having a charge transport layer that contains a no resin as a binder, help to reduce the fog, but not to the extent that the recent high demand for long-life electrophotographic photosensitive members would be fully satisfied.

An aspect of the invention therefore provides an electrophotographic photosensitive member with which fog can be very effectively reduced. Some other aspects of the invention provide a method for manufacturing such an electrophotographic photosensitive member and a process cartridge and an electrophotographic apparatus incorporating such an electrophotographic photosensitive member.

The following describes certain aspects of the invention by providing some preferred embodiments. Studies conducted by the inventors have revealed that the use of a particular kind of polycarbonate resin in a charge transport layer of an electrophotographic photosensitive member significantly improves the mechanical strength of the photosensitive member and leads to effective reduction of fog. To be more specific, an electrophotographic photosensitive member according to an aspect of the invention has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B.

The group A includes structural units represented by formulae (101) and (102).

(101)

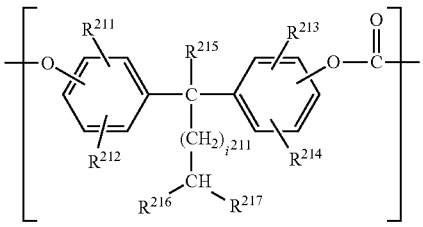

In formula (101), $R^{211}$ to $R^{214}$ each independently represent a hydrogen atom or an alkyl, aryl, or alkoxy group. $R^{215}$ represents an alkyl, aryl, or alkoxy group. $R^{216}$ and $R^{217}$ each independently represent a substituted or unsubstituted alkyl group containing 1 to 9 carbon atoms. $i^{211}$ represents an integer of 0 to 3. When $i^{211}$ is 0, this site is a single bond. $R^{215}$ and $(CH_2)_iCHR^{216}R^{217}$ are different groups.

(102)

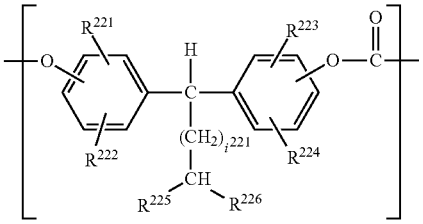

In formula (102), $R^{221}$ to $R^{224}$ each independently represent a hydrogen atom or an alkyl, aryl, or alkoxy group. $R^{225}$ and $R^{226}$ each independently represent a substituted or unsubstituted alkyl group containing 1 to 9 carbon atoms. $R^{225}$ and $R^{226}$ are different groups. $i^{221}$ represents an integer of 0 to 3. When $i^{221}$ is 0, this site is a single bond.

The group B includes structural units represented by formulae (104), (105), and (106).

(104)

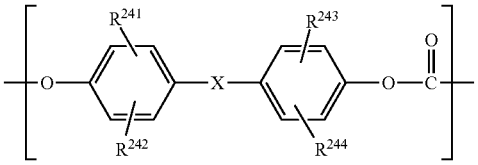

In formula (104), $R^{241}$ to $R^{244}$ each independently represent a hydrogen atom or an alkyl, aryl, or alkoxy group. X represents a single bond, an oxygen atom, a sulfur atom, or a sulfonyl group.

(105)

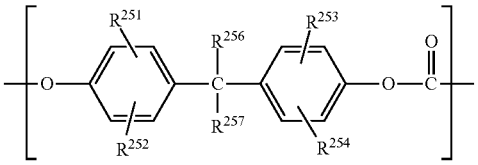

In formula (105), $R^{251}$ to $R^{254}$ independently represent a hydrogen atom or an alkyl, aryl, or alkoxy group. $R^{256}$ and $R^{257}$ each independently represent a hydrogen atom or an alkyl, aryl, or halogenated alkyl group. The aryl group may be substituted with an alkyl or alkoxy group or a halogen atom.

(106)

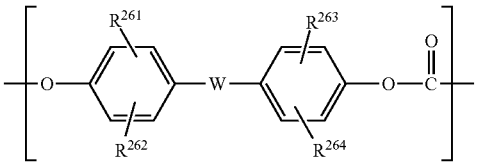

In formula (106), $R^{261}$ to $R^{264}$ each independently represent a hydrogen atom or an alkyl, aryl, or alkoxy group. W represents a cycloalkylidene group containing 5 to 12 carbon atoms. The cycloalkylidene group may be substituted with an alkyl group.

This polycarbonate resin having a structural unit selected from group A and a structural unit selected from group B can be synthesized using, for example, one of the following two processes. The first is to allow at least one bisphenol compound selected from formulae (107) and (108) and at least one bisphenol compound selected from formulae (110) to (112) to react directly with phosgene (a phosgene process). The second is to transesterify the at least two bisphenol compounds and a bisaryl carbonate, such as diphenyl carbonate, di-p-tolyl carbonate, phenyl-p-tolyl carbonate, di-p-chlorophenyl carbonate, or dinaphthyl carbonate (a transesterification process).

In the phosgene process, the at least two bisphenol compounds and phosgene are usually reacted in the presence of an acid-binding agent and a solvent. The acid-binding agent can be pyridine, an alkali metal hydroxide, such as potassium hydroxide or sodium hydroxide, or similar. The solvent can be methylene chloride, chloroform, or similar. A catalyst and/or a molecular-weight modifier may be added in order to accelerate the condensation polymerization. The catalyst can be triethylamine or any other tertiary amine, a quaternary ammonium salt, or similar. The molecular-weight modifier can be phenol, p-cumylphenol, t-butylphenol, a phenol substituted with a long-chain alkyl group, or similar mono functional compounds.

The synthesis of the polycarbonate resin may involve an antioxidant, such as sodium sulfite or hydrosulfide, and/or a branching agent, such as phloroglucin or isatin bisphenol. The polycarbonate resin can be synthesized at a temperature of 0° C. to 150° C., preferably 5° C. to 40° C. The duration of the reaction depends on the reaction temperature but can typically be in the range of 0.5 minutes to 10 hours, preferably 1 minute to 2 hours. During the reaction, the pH of the reaction system can be 10 or more.

Here are some specific examples of bisphenol compounds that can be used for synthesis.

(1) At least one bisphenol compound selected from formulae (107) and (108)

(107)

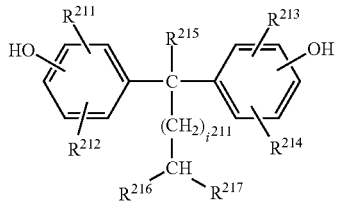

In formula (107) $R^{211}$ to $R^{214}$ each independently represent a hydrogen atom or an alkyl, aryl, or alkoxy group. $R^{215}$ represents an alkyl, aryl, or alkoxy group. $R^{216}$ and $R^{217}$ each independently represent a substituted or unsubstituted alkyl group containing 1 to 9 carbon atoms. $i^{211}$ represents an integer of 0 to 3. When $i^{211}$ is 0, this site is a single bond. $R^{215}$ and $(CH_2)_iCHR^{216}R^{217}$ are different groups.

(108)

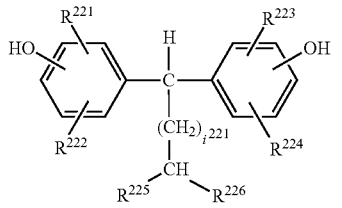

In formula (108), $R^{221}$ to $R^{224}$ each independently represent a hydrogen atom or an alkyl, aryl, or alkoxy group. $R^{225}$ and $R^{226}$ each independently represent a substituted or unsubstituted alkyl group containing 1 to 9 carbon atoms. $R^{225}$ and $R^{226}$ different groups. $i^{221}$ represents an integer of 0 to 3. When $i^{221}$ is 0, this site is a single bond.

Examples of bisphenol compounds represented by general formulae (107) and (108) include 2,2-bis(4-hydroxyphenyl)-4-methyl pentane, 2,2-bis(4-hydroxyphenyl)-5-methyl hexane, 3,3-bis(4-hydroxyphenyl)-5-methyl heptane, 2,2-bis(4-hydroxyphenyl)-3-methyl butane, 1,1-bis(4-hydroxyphenyl)-1-phenyl-2-methyl propane, 1,1-bis(4-hydroxyphenyl)-1-phenyl-3-methyl butane, 2,2-bis(4-hydroxyphenyl)-6-methyl heptane, 1,1-bis(4-hydroxyphenyl)-2-ethyl hexane, and 1,1-bis(4-hydroxyphenyl)-1-phenyl-2-methyl pentane. A combination of two or more of these compounds can also be used.

(2) At least one bisphenol compound selected from formulae (110) to (112)

(110)

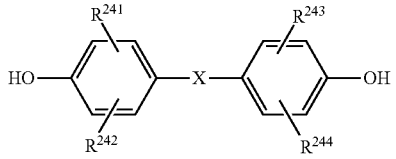

In formula (110), $R^{241}$ to $R^{244}$ each independently represent a hydrogen atom or an alkyl, aryl, or alkoxy group. X represents a single bond, an oxygen atom, a sulfur atom, or a sulfonyl group.

(111)

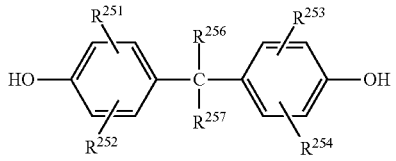

In formula (111), $R^{251}$ to $R^{254}$ independently represent a hydrogen atom or an alkyl, aryl, or alkoxy group. $R^{256}$ and $R^{257}$ each independently represent a hydrogen atom or an alkyl, aryl, or halogenated alkyl group. The aryl group may be substituted with an alkyl or alkoxy group or a halogen atom.

(112)

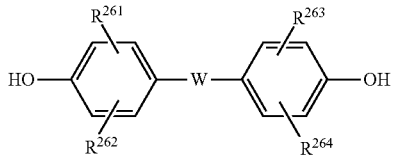

In formula (112), $R^{261}$ to $R^{264}$ each independently represent a hydrogen atom or an alkyl, aryl, or alkoxy group. W represents a cycloalkylidene group containing 5 to 12 carbon atoms. The cycloalkylidene group may be substituted with an alkyl group.

Examples of bisphenol compounds represented by formulae (110) to (112) include 4,4'dihydroxybiphenyl, 4,4"-dihydroxy-3,3'-dimethyl biphenyl, 4,4'-dihydroxy-2,2'-dimethyl biphenyl, 4,4'-dihydroxy-3,3',5-trimethyl biphenyl, 4,4'-dihydroxy-3,3',5,5'-tetramethyl biphenyl, 4,4'-dihydroxy-3,3'-dibutyl biphenyl, 4,4'-dihydroxy-3,3'-dicyclohexyl biphenyl, 3,3'-difluoro-4,4'-dihydroxybiphenyl, 4,4'-dihydroxy-3,3'-diphenyl biphenyl, 1,1-bis(4-hydroxyphenyl)ethane, 1,1-bis(3-methyl-4-hydroxyphenyl) ethane, 1,1-bis(3-fluoro-4-hydroxyphenyl)ethane, 1,1-bis(2-tert-butyl-4-hydroxy-3-methyl phenyl)ethane, 1,2-bis(4-hydroxyphenyl)ethane, 1,2-bis(3-methyl-4-hydroxyphenyl) ethane, 2,2-bis(4-hydroxyphenyl)propane, 2,2-bis(3-methyl-4-hydroxyphenyl)propane, 2,2-bis(3-cyclohexyl-4-hydroxyphenyl)propane, 2,2-bis(3-phenyl-4-hydroxyphenyl)propane, 2,2-bis(3,5-dimethyl-4-hydroxyphenyl)propane, 2,2-bis3-fluoro-4-hydroxyphenyl) propane, 2,2-bis(3-chloro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(2-tert-butyl-4-hydroxy-3-methyl phenyl)propane, 2,2-bis(4-hydroxyphenyl) hexafluoropropane, 2,2-bis(3-methyl-4-hydroxyphenyl) hexafluoropropane, 2,2-bis(3,5-dimethyl-4-hydroxyphenyl) hexafluoropropane, 2,2-bis(3-phenyl-4-hydroxyphenyl) hexafluoropropane, 2,2-bis(3-fluoro-4-hydroxyphenyl) hexafluoropropane, 2,2-bis(3-chloro-4-hydroxyphenyl) hexafluoropropane, 1,1-bis(4-hydroxyphenyl)cyclohexane, 1,1-bis(3-methyl-4-hydroxyphenyl)cyclohexane, 1,1-bis(3-cyclo-4-hydroxyphenyl)cyclohexane, 1,1-bis(3-phenyl-4-hydroxyphenyl)cyclohexane, 1,1-bis(3,5-dimethyl-4-hydroxyphenyl)cyclohexane, 1,1-bis(3-fluoro-hydroxyphenyl) cyclohexane, 1,1-bis(3-chloro-4-hydroxyphenyl) cyclohexane, 1,1-bis(3-bromo-4-hydroxyphenyl) cyclohexane, 1,1-bis(3,5-difluoro-4-hydroxyphenyl) cyclohexane, 1,1-bis(3,5-dichloro-4-hydroxyphenyl) cyclohexane, 1,1-bis(3,5-dibromo-4-hydroxyphenyl) cyclohexane, 1,1-bis(2-tert-butyl-4-hydroxy-3-methyl phenyl)cyclohexane, bis(4-hydroxyphenyl)sulfone, 1,1-bis (4-hydroxyphenyl)-3,3,5-trimethyl cyclohexane, 1,1-bis(4-hydroxyphenyl)cyclopentane, 1,1-bis(4-hydroxyphenyl)-1-phenyl ethane, bis(4-hydroxyphenyl)diphenyl methane, 9,9-bis(4-hydroxyphenyl)-fluorene, and 2,2-bis(4-hydroxyphenyl)butane. A combination of two or more of these compounds can also be used Structural unit selected from group A The use of a polycarbonate resin having any of the structural units represented by formulae (A-101) to (A-105), as compared to others selected from group PI, leads to more effective reduction of fog and better electrical characteristics. Polycarbonate resins having any of these structural units, while in the charge transport layer, will keep a constant intermolecular distance and a constant distance from the charge transport material, improving mechanical strength and electrical characteristics.

(A-101)

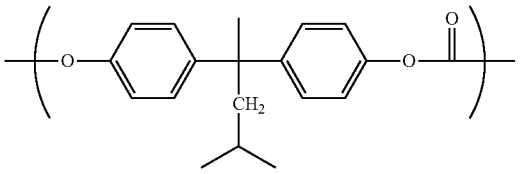

-continued (A-102)

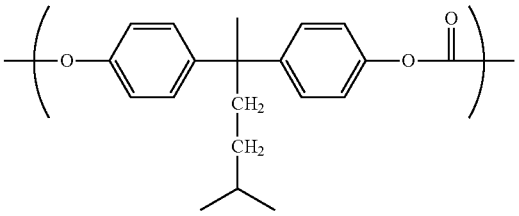

(A-103)

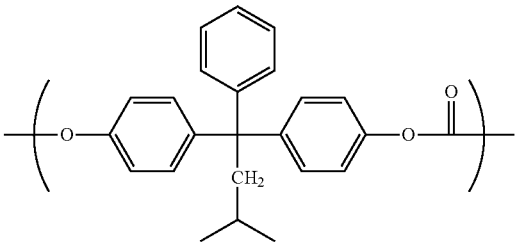

(A-104)

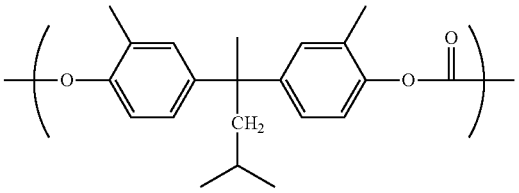

(A-105)

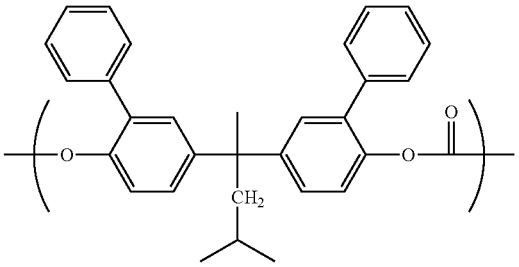

The use of a polycarbonate resin having any of the structural units represented by (A-201) to (A-205), as compared to others selected from group A, is effective in improving the storage stability of the coating liquid for the formation of the charge transport layer, the prevention of photomemories, and electrical characteristics after repeated use. Polycarbonate resins having any of these structural units will exhibit improved solubility in the solvent of the coating liquid for the formation of the charge transport layer. Furthermore, polycarbonate resins having any of these structural units, while in the charge transport layer, will keep a constant distance from the charge transport material, improving electrical characteristics. A photomemory is a defect caused by the retention of light-generated carriers in a photosensitive layer of an electrophotographic photosensitive member and occurs when an electrophotographic photosensitive member is exposed to light, such as from a fluorescent lamp, in association with maintenance of a process cartridge or electrophotographic apparatus after repeated use. It an electrophotographic photosensitive member in this state is used to produce an image, the difference in electrical potential between the exposed and unexposed area appears as uneven density in the resulting image.

(A-201)

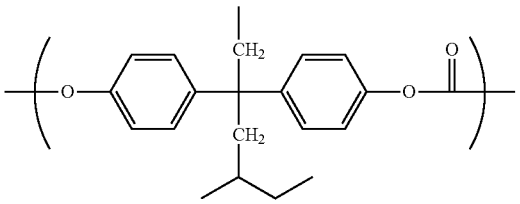

(A-202)

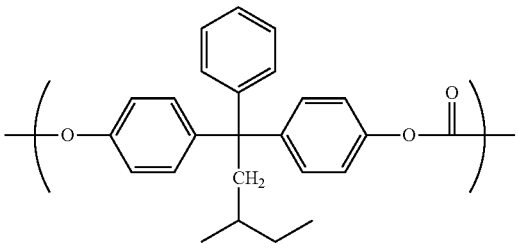

(A-203)

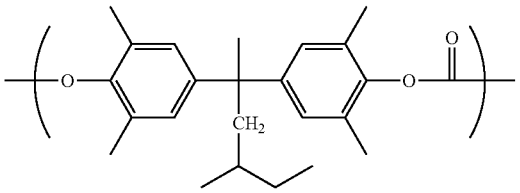

(A-204)

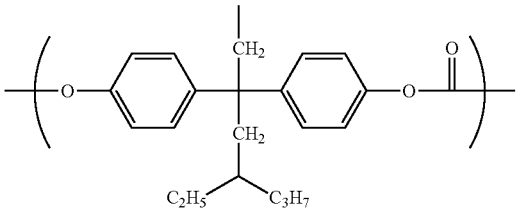

(A-205)

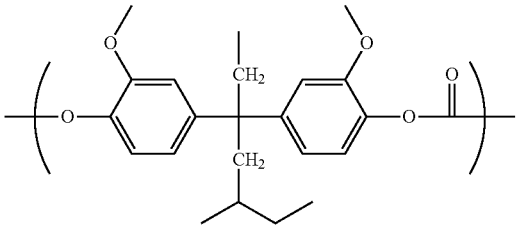

The use of a polycarbonate resin having any of the structural units represented by (A-401) to (A-405), as compared to others selected from group A, is effective in improving the storage stability of the coating liquid for the formation of the charge transport layer and the prevention of photomemories. Polycarbonate resins having any of these structural units will exhibit improved solubility in the solvent of the coating liquid for the formation of the charge transport layer.

(A-401)

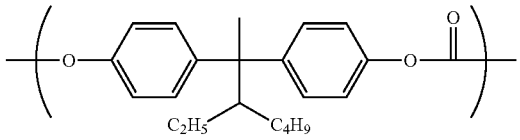

(A-402)

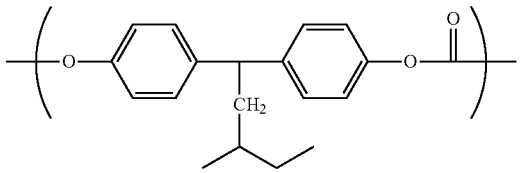

(A-403)

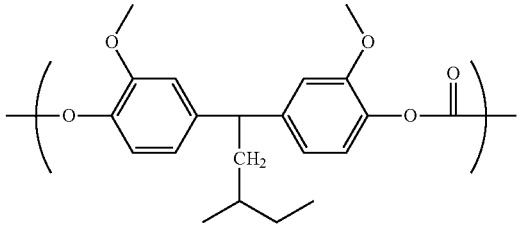

(A-404)

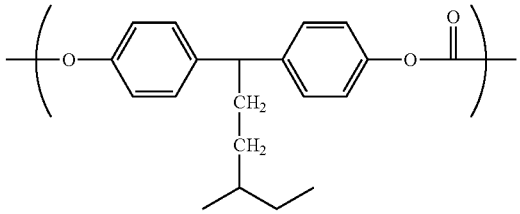

(A-405)

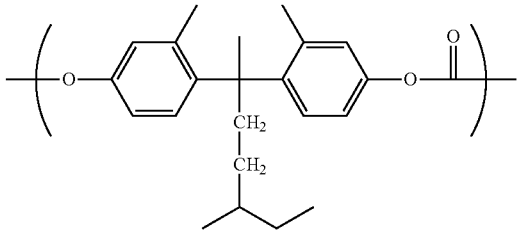

Structural Unit Selected from Group B

The use of a polycarbonate resin having any of the structural units represented by formulae (B-101) to (B-105), as compared to others selected from group B, leads to more effective reduction of fog and better electrical characteristics. Polycarbonate resins having any of these structural units, while in the charge transport layer, will keep a constant intermolecular distance and a constant distance from the charge transport material, improving mechanical strength and electrical characteristics.

(B-101)

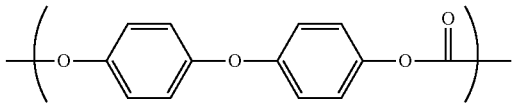

-continued (B-102)

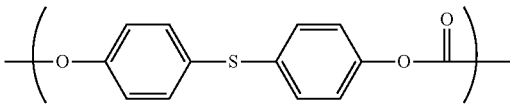

(B-103)

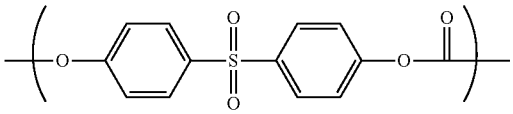

(B-104)

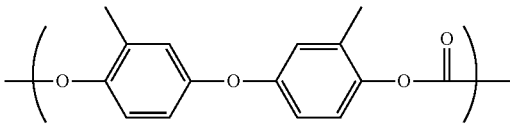

(B-105)

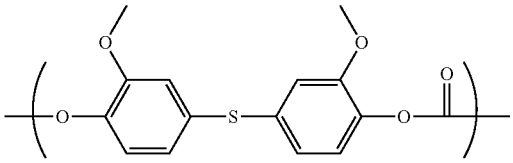

The use of a polycarbonate resin having any of the structural units represented by formulae (B-201) to (B-205), as compared to others selected from group B, leads to more effective reduction of fog. Polycarbonate resins having any of these structural units will be, while in the charge transport layer, densely packed with short intermolecular distances, improving mechanical strength.

(B-201)

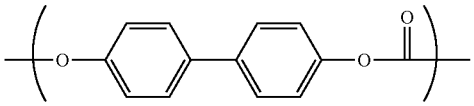

(B-202)

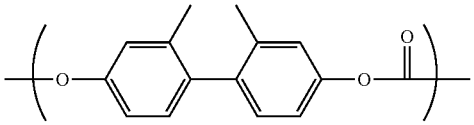

(B-203)

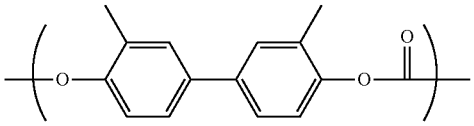

(B-204)

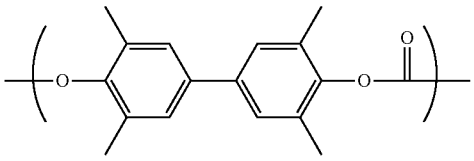

-continued (B-205)

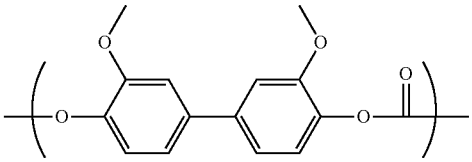

The use of a polycarbonate resin having any of the structural units represented by (B-301) to (B-308), as compared to others selected from group B, is effective in improving the storage stability of the coating liquid for the formation of the charge transport layer, the prevention of photomemories, and electrical characteristics after repeated use. Polycarbonate resins having any of these structural units will exhibit improved solubility in the solvent of the coating liquid for the formation of the charge transport layer. Furthermore, polycarbonate resins having any of these structural units, while in the charge transport layer, will keep a constant distance from the charge transport material, improving electrical characteristics.

(B-301)

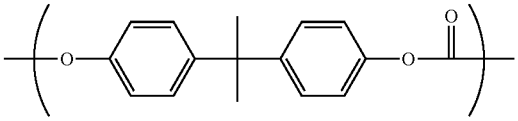

(B-302)

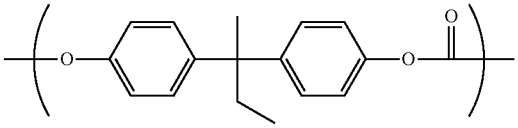

(B-303)

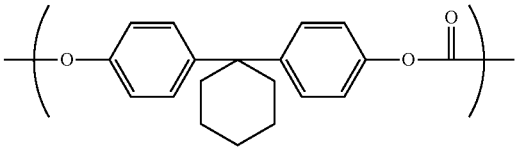

(B-304)

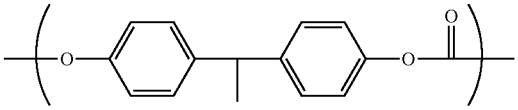

(B-305)

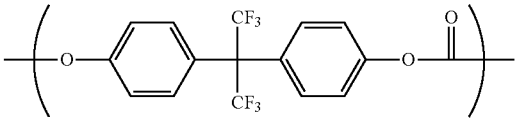

(B-306)

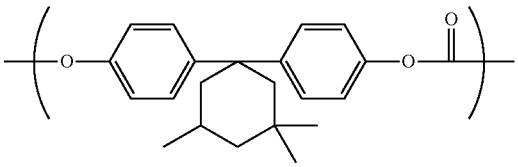

-continued (B-307)

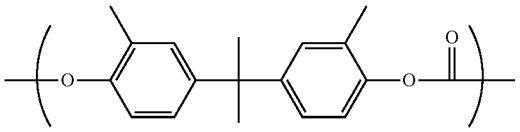

(B-308)

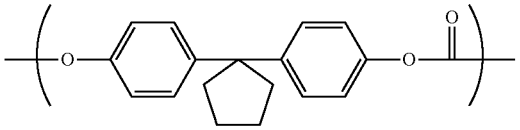

The use of a polycarbonate resin having any of the structural units represented by (B-401) to (B-405), as compared to others selected from group B, is effective in improving the storage stability of the coating liquid for the formation of the charge transport layer, the prevention of photomemories, and electrical characteristics after repeated use. Polycarbonate resins having any of these structural units will exhibit improved solubility in the solvent of the coating liquid for the formation of the charge transport layer. Furthermore, polycarbonate resins having any of these structural units, while in the charge transport layer, will keep a constant distance from the charge transport material, improving electrical characteristics.

(B-401)

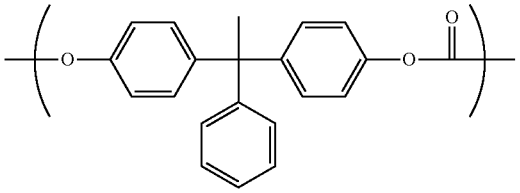

(B-402)

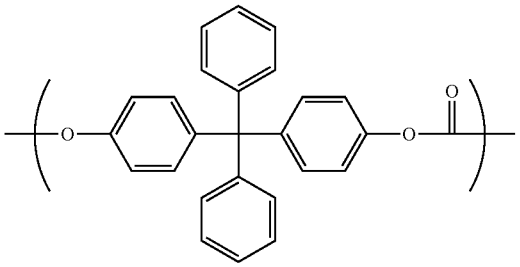

(B-403)

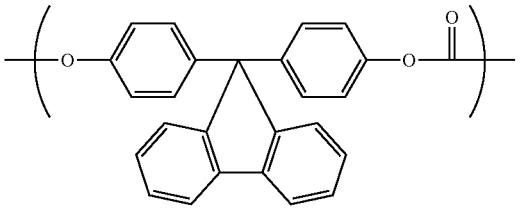

-continued (B-404)

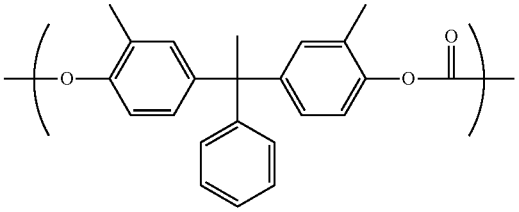

(B-405)

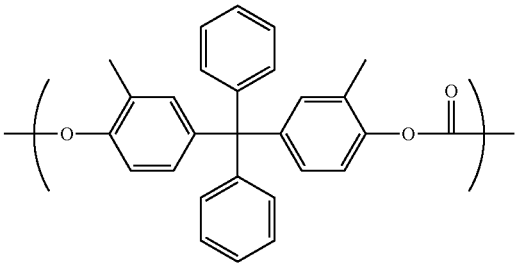

The proportion of the structural unit selected from group A in the polycarbonate resin can be 20 mol % or more and 70 mol % or less, preferably 25 mol % or more and 49 mol % or less.

In an embodiment of the invention, the weight-average molecular weight (Mw) of the polycarbonate resin can be 30,000 or more and 100,000 or less, preferably 40,000 or more and 80,000 or less. If the weight-average molecular weight of the polycarbonate resin is less than 30,000, the reduction of fog may be insufficient due to low mechanical strength. If the weight-average molecular weight of the polycarbonate resin is more than 100,000, the coating liquid for the formation of the charge transport layer may lack storage stability. In Examples below, the weight-average molecular weights of the resins are polystyrene equivalents measured using gel permeation chromatography (GPC) [on Alliance HPLC system (Waters)] under the following conditions: two Shodex KF-805L columns (Showa Denko), 0.25 w/v% chloroform solution as sample, chloroform at 1 ml/min as eluent, and UV detection at 254 nm.

The intrinsic viscosity of the polycarbonate resin can be in the range of 0.3 dL/g to 2.0 dL/g.

The relative dielectric constant c of a polycarbonate resin can be determined according to the Clausius-Mossotti equation that follows.

$$K=(4\pi/3)\times(\alpha/V)$$

$$\epsilon=(1+2K)/(1-K)$$

In this equation, V is the volume of the molecule in its stable structure obtained after structural optimization using density functional calculations E3LYP/6-31G(d,p), and $\alpha$ is the polarizability according to a restricted Hartree-Fock calculation (using the basis function 6-31G(d,p)) in this post-optimization stable structure. For polycarbonate resins having multiple structural units (e.g., copolymers), the relative dielectric constant values of the individual structural units multiplied by their respective proportions are totaled up. For example, exemplified compound 1001 has relative dielectric constant values of 2.12 and 2.11 in structural units (A-101) and (B-101), respectively. The relative dielectric constant of exemplified compound 1001 is therefore 2.12 based on the proportions of the structural units. In an embodiment of the invention, the relative dielectric constant 6 can be 2.15 or less, preferably 2.13 or less.

A relative dielectric constant of 2.15 or less leads to better response at high speeds, presumably for the following reason. The term. "response at high speeds" means that the density of an image produced is comparable between normal and faster process speeds in the image formation process. Altering the process speed usually leads to a change in the amount of light the electrophotographic photosensitive member receives. Even if the amount of light is controlled to achieve constant light exposure of the electrophotographic photosensitive member, different process speeds can result in different image densities. This difference in density becomes more significant in faster processes because the time from exposure to development shortens with increasing process speed. One cause is reciprocal failure, which necessitates complicated control in order to equalize the image density. The inventors, however, presume that reciprocal failure is not the only cause. Another cause is, in the opinion of the inventors, a difference in the rate of light decay of the surface potential of the electrophotographic photosensitive member that occurs during development, a stage in the exposure and development process the electrophotographic photosensitive member undergoes to form an image. To be more specific, even if the electrophotographic photosensitive member has equal surface potentials at the time of development, a difference in the rate of light decay of its surface potential will lead to a difference in the ability of the photosensitive member to develop toner, resulting in variations in density between the images produced. Charge generated in a charge generation layer is injected into a charge transport layer and then is transported to the surface of the electrophotographic photosensitive member by travelling in the charge transport layer. Some amount of charge reaches the surface of the electrophotographic photosensitive member in a short time, but some other amount of charge requires a relatively long time to arrive (residual charge). In view of the fact that the light decay during development occurs immediately after the photoresponse in the charging and exposure process, the rate of light decay should be influenced by the behavior of charge carriers in the charge transport layer toward the residual charge at low electric-field intensity. When the relative dielectric constant of the polycarbonate resin is 2.15 or less, the electrophotographic photosensitive member will not greatly change its capacity to put out residual charge at low electric-field intensity over time, and its rate of light decay during development will therefore be low. Furthermore, the inventors believe that when the relative dielectric constant of the polycarbonate resin is 2.15 or less, the ability of the electrophotographic photosensitive member to develop toner is not very sensitive to unevenness in the surface potential of the electrophotographic photosensitive member, and the density of an image produced is thus comparable between normal and faster process speeds in the image formation process.

When the relative dielectric constant of the polycarbonate resin is 2.15 or less, moreover, the intensity of an electric field applied to the charge transport layer will act favorably on the transport of charge through the charge transport layer and the injection of charge from a charge generation layer into the charge transport layer, making the electrophotographic photosensitive member excellent in terms of the prevention of photomemories after repeated use.

Specific Examples of Polycarbonate Resins

Tables 1 to 12 present specific examples of polycarbonate resins having a structural unit selected from group A and a structural unit selected from group B, along with their relative dielectric constant values.

TABLE 1

Specific examples of polycarbonate resins

| | Group A | | Group B | | |
|---|---|---|---|---|---|
| Exemplified compound No. | Structural unit | Proportion (mol %) | Structural unit | Proportion (mol %) | Dielectric constant |
| Exemplified compound 1001 | A-101 | 49 | B-101 | 51 | 2.12 |
| Exemplified compound 1002 | A-101 | 80 | B-101 | 20 | 2.12 |
| Exemplified compound 1003 | A-101 | 35 | B-101 | 65 | 2.11 |
| Exemplified compound 1004 | A-101 | 20 | B-101 | 80 | 2.11 |
| Exemplified compound 1005 | A-101 | 49 | B-102 | 51 | 2.17 |
| Exemplified compound 1006 | A-101 | 80 | B-102 | 20 | 2.14 |
| Exemplified compound 1007 | A-101 | 35 | B-102 | 65 | 2.18 |
| Exemplified compound 1008 | A-101 | 20 | B-102 | 80 | 2.19 |
| Exemplified compound 1009 | A-101 | 49 | B-103 | 51 | 2.11 |
| Exemplified compound 1010 | A-101 | 80 | B-103 | 20 | 2.12 |
| Exemplified compound 1011 | A-101 | 35 | B-103 | 65 | 2.11 |
| Exemplified compound 1012 | A-101 | 20 | B-103 | 80 | 2.11 |
| Exemplified compound 1013 | A-101 | 49 | B-104 | 51 | 2.09 |
| Exemplified compound 1014 | A-101 | 80 | B-104 | 20 | 2.11 |
| Exemplified compound 1015 | A-101 | 35 | B-104 | 65 | 2.09 |
| Exemplified compound 1016 | A-101 | 20 | B-104 | 80 | 2.08 |
| Exemplified compound 1017 | A-101 | 49 | B-105 | 51 | 2.11 |
| Exemplified compound 1018 | A-101 | 80 | B-105 | 20 | 2.12 |
| Exemplified compound 1019 | A-101 | 35 | B-105 | 65 | 2.10 |
| Exemplified compound 1020 | A-101 | 20 | B-105 | 80 | 2.10 |
| Exemplified compound 1021 | A-101 | 49 | B-201 | 51 | 2.16 |
| Exemplified compound 1022 | A-101 | 80 | B-201 | 20 | 2.14 |
| Exemplified compound 1023 | A-101 | 35 | B-201 | 65 | 2.17 |
| Exemplified compound 1024 | A-101 | 20 | B-201 | 80 | 2.19 |
| Exemplified compound 1025 | A-101 | 49 | B-202 | 51 | 2.11 |
| Exemplified compound 1026 | A-101 | 80 | B-202 | 20 | 2.11 |
| Exemplified compound 1027 | A-101 | 35 | B-202 | 65 | 2.10 |
| Exemplified compound 1028 | A-101 | 20 | B-202 | 80 | 2.10 |

TABLE 1-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1029 | A-101 | 49 | B-203 | 51 | 2.14 |
| Exemplified compound 1030 | A-101 | 80 | B-203 | 20 | 2.13 |
| Exemplified compound 1031 | A-101 | 35 | B-203 | 65 | 2.14 |
| Exemplified compound 1032 | A-101 | 20 | B-203 | 80 | 2.15 |
| Exemplified compound 1033 | A-101 | 49 | B-204 | 51 | 2.10 |
| Exemplified compound 1034 | A-101 | 80 | B-204 | 20 | 2.11 |
| Exemplified compound 1035 | A-101 | 35 | B-204 | 65 | 2.09 |
| Exemplified compound 1036 | A-101 | 20 | B-204 | 80 | 2.08 |
| Exemplified compound 1037 | A-101 | 49 | B-205 | 51 | 2.14 |
| Exemplified compound 1038 | A-101 | 80 | B-205 | 20 | 2.13 |
| Exemplified compound 1039 | A-101 | 35 | B-205 | 65 | 2.14 |
| Exemplified compound 1040 | A-101 | 20 | B-205 | 80 | 2.14 |
| Exemplified compound 1041 | A-101 | 49 | B-301 | 51 | 2.13 |
| Exemplified compound 1042 | A-101 | 80 | B-301 | 20 | 2.12 |
| Exemplified compound 1043 | A-101 | 35 | B-301 | 65 | 2.13 |
| Exemplified compound 1044 | A-101 | 20 | B-301 | 80 | 2.13 |
| Exemplified compound 1045 | A-101 | 49 | B-302 | 51 | 2.13 |
| Exemplified compound 1046 | A-101 | 80 | B-302 | 20 | 2.12 |
| Exemplified compound 1047 | A-101 | 35 | B-302 | 65 | 2.13 |
| Exemplified compound 1048 | A-101 | 20 | B-302 | 80 | 2.13 |
| Exemplified compound 1049 | A-101 | 49 | B-303 | 51 | 2.14 |
| Exemplified compound 1050 | A-101 | 80 | B-303 | 20 | 2.13 |
| Exemplified compound 1051 | A-101 | 35 | B-303 | 65 | 2.14 |
| Exemplified compound 1052 | A-101 | 20 | B-303 | 80 | 2.15 |
| Exemplified compound 1053 | A-101 | 49 | B-304 | 51 | 2.13 |
| Exemplified compound 1054 | A-101 | 80 | B-304 | 20 | 2.12 |
| Exemplified compound 1055 | A-101 | 35 | B-304 | 65 | 2.13 |
| Exemplified compound 1056 | A-101 | 20 | B-304 | 80 | 2.14 |
| Exemplified compound 1057 | A-101 | 49 | B-305 | 51 | 2.08 |
| Exemplified compound 1058 | A-101 | 80 | B-305 | 20 | 2.10 |
| Exemplified compound 1059 | A-101 | 35 | B-305 | 65 | 2.06 |
| Exemplified compound 1060 | A-101 | 20 | B-305 | 80 | 2.05 |
| Exemplified compound 1061 | A-101 | 49 | B-306 | 51 | 2.14 |
| Exemplified compound 1062 | A-101 | 80 | B-306 | 20 | 2.13 |
| Exemplified compound 1063 | A-101 | 35 | B-306 | 65 | 2.15 |
| Exemplified compound 1064 | A-101 | 20 | B-306 | 80 | 2.16 |
| Exemplified compound 1065 | A-101 | 49 | B-307 | 51 | 2.13 |
| Exemplified compound 1066 | A-101 | 80 | B-307 | 20 | 2.12 |
| Exemplified compound 1067 | A-101 | 35 | B-307 | 65 | 2.13 |
| Exemplified compound 1068 | A-101 | 20 | B-307 | 80 | 2.13 |
| Exemplified compound 1069 | A-101 | 49 | B-308 | 51 | 2.13 |
| Exemplified compound 1070 | A-101 | 80 | B-308 | 20 | 2.13 |
| Exemplified compound 1071 | A-101 | 35 | B-308 | 65 | 2.14 |
| Exemplified compound 1072 | A-101 | 20 | B-308 | 80 | 2.14 |
| Exemplified compound 1073 | A-101 | 49 | B-401 | 51 | 2.17 |
| Exemplified compound 1074 | A-101 | 80 | B-401 | 20 | 2.14 |
| Exemplified compound 1075 | A-101 | 35 | B-401 | 65 | 2.19 |
| Exemplified compound 1076 | A-101 | 20 | B-401 | 80 | 2.20 |
| Exemplified compound 1077 | A-101 | 49 | B-402 | 51 | 2.21 |
| Exemplified compound 1078 | A-101 | 80 | B-402 | 20 | 2.16 |
| Exemplified compound 1079 | A-101 | 35 | B-402 | 65 | 2.24 |
| Exemplified compound 1080 | A-101 | 20 | B-402 | 80 | 2.26 |
| Exemplified compound 1081 | A-101 | 49 | B-403 | 51 | 2.27 |
| Exemplified compound 1082 | A-101 | 80 | B-403 | 20 | 2.18 |
| Exemplified compound 1083 | A-101 | 35 | B-403 | 65 | 2.31 |
| Exemplified compound 1084 | A-101 | 20 | B-403 | 80 | 2.35 |
| Exemplified compound 1085 | A-101 | 49 | B-404 | 51 | 2.14 |
| Exemplified compound 1086 | A-101 | 80 | B-404 | 20 | 2.13 |
| Exemplified compound 1087 | A-101 | 35 | B-404 | 65 | 2.15 |
| Exemplified compound 1088 | A-101 | 20 | B-404 | 80 | 2.16 |
| Exemplified compound 1089 | A-101 | 49 | B-405 | 51 | 2.21 |
| Exemplified compound 1090 | A-101 | 80 | B-405 | 20 | 2.15 |
| Exemplified compound 1091 | A-101 | 35 | B-405 | 65 | 2.23 |
| Exemplified compound 1092 | A-101 | 20 | B-405 | 80 | 2.25 |
| Exemplified compound 1093 | A-102 | 49 | B-101 | 51 | 2.11 |
| Exemplified compound 1094 | A-102 | 80 | B-101 | 20 | 2.11 |
| Exemplified compound 1095 | A-102 | 35 | B-101 | 65 | 2.11 |
| Exemplified compound 1096 | A-102 | 20 | B-101 | 80 | 2.11 |
| Exemplified compound 1097 | A-102 | 49 | B-102 | 51 | 2.16 |
| Exemplified compound 1098 | A-102 | 80 | B-102 | 20 | 2.13 |
| Exemplified compound 1099 | A-102 | 35 | B-102 | 65 | 2.18 |
| Exemplified compound 1100 | A-102 | 20 | B-102 | 80 | 2.19 |
| Exemplified compound 1101 | A-102 | 49 | B-103 | 51 | 2.11 |

TABLE 1-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1102 | A-102 | 80 | B-103 | 20 | 2.11 |
| Exemplified compound 1103 | A-102 | 35 | B-103 | 65 | 2.11 |
| Exemplified compound 1104 | A-102 | 20 | B-103 | 80 | 2.11 |
| Exemplified compound 1105 | A-102 | 49 | B-104 | 51 | 2.09 |
| Exemplified compound 1106 | A-102 | 80 | B-104 | 20 | 2.10 |
| Exemplified compound 1107 | A-102 | 35 | B-104 | 65 | 2.08 |
| Exemplified compound 1108 | A-102 | 20 | B-104 | 80 | 2.08 |
| Exemplified compound 1109 | A-102 | 49 | B-105 | 51 | 2.10 |
| Exemplified compound 1110 | A-102 | 80 | B-105 | 20 | 2.11 |
| Exemplified compound 1111 | A-102 | 35 | B-105 | 65 | 2.10 |
| Exemplified compound 1112 | A-102 | 20 | B-105 | 80 | 2.10 |
| Exemplified compound 1113 | A-102 | 49 | B-201 | 51 | 2.16 |
| Exemplified compound 1114 | A-102 | 80 | B-201 | 20 | 2.13 |
| Exemplified compound 1115 | A-102 | 35 | B-201 | 65 | 2.17 |
| Exemplified compound 1116 | A-102 | 20 | B-201 | 80 | 2.18 |
| Exemplified compound 1117 | A-102 | 49 | B-202 | 51 | 2.10 |
| Exemplified compound 1118 | A-102 | 80 | B-202 | 20 | 2.11 |
| Exemplified compound 1119 | A-102 | 35 | B-202 | 65 | 2.10 |
| Exemplified compound 1120 | A-102 | 20 | B-202 | 80 | 2.09 |

TABLE 2

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1121 | A-102 | 49 | B-203 | 51 | 2.13 |
| Exemplified compound 1122 | A-102 | 80 | B-203 | 20 | 2.12 |
| Exemplified compound 1123 | A-102 | 35 | B-203 | 65 | 2.14 |
| Exemplified compound 1124 | A-102 | 20 | B-203 | 80 | 2.14 |
| Exemplified compound 1125 | A-102 | 49 | B-204 | 51 | 2.09 |
| Exemplified compound 1126 | A-102 | 80 | B-204 | 20 | 2.10 |
| Exemplified compound 1127 | A-102 | 35 | B-204 | 65 | 2.09 |
| Exemplified compound 1128 | A-102 | 20 | B-204 | 80 | 2.08 |
| Exemplified compound 1129 | A-102 | 49 | B-205 | 51 | 2.13 |
| Exemplified compound 1130 | A-102 | 80 | B-205 | 20 | 2.12 |
| Exemplified compound 1131 | A-102 | 35 | B-205 | 65 | 2.14 |
| Exemplified compound 1132 | A-102 | 20 | B-205 | 80 | 2.14 |
| Exemplified compound 1133 | A-102 | 49 | B-301 | 51 | 2.12 |
| Exemplified compound 1134 | A-102 | 80 | B-301 | 20 | 2.11 |
| Exemplified compound 1135 | A-102 | 35 | B-301 | 65 | 2.12 |
| Exemplified compound 1136 | A-102 | 20 | B-301 | 80 | 2.13 |
| Exemplified compound 1137 | A-102 | 49 | B-302 | 51 | 2.12 |
| Exemplified compound 1138 | A-102 | 80 | B-302 | 20 | 2.11 |
| Exemplified compound 1139 | A-102 | 35 | B-302 | 65 | 2.12 |
| Exemplified compound 1140 | A-102 | 20 | B-302 | 80 | 2.13 |
| Exemplified compound 1141 | A-102 | 49 | B-303 | 51 | 2.13 |
| Exemplified compound 1142 | A-102 | 80 | B-303 | 20 | 2.12 |
| Exemplified compound 1143 | A-102 | 35 | B-303 | 65 | 2.14 |
| Exemplified compound 1144 | A-102 | 20 | B-303 | 80 | 2.14 |
| Exemplified compound 1145 | A-102 | 49 | B-304 | 51 | 2.13 |
| Exemplified compound 1146 | A-102 | 80 | B-304 | 20 | 2.12 |
| Exemplified compound 1147 | A-102 | 35 | B-304 | 65 | 2.13 |
| Exemplified compound 1148 | A-102 | 20 | B-304 | 80 | 2.13 |
| Exemplified compound 1149 | A-102 | 49 | B-305 | 51 | 2.07 |
| Exemplified compound 1150 | A-102 | 80 | B-305 | 20 | 2.10 |
| Exemplified compound 1151 | A-102 | 35 | B-305 | 65 | 2.06 |
| Exemplified compound 1152 | A-102 | 20 | B-305 | 80 | 2.05 |
| Exemplified compound 1153 | A-102 | 49 | B-306 | 51 | 2.14 |
| Exemplified compound 1154 | A-102 | 80 | B-306 | 20 | 2.12 |
| Exemplified compound 1155 | A-102 | 35 | B-306 | 65 | 2.14 |
| Exemplified compound 1156 | A-102 | 20 | B-306 | 80 | 2.15 |
| Exemplified compound 1157 | A-102 | 49 | B-307 | 51 | 2.12 |
| Exemplified compound 1158 | A-102 | 80 | B-307 | 20 | 2.11 |
| Exemplified compound 1159 | A-102 | 35 | B-307 | 65 | 2.12 |
| Exemplified compound 1160 | A-102 | 20 | B-307 | 80 | 2.13 |
| Exemplified compound 1161 | A-102 | 49 | B-308 | 51 | 2.13 |

TABLE 2-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1162 | A-102 | 80 | B-308 | 20 | 2.12 |
| Exemplified compound 1163 | A-102 | 35 | B-308 | 65 | 2.13 |
| Exemplified compound 1164 | A-102 | 20 | B-308 | 80 | 2.14 |
| Exemplified compound 1165 | A-102 | 49 | B-401 | 51 | 2.17 |
| Exemplified compound 1166 | A-102 | 80 | B-401 | 20 | 2.13 |
| Exemplified compound 1167 | A-102 | 35 | B-401 | 65 | 2.18 |
| Exemplified compound 1168 | A-102 | 20 | B-401 | 80 | 2.20 |
| Exemplified compound 1169 | A-102 | 49 | B-402 | 51 | 2.21 |
| Exemplified compound 1170 | A-102 | 80 | B-402 | 20 | 2.15 |
| Exemplified compound 1171 | A-102 | 35 | B-402 | 65 | 2.23 |
| Exemplified compound 1172 | A-102 | 20 | B-402 | 80 | 2.26 |
| Exemplified compound 1173 | A-102 | 49 | B-403 | 51 | 2.26 |
| Exemplified compound 1174 | A-102 | 80 | B-403 | 20 | 2.17 |
| Exemplified compound 1175 | A-102 | 35 | B-403 | 65 | 2.30 |
| Exemplified compound 1176 | A-102 | 20 | B-403 | 80 | 2.35 |
| Exemplified compound 1177 | A-102 | 49 | B-404 | 51 | 2.14 |
| Exemplified compound 1178 | A-102 | 80 | B-404 | 20 | 2.12 |
| Exemplified compound 1179 | A-102 | 35 | B-404 | 65 | 2.15 |
| Exemplified compound 1180 | A-102 | 20 | B-404 | 80 | 2.16 |
| Exemplified compound 1181 | A-102 | 49 | B-405 | 51 | 2.20 |
| Exemplified compound 1182 | A-102 | 80 | B-405 | 20 | 2.15 |
| Exemplified compound 1183 | A-102 | 35 | B-405 | 65 | 2.22 |
| Exemplified compound 1184 | A-102 | 20 | B-405 | 80 | 2.25 |
| Exemplified compound 1185 | A-103 | 49 | B-101 | 51 | 2.16 |
| Exemplified compound 1186 | A-103 | 80 | B-101 | 20 | 2.19 |
| Exemplified compound 1187 | A-103 | 35 | B-101 | 65 | 2.14 |
| Exemplified compound 1188 | A-103 | 20 | B-101 | 80 | 2.13 |
| Exemplified compound 1189 | A-103 | 49 | B-102 | 51 | 2.21 |
| Exemplified compound 1190 | A-103 | 80 | B-102 | 20 | 2.21 |
| Exemplified compound 1191 | A-103 | 35 | B-102 | 65 | 2.21 |
| Exemplified compound 1192 | A-103 | 20 | B-102 | 80 | 2.21 |
| Exemplified compound 1193 | A-103 | 49 | B-103 | 51 | 2.16 |
| Exemplified compound 1194 | A-103 | 80 | B-103 | 20 | 2.19 |
| Exemplified compound 1195 | A-103 | 35 | B-103 | 65 | 2.14 |
| Exemplified compound 1196 | A-103 | 20 | B-103 | 80 | 2.13 |
| Exemplified compound 1197 | A-103 | 49 | B-104 | 51 | 2.14 |
| Exemplified compound 1198 | A-103 | 80 | B-104 | 20 | 2.18 |
| Exemplified compound 1199 | A-103 | 35 | B-104 | 65 | 2.12 |
| Exemplified compound 1200 | A-103 | 20 | B-104 | 80 | 2.10 |
| Exemplified compound 1201 | A-103 | 49 | B-105 | 51 | 2.15 |
| Exemplified compound 1202 | A-103 | 80 | B-105 | 20 | 2.18 |
| Exemplified compound 1203 | A-103 | 35 | B-105 | 65 | 2.13 |
| Exemplified compound 1204 | A-103 | 20 | B-105 | 80 | 2.12 |
| Exemplified compound 1205 | A-103 | 49 | B-201 | 51 | 2.20 |
| Exemplified compound 1206 | A-103 | 80 | B-201 | 20 | 2.21 |
| Exemplified compound 1207 | A-103 | 35 | B-201 | 65 | 2.20 |
| Exemplified compound 1208 | A-103 | 20 | B-201 | 80 | 2.20 |
| Exemplified compound 1209 | A-103 | 49 | B-202 | 51 | 2.15 |
| Exemplified compound 1210 | A-103 | 80 | B-202 | 20 | 2.18 |
| Exemplified compound 1211 | A-103 | 35 | B-202 | 65 | 2.13 |
| Exemplified compound 1212 | A-103 | 20 | B-202 | 80 | 2.11 |
| Exemplified compound 1213 | A-103 | 49 | B-203 | 51 | 2.18 |
| Exemplified compound 1214 | A-103 | 80 | B-203 | 20 | 2.20 |
| Exemplified compound 1215 | A-103 | 35 | B-203 | 65 | 2.17 |
| Exemplified compound 1216 | A-103 | 20 | B-203 | 80 | 2.16 |
| Exemplified compound 1217 | A-103 | 49 | B-204 | 51 | 2.14 |
| Exemplified compound 1218 | A-103 | 80 | B-204 | 20 | 2.18 |
| Exemplified compound 1219 | A-103 | 35 | B-204 | 65 | 2.12 |
| Exemplified compound 1220 | A-103 | 20 | B-204 | 80 | 2.10 |
| Exemplified compound 1221 | A-103 | 49 | B-205 | 51 | 2.18 |
| Exemplified compound 1222 | A-103 | 80 | B-205 | 20 | 2.20 |
| Exemplified compound 1223 | A-103 | 35 | B-205 | 65 | 2.17 |
| Exemplified compound 1224 | A-103 | 20 | B-205 | 80 | 2.16 |
| Exemplified compound 1225 | A-103 | 49 | B-301 | 51 | 2.17 |
| Exemplified compound 1226 | A-103 | 80 | B-301 | 20 | 2.19 |
| Exemplified compound 1227 | A-103 | 35 | B-301 | 65 | 2.16 |
| Exemplified compound 1228 | A-103 | 20 | B-301 | 80 | 2.15 |
| Exemplified compound 1229 | A-103 | 49 | B-302 | 51 | 2.17 |
| Exemplified compound 1230 | A-103 | 80 | B-302 | 20 | 2.19 |
| Exemplified compound 1231 | A-103 | 35 | B-302 | 65 | 2.16 |
| Exemplified compound 1232 | A-103 | 20 | B-302 | 80 | 2.15 |
| Exemplified compound 1233 | A-103 | 49 | B-303 | 51 | 2.18 |
| Exemplified compound 1234 | A-103 | 80 | B-303 | 20 | 2.20 |

TABLE 2-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1235 | A-103 | 35 | B-303 | 65 | 2.17 |
| Exemplified compound 1236 | A-103 | 20 | B-303 | 80 | 2.16 |
| Exemplified compound 1237 | A-103 | 49 | B-304 | 51 | 2.17 |
| Exemplified compound 1238 | A-103 | 80 | B-304 | 20 | 2.19 |
| Exemplified compound 1239 | A-103 | 35 | B-304 | 65 | 2.16 |
| Exemplified compound 1240 | A-103 | 20 | B-304 | 80 | 2.15 |

TABLE 3

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1241 | A-103 | 49 | B-305 | 51 | 2.12 |
| Exemplified compound 1242 | A-103 | 80 | B-305 | 20 | 2.17 |
| Exemplified compound 1243 | A-103 | 35 | B-305 | 65 | 2.09 |
| Exemplified compound 1244 | A-103 | 20 | B-305 | 80 | 2.07 |
| Exemplified compound 1245 | A-103 | 49 | B-306 | 51 | 2.18 |
| Exemplified compound 1246 | A-103 | 80 | B-306 | 20 | 2.20 |
| Exemplified compound 1247 | A-103 | 35 | B-306 | 65 | 2.18 |
| Exemplified compound 1248 | A-103 | 20 | B-306 | 80 | 2.17 |
| Exemplified compound 1249 | A-103 | 49 | B-307 | 51 | 2.17 |
| Exemplified compound 1250 | A-103 | 80 | B-307 | 20 | 2.19 |
| Exemplified compound 1251 | A-103 | 35 | B-307 | 65 | 2.16 |
| Exemplified compound 1252 | A-103 | 20 | B-307 | 80 | 2.14 |
| Exemplified compound 1253 | A-103 | 49 | B-308 | 51 | 2.18 |
| Exemplified compound 1254 | A-103 | 80 | B-308 | 20 | 2.19 |
| Exemplified compound 1255 | A-103 | 35 | B-308 | 65 | 2.17 |
| Exemplified compound 1256 | A-103 | 20 | B-308 | 80 | 2.16 |
| Exemplified compound 1257 | A-103 | 49 | B-401 | 51 | 2.21 |
| Exemplified compound 1258 | A-103 | 80 | B-401 | 20 | 2.21 |
| Exemplified compound 1259 | A-103 | 35 | B-401 | 65 | 2.22 |
| Exemplified compound 1260 | A-103 | 20 | B-401 | 80 | 2.22 |
| Exemplified compound 1261 | A-103 | 49 | B-402 | 51 | 2.25 |
| Exemplified compound 1262 | A-103 | 80 | B-402 | 20 | 2.23 |
| Exemplified compound 1263 | A-103 | 35 | B-402 | 65 | 2.27 |
| Exemplified compound 1264 | A-103 | 20 | B-402 | 80 | 2.28 |
| Exemplified compound 1265 | A-103 | 49 | B-403 | 51 | 2.31 |
| Exemplified compound 1266 | A-103 | 80 | B-403 | 20 | 2.25 |
| Exemplified compound 1267 | A-103 | 35 | B-403 | 65 | 2.34 |
| Exemplified compound 1268 | A-103 | 20 | B-403 | 80 | 2.37 |
| Exemplified compound 1269 | A-103 | 49 | B-404 | 51 | 2.19 |
| Exemplified compound 1270 | A-103 | 80 | B-404 | 20 | 2.20 |
| Exemplified compound 1271 | A-103 | 35 | B-404 | 65 | 2.18 |
| Exemplified compound 1272 | A-103 | 20 | B-404 | 80 | 2.17 |
| Exemplified compound 1273 | A-103 | 49 | B-405 | 51 | 2.25 |
| Exemplified compound 1274 | A-103 | 80 | B-405 | 20 | 2.22 |
| Exemplified compound 1275 | A-103 | 35 | B-405 | 65 | 2.26 |
| Exemplified compound 1276 | A-103 | 20 | B-405 | 80 | 2.27 |
| Exemplified compound 1277 | A-104 | 49 | B-101 | 51 | 2.06 |
| Exemplified compound 1278 | A-104 | 80 | B-101 | 20 | 2.03 |
| Exemplified compound 1279 | A-104 | 35 | B-101 | 65 | 2.07 |
| Exemplified compound 1280 | A-104 | 20 | B-101 | 80 | 2.09 |
| Exemplified compound 1281 | A-104 | 49 | B-102 | 51 | 2.11 |
| Exemplified compound 1282 | A-104 | 80 | B-102 | 20 | 2.05 |
| Exemplified compound 1283 | A-104 | 35 | B-102 | 65 | 2.14 |
| Exemplified compound 1284 | A-104 | 20 | B-102 | 80 | 2.17 |
| Exemplified compound 1285 | A-104 | 49 | B-103 | 51 | 2.06 |
| Exemplified compound 1286 | A-104 | 80 | B-103 | 20 | 2.03 |
| Exemplified compound 1287 | A-104 | 35 | B-103 | 65 | 2.07 |
| Exemplified compound 1288 | A-104 | 20 | B-103 | 80 | 2.09 |
| Exemplified compound 1289 | A-104 | 49 | B-104 | 51 | 2.04 |
| Exemplified compound 1290 | A-104 | 80 | B-104 | 20 | 2.02 |
| Exemplified compound 1291 | A-104 | 35 | B-104 | 65 | 2.05 |
| Exemplified compound 1292 | A-104 | 20 | B-104 | 80 | 2.06 |
| Exemplified compound 1293 | A-104 | 49 | B-105 | 51 | 2.05 |
| Exemplified compound 1294 | A-104 | 80 | B-105 | 20 | 2.03 |

TABLE 3-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1295 | A-104 | 35 | B-105 | 65 | 2.07 |
| Exemplified compound 1296 | A-104 | 20 | B-105 | 80 | 2.08 |
| Exemplified compound 1297 | A-104 | 49 | B-201 | 51 | 2.11 |
| Exemplified compound 1298 | A-104 | 80 | B-201 | 20 | 2.05 |
| Exemplified compound 1299 | A-104 | 35 | B-201 | 65 | 2.13 |
| Exemplified compound 1300 | A-104 | 20 | B-201 | 80 | 2.16 |
| Exemplified compound 1301 | A-104 | 49 | B-202 | 51 | 2.05 |
| Exemplified compound 1302 | A-104 | 80 | B-202 | 20 | 2.02 |
| Exemplified compound 1303 | A-104 | 35 | B-202 | 65 | 2.06 |
| Exemplified compound 1304 | A-104 | 20 | B-202 | 80 | 2.07 |
| Exemplified compound 1305 | A-104 | 49 | B-203 | 51 | 2.08 |
| Exemplified compound 1306 | A-104 | 80 | B-203 | 20 | 2.04 |
| Exemplified compound 1307 | A-104 | 35 | B-203 | 65 | 2.10 |
| Exemplified compound 1308 | A-104 | 20 | B-203 | 80 | 2.12 |
| Exemplified compound 1309 | A-104 | 49 | B-204 | 51 | 2.04 |
| Exemplified compound 1310 | A-104 | 80 | B-204 | 20 | 2.02 |
| Exemplified compound 1311 | A-104 | 35 | B-204 | 65 | 2.05 |
| Exemplified compound 1312 | A-104 | 20 | B-204 | 80 | 2.06 |
| Exemplified compound 1313 | A-104 | 49 | B-205 | 51 | 2.08 |
| Exemplified compound 1314 | A-104 | 80 | B-205 | 20 | 2.04 |
| Exemplified compound 1315 | A-104 | 35 | B-205 | 65 | 2.10 |
| Exemplified compound 1316 | A-104 | 20 | B-205 | 80 | 2.12 |
| Exemplified compound 1317 | A-104 | 49 | B-301 | 51 | 2.07 |
| Exemplified compound 1318 | A-104 | 80 | B-301 | 20 | 2.03 |
| Exemplified compound 1319 | A-104 | 35 | B-301 | 65 | 2.09 |
| Exemplified compound 1320 | A-104 | 20 | B-301 | 80 | 2.11 |
| Exemplified compound 1321 | A-104 | 49 | B-302 | 51 | 2.07 |
| Exemplified compound 1322 | A-104 | 80 | B-302 | 20 | 2.03 |
| Exemplified compound 1323 | A-104 | 35 | B-302 | 65 | 2.09 |
| Exemplified compound 1324 | A-104 | 20 | B-302 | 80 | 2.11 |
| Exemplified compound 1325 | A-104 | 49 | B-303 | 51 | 2.08 |
| Exemplified compound 1326 | A-104 | 80 | B-303 | 20 | 2.04 |
| Exemplified compound 1327 | A-104 | 35 | B-303 | 65 | 2.10 |
| Exemplified compound 1328 | A-104 | 20 | B-303 | 80 | 2.12 |
| Exemplified compound 1329 | A-104 | 49 | B-304 | 51 | 2.08 |
| Exemplified compound 1330 | A-104 | 80 | B-304 | 20 | 2.03 |
| Exemplified compound 1331 | A-104 | 35 | B-304 | 65 | 2.09 |
| Exemplified compound 1332 | A-104 | 20 | B-304 | 80 | 2.11 |
| Exemplified compound 1333 | A-104 | 49 | B-305 | 51 | 2.02 |
| Exemplified compound 1334 | A-104 | 80 | B-305 | 20 | 2.01 |
| Exemplified compound 1335 | A-104 | 35 | B-305 | 65 | 2.03 |
| Exemplified compound 1336 | A-104 | 20 | B-305 | 80 | 2.03 |
| Exemplified compound 1337 | A-104 | 49 | B-306 | 51 | 2.09 |
| Exemplified compound 1338 | A-104 | 80 | B-306 | 20 | 2.04 |
| Exemplified compound 1339 | A-104 | 35 | B-306 | 65 | 2.11 |
| Exemplified compound 1340 | A-104 | 20 | B-306 | 80 | 2.13 |
| Exemplified compound 1341 | A-104 | 49 | B-307 | 51 | 2.07 |
| Exemplified compound 1342 | A-104 | 80 | B-307 | 20 | 2.03 |
| Exemplified compound 1343 | A-104 | 35 | B-307 | 65 | 2.09 |
| Exemplified compound 1344 | A-104 | 20 | B-307 | 80 | 2.11 |
| Exemplified compound 1345 | A-104 | 49 | B-308 | 51 | 2.08 |
| Exemplified compound 1346 | A-104 | 80 | B-308 | 20 | 2.04 |
| Exemplified compound 1347 | A-104 | 35 | B-308 | 65 | 2.10 |
| Exemplified compound 1348 | A-104 | 20 | B-308 | 80 | 2.12 |
| Exemplified compound 1349 | A-104 | 49 | B-401 | 51 | 2.12 |
| Exemplified compound 1350 | A-104 | 80 | B-401 | 20 | 2.05 |
| Exemplified compound 1351 | A-104 | 35 | B-401 | 65 | 2.15 |
| Exemplified compound 1352 | A-104 | 20 | B-401 | 80 | 2.18 |
| Exemplified compound 1353 | A-104 | 49 | B-402 | 51 | 2.16 |
| Exemplified compound 1354 | A-104 | 80 | B-402 | 20 | 2.07 |
| Exemplified compound 1355 | A-104 | 35 | B-402 | 65 | 2.20 |
| Exemplified compound 1356 | A-104 | 20 | B-402 | 80 | 2.24 |
| Exemplified compound 1357 | A-104 | 49 | B-403 | 51 | 2.21 |
| Exemplified compound 1358 | A-104 | 80 | B-403 | 20 | 2.09 |
| Exemplified compound 1359 | A-104 | 35 | B-403 | 65 | 2.27 |
| Exemplified compound 1360 | A-104 | 20 | B-403 | 80 | 2.33 |

TABLE 4

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1361 | A-104 | 49 | B-404 | 51 | 2.09 |
| Exemplified compound 1362 | A-104 | 80 | B-404 | 20 | 2.04 |
| Exemplified compound 1363 | A-104 | 35 | B-404 | 65 | 2.11 |
| Exemplified compound 1364 | A-104 | 20 | B-404 | 80 | 2.13 |
| Exemplified compound 1365 | A-104 | 49 | B-405 | 51 | 2.15 |
| Exemplified compound 1366 | A-104 | 80 | B-405 | 20 | 2.06 |
| Exemplified compound 1367 | A-104 | 35 | B-405 | 65 | 2.19 |
| Exemplified compound 1368 | A-104 | 20 | B-405 | 80 | 2.23 |
| Exemplified compound 1369 | A-105 | 49 | B-101 | 51 | 2.17 |
| Exemplified compound 1370 | A-105 | 80 | B-101 | 20 | 2.21 |
| Exemplified compound 1371 | A-105 | 35 | B-101 | 65 | 2.15 |
| Exemplified compound 1372 | A-105 | 20 | B-101 | 80 | 2.13 |
| Exemplified compound 1373 | A-105 | 49 | B-102 | 51 | 2.22 |
| Exemplified compound 1374 | A-105 | 80 | B-102 | 20 | 2.23 |
| Exemplified compound 1375 | A-105 | 35 | B-102 | 65 | 2.22 |
| Exemplified compound 1376 | A-105 | 20 | B-102 | 80 | 2.22 |
| Exemplified compound 1377 | A-105 | 49 | B-103 | 51 | 2.17 |
| Exemplified compound 1378 | A-105 | 80 | B-103 | 20 | 2.21 |
| Exemplified compound 1379 | A-105 | 35 | B-103 | 65 | 2.15 |
| Exemplified compound 1380 | A-105 | 20 | B-103 | 80 | 2.13 |
| Exemplified compound 1381 | A-105 | 49 | B-104 | 51 | 2.15 |
| Exemplified compound 1382 | A-105 | 80 | B-104 | 20 | 2.20 |
| Exemplified compound 1383 | A-105 | 35 | B-104 | 65 | 2.13 |
| Exemplified compound 1384 | A-105 | 20 | B-104 | 80 | 2.10 |
| Exemplified compound 1385 | A-105 | 49 | B-105 | 51 | 2.16 |
| Exemplified compound 1386 | A-105 | 80 | B-105 | 20 | 2.21 |
| Exemplified compound 1387 | A-105 | 35 | B-105 | 65 | 2.14 |
| Exemplified compound 1388 | A-105 | 20 | B-105 | 80 | 2.12 |
| Exemplified compound 1389 | A-105 | 49 | B-201 | 51 | 2.22 |
| Exemplified compound 1390 | A-105 | 80 | B-201 | 20 | 2.23 |
| Exemplified compound 1391 | A-105 | 35 | B-201 | 65 | 2.21 |
| Exemplified compound 1392 | A-105 | 20 | B-201 | 80 | 2.21 |
| Exemplified compound 1393 | A-105 | 49 | B-202 | 51 | 2.16 |
| Exemplified compound 1394 | A-105 | 80 | B-202 | 20 | 2.21 |
| Exemplified compound 1395 | A-105 | 35 | B-202 | 65 | 2.14 |
| Exemplified compound 1396 | A-105 | 20 | B-202 | 80 | 2.12 |
| Exemplified compound 1397 | A-105 | 49 | B-203 | 51 | 2.19 |
| Exemplified compound 1398 | A-105 | 80 | B-203 | 20 | 2.22 |
| Exemplified compound 1399 | A-105 | 35 | B-203 | 65 | 2.18 |
| Exemplified compound 1400 | A-105 | 20 | B-203 | 80 | 2.17 |
| Exemplified compound 1401 | A-105 | 49 | B-204 | 51 | 2.15 |
| Exemplified compound 1402 | A-105 | 80 | B-204 | 20 | 2.20 |
| Exemplified compound 1403 | A-105 | 35 | B-204 | 65 | 2.13 |
| Exemplified compound 1404 | A-105 | 20 | B-204 | 80 | 2.11 |
| Exemplified compound 1405 | A-105 | 49 | B-205 | 51 | 2.19 |
| Exemplified compound 1406 | A-105 | 80 | B-205 | 20 | 2.22 |
| Exemplified compound 1407 | A-105 | 35 | B-205 | 65 | 2.18 |
| Exemplified compound 1408 | A-105 | 20 | B-205 | 80 | 2.17 |
| Exemplified compound 1409 | A-105 | 49 | B-301 | 51 | 2.18 |
| Exemplified compound 1410 | A-105 | 80 | B-301 | 20 | 2.21 |
| Exemplified compound 1411 | A-105 | 35 | B-301 | 65 | 2.17 |
| Exemplified compound 1412 | A-105 | 20 | B-301 | 80 | 2.15 |
| Exemplified compound 1413 | A-105 | 49 | B-302 | 51 | 2.18 |
| Exemplified compound 1414 | A-105 | 80 | B-302 | 20 | 2.21 |
| Exemplified compound 1415 | A-105 | 35 | B-302 | 65 | 2.17 |
| Exemplified compound 1416 | A-105 | 20 | B-302 | 80 | 2.15 |
| Exemplified compound 1417 | A-105 | 49 | B-303 | 51 | 2.19 |
| Exemplified compound 1418 | A-105 | 80 | B-303 | 20 | 2.22 |
| Exemplified compound 1419 | A-105 | 35 | B-303 | 65 | 2.18 |
| Exemplified compound 1420 | A-105 | 20 | B-303 | 80 | 2.17 |
| Exemplified compound 1421 | A-105 | 49 | B-304 | 51 | 2.19 |
| Exemplified compound 1422 | A-105 | 80 | B-304 | 20 | 2.22 |
| Exemplified compound 1423 | A-105 | 35 | B-304 | 65 | 2.17 |
| Exemplified compound 1424 | A-105 | 20 | B-304 | 80 | 2.16 |
| Exemplified compound 1425 | A-105 | 49 | B-305 | 51 | 2.13 |
| Exemplified compound 1426 | A-105 | 80 | B-305 | 20 | 2.19 |
| Exemplified compound 1427 | A-105 | 35 | B-305 | 65 | 2.10 |
| Exemplified compound 1428 | A-105 | 20 | B-305 | 80 | 2.07 |
| Exemplified compound 1429 | A-105 | 49 | B-306 | 51 | 2.20 |
| Exemplified compound 1430 | A-105 | 80 | B-306 | 20 | 2.22 |
| Exemplified compound 1431 | A-105 | 35 | B-306 | 65 | 2.19 |
| Exemplified compound 1432 | A-105 | 20 | B-306 | 80 | 2.18 |
| Exemplified compound 1433 | A-105 | 49 | B-307 | 51 | 2.18 |

TABLE 4-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1434 | A-105 | 80 | B-307 | 20 | 2.21 |
| Exemplified compound 1435 | A-105 | 35 | B-307 | 65 | 2.17 |
| Exemplified compound 1436 | A-105 | 20 | B-307 | 80 | 2.15 |
| Exemplified compound 1437 | A-105 | 49 | B-308 | 51 | 2.19 |
| Exemplified compound 1438 | A-105 | 80 | B-308 | 20 | 2.22 |
| Exemplified compound 1439 | A-105 | 35 | B-308 | 65 | 2.18 |
| Exemplified compound 1440 | A-105 | 20 | B-308 | 80 | 2.17 |
| Exemplified compound 1441 | A-105 | 49 | B-401 | 51 | 2.23 |
| Exemplified compound 1442 | A-105 | 80 | B-401 | 20 | 2.23 |
| Exemplified compound 1443 | A-105 | 35 | B-401 | 65 | 2.23 |
| Exemplified compound 1444 | A-105 | 20 | B-401 | 80 | 2.22 |
| Exemplified compound 1445 | A-105 | 49 | B-402 | 51 | 2.27 |
| Exemplified compound 1446 | A-105 | 80 | B-402 | 20 | 2.25 |
| Exemplified compound 1447 | A-105 | 35 | B-402 | 65 | 2.28 |
| Exemplified compound 1448 | A-105 | 20 | B-402 | 80 | 2.29 |
| Exemplified compound 1449 | A-105 | 49 | B-403 | 51 | 2.32 |
| Exemplified compound 1450 | A-105 | 80 | B-403 | 20 | 2.27 |
| Exemplified compound 1451 | A-105 | 35 | B-403 | 65 | 2.35 |
| Exemplified compound 1452 | A-105 | 20 | B-403 | 80 | 2.37 |
| Exemplified compound 1453 | A-105 | 49 | B-404 | 51 | 2.20 |
| Exemplified compound 1454 | A-105 | 80 | B-404 | 20 | 2.22 |
| Exemplified compound 1455 | A-105 | 35 | B-404 | 65 | 2.19 |
| Exemplified compound 1456 | A-105 | 20 | B-404 | 80 | 2.18 |
| Exemplified compound 1457 | A-105 | 49 | B-405 | 51 | 2.26 |
| Exemplified compound 1458 | A-105 | 80 | B-405 | 20 | 2.25 |
| Exemplified compound 1459 | A-105 | 35 | B-405 | 65 | 2.27 |
| Exemplified compound 1460 | A-105 | 20 | B-405 | 80 | 2.28 |
| Exemplified compound 1461 | A-201 | 49 | B-101 | 51 | 2.11 |
| Exemplified compound 1462 | A-201 | 80 | B-101 | 20 | 2.12 |
| Exemplified compound 1463 | A-201 | 35 | B-101 | 65 | 2.11 |
| Exemplified compound 1464 | A-201 | 20 | B-101 | 80 | 2.11 |
| Exemplified compound 1465 | A-201 | 49 | B-102 | 51 | 2.17 |
| Exemplified compound 1466 | A-201 | 80 | B-102 | 20 | 2.14 |
| Exemplified compound 1467 | A-201 | 35 | B-102 | 65 | 2.18 |
| Exemplified compound 1468 | A-201 | 20 | B-102 | 80 | 2.19 |
| Exemplified compound 1469 | A-201 | 49 | B-103 | 51 | 2.11 |
| Exemplified compound 1470 | A-201 | 80 | B-103 | 20 | 2.12 |
| Exemplified compound 1471 | A-201 | 35 | B-103 | 65 | 2.11 |
| Exemplified compound 1472 | A-201 | 20 | B-103 | 80 | 2.11 |
| Exemplified compound 1473 | A-201 | 49 | B-104 | 51 | 2.09 |
| Exemplified compound 1474 | A-201 | 80 | B-104 | 20 | 2.11 |
| Exemplified compound 1475 | A-201 | 35 | B-104 | 65 | 2.09 |
| Exemplified compound 1476 | A-201 | 20 | B-104 | 80 | 2.08 |
| Exemplified compound 1477 | A-201 | 49 | B-105 | 51 | 2.11 |
| Exemplified compound 1478 | A-201 | 80 | B-105 | 20 | 2.11 |
| Exemplified compound 1479 | A-201 | 35 | B-105 | 65 | 2.10 |
| Exemplified compound 1480 | A-201 | 20 | B-105 | 80 | 2.10 |

TABLE 5

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1481 | A-201 | 49 | B-201 | 51 | 2.16 |
| Exemplified compound 1482 | A-201 | 80 | B-201 | 20 | 2.13 |
| Exemplified compound 1483 | A-201 | 35 | B-201 | 65 | 2.17 |
| Exemplified compound 1484 | A-201 | 20 | B-201 | 80 | 2.19 |
| Exemplified compound 1485 | A-201 | 49 | B-202 | 51 | 2.10 |
| Exemplified compound 1486 | A-201 | 80 | B-202 | 20 | 2.11 |
| Exemplified compound 1487 | A-201 | 35 | B-202 | 65 | 2.10 |
| Exemplified compound 1488 | A-201 | 20 | B-202 | 80 | 2.10 |
| Exemplified compound 1489 | A-201 | 49 | B-203 | 51 | 2.14 |
| Exemplified compound 1490 | A-201 | 80 | B-203 | 20 | 2.13 |
| Exemplified compound 1491 | A-201 | 35 | B-203 | 65 | 2.14 |
| Exemplified compound 1492 | A-201 | 20 | B-203 | 80 | 2.15 |
| Exemplified compound 1493 | A-201 | 49 | B-204 | 51 | 2.10 |

TABLE 5-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1494 | A-201 | 80 | B-204 | 20 | 2.11 |
| Exemplified compound 1495 | A-201 | 35 | B-204 | 65 | 2.09 |
| Exemplified compound 1496 | A-201 | 20 | B-204 | 80 | 2.08 |
| Exemplified compound 1497 | A-201 | 49 | B-205 | 51 | 2.13 |
| Exemplified compound 1498 | A-201 | 80 | B-205 | 20 | 2.12 |
| Exemplified compound 1499 | A-201 | 35 | B-205 | 65 | 2.14 |
| Exemplified compound 1500 | A-201 | 20 | B-205 | 80 | 2.14 |
| Exemplified compound 1501 | A-201 | 49 | B-301 | 51 | 2.13 |
| Exemplified compound 1502 | A-201 | 80 | B-301 | 20 | 2.12 |
| Exemplified compound 1503 | A-201 | 35 | B-301 | 65 | 2.13 |
| Exemplified compound 1504 | A-201 | 20 | B-301 | 80 | 2.13 |
| Exemplified compound 1505 | A-201 | 49 | B-302 | 51 | 2.12 |
| Exemplified compound 1506 | A-201 | 80 | B-302 | 20 | 2.12 |
| Exemplified compound 1507 | A-201 | 35 | B-302 | 65 | 2.13 |
| Exemplified compound 1508 | A-201 | 20 | B-302 | 80 | 2.13 |
| Exemplified compound 1509 | A-201 | 49 | B-303 | 51 | 2.14 |
| Exemplified compound 1510 | A-201 | 80 | B-303 | 20 | 2.12 |
| Exemplified compound 1511 | A-201 | 35 | B-303 | 65 | 2.14 |
| Exemplified compound 1512 | A-201 | 20 | B-303 | 80 | 2.15 |
| Exemplified compound 1513 | A-201 | 49 | B-304 | 51 | 2.13 |
| Exemplified compound 1514 | A-201 | 80 | B-304 | 20 | 2.12 |
| Exemplified compound 1515 | A-201 | 35 | B-304 | 65 | 2.13 |
| Exemplified compound 1516 | A-201 | 20 | B-304 | 80 | 2.14 |
| Exemplified compound 1517 | A-201 | 49 | B-305 | 51 | 2.08 |
| Exemplified compound 1518 | A-201 | 80 | B-305 | 20 | 2.10 |
| Exemplified compound 1519 | A-201 | 35 | B-305 | 65 | 2.06 |
| Exemplified compound 1520 | A-201 | 20 | B-305 | 80 | 2.05 |
| Exemplified compound 1521 | A-201 | 49 | B-306 | 51 | 2.14 |
| Exemplified compound 1522 | A-201 | 80 | B-306 | 20 | 2.13 |
| Exemplified compound 1523 | A-201 | 35 | B-306 | 65 | 2.15 |
| Exemplified compound 1524 | A-201 | 20 | B-306 | 80 | 2.15 |
| Exemplified compound 1525 | A-201 | 49 | B-307 | 51 | 2.12 |
| Exemplified compound 1526 | A-201 | 80 | B-307 | 20 | 2.12 |
| Exemplified compound 1527 | A-201 | 35 | B-307 | 65 | 2.13 |
| Exemplified compound 1528 | A-201 | 20 | B-307 | 80 | 2.13 |
| Exemplified compound 1529 | A-201 | 49 | B-308 | 51 | 2.13 |
| Exemplified compound 1530 | A-201 | 80 | B-308 | 20 | 2.12 |
| Exemplified compound 1531 | A-201 | 35 | B-308 | 65 | 2.14 |
| Exemplified compound 1532 | A-201 | 20 | B-308 | 80 | 2.14 |
| Exemplified compound 1533 | A-201 | 49 | B-401 | 51 | 2.17 |
| Exemplified compound 1534 | A-201 | 80 | B-401 | 20 | 2.14 |
| Exemplified compound 1535 | A-201 | 35 | B-401 | 65 | 2.18 |
| Exemplified compound 1536 | A-201 | 20 | B-401 | 80 | 2.20 |
| Exemplified compound 1537 | A-201 | 49 | B-402 | 51 | 2.21 |
| Exemplified compound 1538 | A-201 | 80 | B-402 | 20 | 2.15 |
| Exemplified compound 1539 | A-201 | 35 | B-402 | 65 | 2.24 |
| Exemplified compound 1540 | A-201 | 20 | B-402 | 80 | 2.26 |
| Exemplified compound 1541 | A-201 | 49 | B-403 | 51 | 2.26 |
| Exemplified compound 1542 | A-201 | 80 | B-403 | 20 | 2.18 |
| Exemplified compound 1543 | A-201 | 35 | B-403 | 65 | 2.30 |
| Exemplified compound 1544 | A-201 | 20 | B-403 | 80 | 2.35 |
| Exemplified compound 1545 | A-201 | 49 | B-404 | 51 | 2.14 |
| Exemplified compound 1546 | A-201 | 80 | B-404 | 20 | 2.13 |
| Exemplified compound 1547 | A-201 | 35 | B-404 | 65 | 2.15 |
| Exemplified compound 1548 | A-201 | 20 | B-404 | 80 | 2.16 |
| Exemplified compound 1549 | A-201 | 49 | B-405 | 51 | 2.20 |
| Exemplified compound 1550 | A-201 | 80 | B-405 | 20 | 2.15 |
| Exemplified compound 1551 | A-201 | 35 | B-405 | 65 | 2.23 |
| Exemplified compound 1552 | A-201 | 20 | B-405 | 80 | 2.25 |
| Exemplified compound 1553 | A-202 | 49 | B-101 | 51 | 2.16 |
| Exemplified compound 1554 | A-202 | 80 | B-101 | 20 | 2.19 |
| Exemplified compound 1555 | A-202 | 35 | B-101 | 65 | 2.14 |
| Exemplified compound 1556 | A-202 | 20 | B-101 | 80 | 2.13 |
| Exemplified compound 1557 | A-202 | 49 | B-102 | 51 | 2.21 |
| Exemplified compound 1558 | A-202 | 80 | B-102 | 20 | 2.21 |
| Exemplified compound 1559 | A-202 | 35 | B-102 | 65 | 2.21 |
| Exemplified compound 1560 | A-202 | 20 | B-102 | 80 | 2.21 |
| Exemplified compound 1561 | A-202 | 49 | B-103 | 51 | 2.16 |
| Exemplified compound 1562 | A-202 | 80 | B-103 | 20 | 2.19 |
| Exemplified compound 1563 | A-202 | 35 | B-103 | 65 | 2.14 |
| Exemplified compound 1564 | A-202 | 20 | B-103 | 80 | 2.13 |
| Exemplified compound 1565 | A-202 | 49 | B-104 | 51 | 2.14 |
| Exemplified compound 1566 | A-202 | 80 | B-104 | 20 | 2.18 |

TABLE 5-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1567 | A-202 | 35 | B-104 | 65 | 2.12 |
| Exemplified compound 1568 | A-202 | 20 | B-104 | 80 | 2.10 |
| Exemplified compound 1569 | A-202 | 49 | B-105 | 51 | 2.15 |
| Exemplified compound 1570 | A-202 | 80 | B-105 | 20 | 2.18 |
| Exemplified compound 1571 | A-202 | 35 | B-105 | 65 | 2.13 |
| Exemplified compound 1572 | A-202 | 20 | B-105 | 80 | 2.12 |
| Exemplified compound 1573 | A-202 | 49 | B-201 | 51 | 2.20 |
| Exemplified compound 1574 | A-202 | 80 | B-201 | 20 | 2.21 |
| Exemplified compound 1575 | A-202 | 35 | B-201 | 65 | 2.20 |
| Exemplified compound 1576 | A-202 | 20 | B-201 | 80 | 2.20 |
| Exemplified compound 1577 | A-202 | 49 | B-202 | 51 | 2.15 |
| Exemplified compound 1578 | A-202 | 80 | B-202 | 20 | 2.18 |
| Exemplified compound 1579 | A-202 | 35 | B-202 | 65 | 2.13 |
| Exemplified compound 1580 | A-202 | 20 | B-202 | 80 | 2.11 |
| Exemplified compound 1581 | A-202 | 49 | B-203 | 51 | 2.18 |
| Exemplified compound 1582 | A-202 | 80 | B-203 | 20 | 2.20 |
| Exemplified compound 1583 | A-202 | 35 | B-203 | 65 | 2.17 |
| Exemplified compound 1584 | A-202 | 20 | B-203 | 80 | 2.16 |
| Exemplified compound 1585 | A-202 | 49 | B-204 | 51 | 2.14 |
| Exemplified compound 1586 | A-202 | 80 | B-204 | 20 | 2.18 |
| Exemplified compound 1587 | A-202 | 35 | B-204 | 65 | 2.12 |
| Exemplified compound 1588 | A-202 | 20 | B-204 | 80 | 2.10 |
| Exemplified compound 1589 | A-202 | 49 | B-205 | 51 | 2.18 |
| Exemplified compound 1590 | A-202 | 80 | B-205 | 20 | 2.20 |
| Exemplified compound 1591 | A-202 | 35 | B-205 | 65 | 2.17 |
| Exemplified compound 1592 | A-202 | 20 | B-205 | 80 | 2.16 |
| Exemplified compound 1593 | A-202 | 49 | B-301 | 51 | 2.17 |
| Exemplified compound 1594 | A-202 | 80 | B-301 | 20 | 2.19 |
| Exemplified compound 1595 | A-202 | 35 | B-301 | 65 | 2.16 |
| Exemplified compound 1596 | A-202 | 20 | B-301 | 80 | 2.15 |
| Exemplified compound 1597 | A-202 | 49 | B-302 | 51 | 2.17 |
| Exemplified compound 1598 | A-202 | 80 | B-302 | 20 | 2.19 |
| Exemplified compound 1599 | A-202 | 35 | B-302 | 65 | 2.16 |
| Exemplified compound 1600 | A-202 | 20 | B-302 | 80 | 2.15 |

TABLE 6

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1601 | A-202 | 49 | B-303 | 51 | 2.18 |
| Exemplified compound 1602 | A-202 | 80 | B-303 | 20 | 2.20 |
| Exemplified compound 1603 | A-202 | 35 | B-303 | 65 | 2.17 |
| Exemplified compound 1604 | A-202 | 20 | B-303 | 80 | 2.16 |
| Exemplified compound 1605 | A-202 | 49 | B-304 | 51 | 2.17 |
| Exemplified compound 1606 | A-202 | 80 | B-304 | 20 | 2.19 |
| Exemplified compound 1607 | A-202 | 35 | B-304 | 65 | 2.16 |
| Exemplified compound 1608 | A-202 | 20 | B-304 | 80 | 2.15 |
| Exemplified compound 1609 | A-202 | 49 | B-305 | 51 | 2.12 |
| Exemplified compound 1610 | A-202 | 80 | B-305 | 20 | 2.17 |
| Exemplified compound 1611 | A-202 | 35 | B-305 | 65 | 2.09 |
| Exemplified compound 1612 | A-202 | 20 | B-305 | 80 | 2.07 |
| Exemplified compound 1613 | A-202 | 49 | B-306 | 51 | 2.18 |
| Exemplified compound 1614 | A-202 | 80 | B-306 | 20 | 2.20 |
| Exemplified compound 1615 | A-202 | 35 | B-306 | 65 | 2.18 |
| Exemplified compound 1616 | A-202 | 20 | B-306 | 80 | 2.17 |
| Exemplified compound 1617 | A-202 | 49 | B-307 | 51 | 2.17 |
| Exemplified compound 1618 | A-202 | 80 | B-307 | 20 | 2.19 |
| Exemplified compound 1619 | A-202 | 35 | B-307 | 65 | 2.16 |
| Exemplified compound 1620 | A-202 | 20 | B-307 | 80 | 2.14 |
| Exemplified compound 1621 | A-202 | 49 | B-308 | 51 | 2.18 |
| Exemplified compound 1622 | A-202 | 80 | B-308 | 20 | 2.19 |
| Exemplified compound 1623 | A-202 | 35 | B-308 | 65 | 2.17 |
| Exemplified compound 1624 | A-202 | 20 | B-308 | 80 | 2.16 |
| Exemplified compound 1625 | A-202 | 49 | B-401 | 51 | 2.21 |
| Exemplified compound 1626 | A-202 | 80 | B-401 | 20 | 2.21 |

TABLE 6-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1627 | A-202 | 35 | B-401 | 65 | 2.22 |
| Exemplified compound 1628 | A-202 | 20 | B-401 | 80 | 2.22 |
| Exemplified compound 1629 | A-202 | 49 | B-402 | 51 | 2.25 |
| Exemplified compound 1630 | A-202 | 80 | B-402 | 20 | 2.23 |
| Exemplified compound 1631 | A-202 | 35 | B-402 | 65 | 2.27 |
| Exemplified compound 1632 | A-202 | 20 | B-402 | 80 | 2.28 |
| Exemplified compound 1633 | A-202 | 49 | B-403 | 51 | 2.31 |
| Exemplified compound 1634 | A-202 | 80 | B-403 | 20 | 2.25 |
| Exemplified compound 1635 | A-202 | 35 | B-403 | 65 | 2.34 |
| Exemplified compound 1636 | A-202 | 20 | B-403 | 80 | 2.37 |
| Exemplified compound 1637 | A-202 | 49 | B-404 | 51 | 2.19 |
| Exemplified compound 1638 | A-202 | 80 | B-404 | 20 | 2.20 |
| Exemplified compound 1639 | A-202 | 35 | B-404 | 65 | 2.18 |
| Exemplified compound 1640 | A-202 | 20 | B-404 | 80 | 2.17 |
| Exemplified compound 1641 | A-202 | 49 | B-405 | 51 | 2.25 |
| Exemplified compound 1642 | A-202 | 80 | B-405 | 20 | 2.22 |
| Exemplified compound 1643 | A-202 | 35 | B-405 | 65 | 2.26 |
| Exemplified compound 1644 | A-202 | 20 | B-405 | 80 | 2.27 |
| Exemplified compound 1645 | A-203 | 49 | B-101 | 51 | 2.04 |
| Exemplified compound 1646 | A-203 | 80 | B-101 | 20 | 2.00 |
| Exemplified compound 1647 | A-203 | 35 | B-101 | 65 | 2.06 |
| Exemplified compound 1648 | A-203 | 20 | B-101 | 80 | 2.08 |
| Exemplified compound 1649 | A-203 | 49 | B-102 | 51 | 2.09 |
| Exemplified compound 1650 | A-203 | 80 | B-102 | 20 | 2.02 |
| Exemplified compound 1651 | A-203 | 35 | B-102 | 65 | 2.13 |
| Exemplified compound 1652 | A-203 | 20 | B-102 | 80 | 2.16 |
| Exemplified compound 1653 | A-203 | 49 | B-103 | 51 | 2.04 |
| Exemplified compound 1654 | A-203 | 80 | B-103 | 20 | 2.00 |
| Exemplified compound 1655 | A-203 | 35 | B-103 | 65 | 2.06 |
| Exemplified compound 1656 | A-203 | 20 | B-103 | 80 | 2.08 |
| Exemplified compound 1657 | A-203 | 49 | B-104 | 51 | 2.02 |
| Exemplified compound 1658 | A-203 | 80 | B-104 | 20 | 1.99 |
| Exemplified compound 1659 | A-203 | 35 | B-104 | 65 | 2.03 |
| Exemplified compound 1660 | A-203 | 20 | B-104 | 80 | 2.05 |
| Exemplified compound 1661 | A-203 | 49 | B-105 | 51 | 2.03 |
| Exemplified compound 1662 | A-203 | 80 | B-105 | 20 | 2.00 |
| Exemplified compound 1663 | A-203 | 35 | B-105 | 65 | 2.05 |
| Exemplified compound 1664 | A-203 | 20 | B-105 | 80 | 2.07 |
| Exemplified compound 1665 | A-203 | 49 | B-201 | 51 | 2.09 |
| Exemplified compound 1666 | A-203 | 80 | B-201 | 20 | 2.02 |
| Exemplified compound 1667 | A-203 | 35 | B-201 | 65 | 2.12 |
| Exemplified compound 1668 | A-203 | 20 | B-201 | 80 | 2.16 |
| Exemplified compound 1669 | A-203 | 49 | B-202 | 51 | 2.03 |
| Exemplified compound 1670 | A-203 | 80 | B-202 | 20 | 1.99 |
| Exemplified compound 1671 | A-203 | 35 | B-202 | 65 | 2.05 |
| Exemplified compound 1672 | A-203 | 20 | B-202 | 80 | 2.07 |
| Exemplified compound 1673 | A-203 | 49 | B-203 | 51 | 2.06 |
| Exemplified compound 1674 | A-203 | 80 | B-203 | 20 | 2.01 |
| Exemplified compound 1675 | A-203 | 35 | B-203 | 65 | 2.09 |
| Exemplified compound 1676 | A-203 | 20 | B-203 | 80 | 2.12 |
| Exemplified compound 1677 | A-203 | 49 | B-204 | 51 | 2.02 |
| Exemplified compound 1678 | A-203 | 80 | B-204 | 20 | 1.99 |
| Exemplified compound 1679 | A-203 | 35 | B-204 | 65 | 2.04 |
| Exemplified compound 1680 | A-203 | 20 | B-204 | 80 | 2.05 |
| Exemplified compound 1681 | A-203 | 49 | B-205 | 51 | 2.06 |
| Exemplified compound 1682 | A-203 | 80 | B-205 | 20 | 2.01 |
| Exemplified compound 1683 | A-203 | 35 | B-205 | 65 | 2.09 |
| Exemplified compound 1684 | A-203 | 20 | B-205 | 80 | 2.11 |
| Exemplified compound 1685 | A-203 | 49 | B-301 | 51 | 2.05 |
| Exemplified compound 1686 | A-203 | 80 | B-301 | 20 | 2.00 |
| Exemplified compound 1687 | A-203 | 35 | B-301 | 65 | 2.08 |
| Exemplified compound 1688 | A-203 | 20 | B-301 | 80 | 2.10 |
| Exemplified compound 1689 | A-203 | 49 | B-302 | 51 | 2.05 |
| Exemplified compound 1690 | A-203 | 80 | B-302 | 20 | 2.00 |
| Exemplified compound 1691 | A-203 | 35 | B-302 | 65 | 2.07 |
| Exemplified compound 1692 | A-203 | 20 | B-302 | 80 | 2.10 |
| Exemplified compound 1693 | A-203 | 49 | B-303 | 51 | 2.06 |
| Exemplified compound 1694 | A-203 | 80 | B-303 | 20 | 2.01 |
| Exemplified compound 1695 | A-203 | 35 | B-303 | 65 | 2.09 |
| Exemplified compound 1696 | A-203 | 20 | B-303 | 80 | 2.12 |
| Exemplified compound 1697 | A-203 | 49 | B-304 | 51 | 2.06 |
| Exemplified compound 1698 | A-203 | 80 | B-304 | 20 | 2.00 |
| Exemplified compound 1699 | A-203 | 35 | B-304 | 65 | 2.08 |

TABLE 6-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1700 | A-203 | 20 | B-304 | 80 | 2.11 |
| Exemplified compound 1701 | A-203 | 49 | B-305 | 51 | 2.00 |
| Exemplified compound 1702 | A-203 | 80 | B-305 | 20 | 1.98 |
| Exemplified compound 1703 | A-203 | 35 | B-305 | 65 | 2.01 |
| Exemplified compound 1704 | A-203 | 20 | B-305 | 80 | 2.02 |
| Exemplified compound 1705 | A-203 | 49 | B-306 | 51 | 2.07 |
| Exemplified compound 1706 | A-203 | 80 | B-306 | 20 | 2.01 |
| Exemplified compound 1707 | A-203 | 35 | B-306 | 65 | 2.10 |
| Exemplified compound 1708 | A-203 | 20 | B-306 | 80 | 2.13 |
| Exemplified compound 1709 | A-203 | 49 | B-307 | 51 | 2.05 |
| Exemplified compound 1710 | A-203 | 80 | B-307 | 20 | 2.00 |
| Exemplified compound 1711 | A-203 | 35 | B-307 | 65 | 2.07 |
| Exemplified compound 1712 | A-203 | 20 | B-307 | 80 | 2.10 |
| Exemplified compound 1713 | A-203 | 49 | B-308 | 51 | 2.06 |
| Exemplified compound 1714 | A-203 | 80 | B-308 | 20 | 2.01 |
| Exemplified compound 1715 | A-203 | 35 | B-308 | 65 | 2.09 |
| Exemplified compound 1716 | A-203 | 20 | B-308 | 80 | 2.11 |
| Exemplified compound 1717 | A-203 | 49 | B-401 | 51 | 2.10 |
| Exemplified compound 1718 | A-203 | 80 | B-401 | 20 | 2.02 |
| Exemplified compound 1719 | A-203 | 35 | B-401 | 65 | 2.13 |
| Exemplified compound 1720 | A-203 | 20 | B-401 | 80 | 2.17 |

TABLE 7

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1721 | A-203 | 49 | B-402 | 51 | 2.14 |
| Exemplified compound 1722 | A-203 | 80 | B-402 | 20 | 2.04 |
| Exemplified compound 1723 | A-203 | 35 | B-402 | 65 | 2.18 |
| Exemplified compound 1724 | A-203 | 20 | B-402 | 80 | 2.23 |
| Exemplified compound 1725 | A-203 | 49 | B-403 | 51 | 2.19 |
| Exemplified compound 1726 | A-203 | 80 | B-403 | 20 | 2.06 |
| Exemplified compound 1727 | A-203 | 35 | B-403 | 65 | 2.25 |
| Exemplified compound 1728 | A-203 | 20 | B-403 | 80 | 2.32 |
| Exemplified compound 1729 | A-203 | 49 | B-404 | 51 | 2.07 |
| Exemplified compound 1730 | A-203 | 80 | B-404 | 20 | 2.01 |
| Exemplified compound 1731 | A-203 | 35 | B-404 | 65 | 2.10 |
| Exemplified compound 1732 | A-203 | 20 | B-404 | 80 | 2.13 |
| Exemplified compound 1733 | A-203 | 49 | B-405 | 51 | 2.13 |
| Exemplified compound 1734 | A-203 | 80 | B-405 | 20 | 2.03 |
| Exemplified compound 1735 | A-203 | 35 | B-405 | 65 | 2.18 |
| Exemplified compound 1736 | A-203 | 20 | B-405 | 80 | 2.22 |
| Exemplified compound 1737 | A-204 | 49 | B-101 | 51 | 2.09 |
| Exemplified compound 1738 | A-204 | 80 | B-101 | 20 | 2.08 |
| Exemplified compound 1739 | A-204 | 35 | B-101 | 65 | 2.10 |
| Exemplified compound 1740 | A-204 | 20 | B-101 | 80 | 2.10 |
| Exemplified compound 1741 | A-204 | 49 | B-102 | 51 | 2.14 |
| Exemplified compound 1742 | A-204 | 80 | B-102 | 20 | 2.10 |
| Exemplified compound 1743 | A-204 | 35 | B-102 | 65 | 2.16 |
| Exemplified compound 1744 | A-204 | 20 | B-102 | 80 | 2.18 |
| Exemplified compound 1745 | A-204 | 49 | B-103 | 51 | 2.09 |
| Exemplified compound 1746 | A-204 | 80 | B-103 | 20 | 2.08 |
| Exemplified compound 1747 | A-204 | 35 | B-103 | 65 | 2.09 |
| Exemplified compound 1748 | A-204 | 20 | B-103 | 80 | 2.10 |
| Exemplified compound 1749 | A-204 | 49 | B-104 | 51 | 2.07 |
| Exemplified compound 1750 | A-204 | 80 | B-104 | 20 | 2.07 |
| Exemplified compound 1751 | A-204 | 35 | B-104 | 65 | 2.07 |
| Exemplified compound 1752 | A-204 | 20 | B-104 | 80 | 2.07 |
| Exemplified compound 1753 | A-204 | 49 | B-105 | 51 | 2.08 |
| Exemplified compound 1754 | A-204 | 80 | B-105 | 20 | 2.07 |
| Exemplified compound 1755 | A-204 | 35 | B-105 | 65 | 2.09 |
| Exemplified compound 1756 | A-204 | 20 | B-105 | 80 | 2.09 |
| Exemplified compound 1757 | A-204 | 49 | B-201 | 51 | 2.14 |
| Exemplified compound 1758 | A-204 | 80 | B-201 | 20 | 2.10 |
| Exemplified compound 1759 | A-204 | 35 | B-201 | 65 | 2.16 |

TABLE 7-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1760 | A-204 | 20 | B-201 | 80 | 2.18 |
| Exemplified compound 1761 | A-204 | 49 | B-202 | 51 | 2.08 |
| Exemplified compound 1762 | A-204 | 80 | B-202 | 20 | 2.07 |
| Exemplified compound 1763 | A-204 | 35 | B-202 | 65 | 2.08 |
| Exemplified compound 1764 | A-204 | 20 | B-202 | 80 | 2.09 |
| Exemplified compound 1765 | A-204 | 49 | B-203 | 51 | 2.11 |
| Exemplified compound 1766 | A-204 | 80 | B-203 | 20 | 2.09 |
| Exemplified compound 1767 | A-204 | 35 | B-203 | 65 | 2.12 |
| Exemplified compound 1768 | A-204 | 20 | B-203 | 80 | 2.14 |
| Exemplified compound 1769 | A-204 | 49 | B-204 | 51 | 2.07 |
| Exemplified compound 1770 | A-204 | 80 | B-204 | 20 | 2.07 |
| Exemplified compound 1771 | A-204 | 35 | B-204 | 65 | 2.07 |
| Exemplified compound 1772 | A-204 | 20 | B-204 | 80 | 2.07 |
| Exemplified compound 1773 | A-204 | 49 | B-205 | 51 | 2.11 |
| Exemplified compound 1774 | A-204 | 80 | B-205 | 20 | 2.09 |
| Exemplified compound 1775 | A-204 | 35 | B-205 | 65 | 2.12 |
| Exemplified compound 1776 | A-204 | 20 | B-205 | 80 | 2.13 |
| Exemplified compound 1777 | A-204 | 49 | B-301 | 51 | 2.10 |
| Exemplified compound 1778 | A-204 | 80 | B-301 | 20 | 2.08 |
| Exemplified compound 1779 | A-204 | 35 | B-301 | 65 | 2.11 |
| Exemplified compound 1780 | A-204 | 20 | B-301 | 80 | 2.12 |
| Exemplified compound 1781 | A-204 | 49 | B-302 | 51 | 2.10 |
| Exemplified compound 1782 | A-204 | 80 | B-302 | 20 | 2.08 |
| Exemplified compound 1783 | A-204 | 35 | B-302 | 65 | 2.11 |
| Exemplified compound 1784 | A-204 | 20 | B-302 | 80 | 2.12 |
| Exemplified compound 1785 | A-204 | 49 | B-303 | 51 | 2.11 |
| Exemplified compound 1786 | A-204 | 80 | B-303 | 20 | 2.09 |
| Exemplified compound 1787 | A-204 | 35 | B-303 | 65 | 2.12 |
| Exemplified compound 1788 | A-204 | 20 | B-303 | 80 | 2.14 |
| Exemplified compound 1789 | A-204 | 49 | B-304 | 51 | 2.11 |
| Exemplified compound 1790 | A-204 | 80 | B-304 | 20 | 2.08 |
| Exemplified compound 1791 | A-204 | 35 | B-304 | 65 | 2.12 |
| Exemplified compound 1792 | A-204 | 20 | B-304 | 80 | 2.13 |
| Exemplified compound 1793 | A-204 | 49 | B-305 | 51 | 2.05 |
| Exemplified compound 1794 | A-204 | 80 | B-305 | 20 | 2.06 |
| Exemplified compound 1795 | A-204 | 35 | B-305 | 65 | 2.05 |
| Exemplified compound 1796 | A-204 | 20 | B-305 | 80 | 2.04 |
| Exemplified compound 1797 | A-204 | 49 | B-306 | 51 | 2.12 |
| Exemplified compound 1798 | A-204 | 80 | B-306 | 20 | 2.09 |
| Exemplified compound 1799 | A-204 | 35 | B-306 | 65 | 2.13 |
| Exemplified compound 1800 | A-204 | 20 | B-306 | 80 | 2.14 |
| Exemplified compound 1801 | A-204 | 49 | B-307 | 51 | 2.10 |
| Exemplified compound 1802 | A-204 | 80 | B-307 | 20 | 2.08 |
| Exemplified compound 1803 | A-204 | 35 | B-307 | 65 | 2.11 |
| Exemplified compound 1804 | A-204 | 20 | B-307 | 80 | 2.12 |
| Exemplified compound 1805 | A-204 | 49 | B-308 | 51 | 2.11 |
| Exemplified compound 1806 | A-204 | 80 | B-308 | 20 | 2.08 |
| Exemplified compound 1807 | A-204 | 35 | B-308 | 65 | 2.12 |
| Exemplified compound 1808 | A-204 | 20 | B-308 | 80 | 2.13 |
| Exemplified compound 1809 | A-204 | 49 | B-401 | 51 | 2.15 |
| Exemplified compound 1810 | A-204 | 80 | B-401 | 20 | 2.10 |
| Exemplified compound 1811 | A-204 | 35 | B-401 | 65 | 2.17 |
| Exemplified compound 1812 | A-204 | 20 | B-401 | 80 | 2.19 |
| Exemplified compound 1813 | A-204 | 49 | B-402 | 51 | 2.19 |
| Exemplified compound 1814 | A-204 | 80 | B-402 | 20 | 2.12 |
| Exemplified compound 1815 | A-204 | 35 | B-402 | 65 | 2.22 |
| Exemplified compound 1816 | A-204 | 20 | B-402 | 80 | 2.25 |
| Exemplified compound 1817 | A-204 | 49 | B-403 | 51 | 2.24 |
| Exemplified compound 1818 | A-204 | 80 | B-403 | 20 | 2.14 |
| Exemplified compound 1819 | A-204 | 35 | B-403 | 65 | 2.29 |
| Exemplified compound 1820 | A-204 | 20 | B-403 | 80 | 2.34 |
| Exemplified compound 1821 | A-204 | 49 | B-404 | 51 | 2.12 |
| Exemplified compound 1822 | A-204 | 80 | B-404 | 20 | 2.09 |
| Exemplified compound 1823 | A-204 | 35 | B-404 | 65 | 2.13 |
| Exemplified compound 1824 | A-204 | 20 | B-404 | 80 | 2.15 |
| Exemplified compound 1825 | A-204 | 49 | B-405 | 51 | 2.18 |
| Exemplified compound 1826 | A-204 | 80 | B-405 | 20 | 2.11 |
| Exemplified compound 1827 | A-204 | 35 | B-405 | 65 | 2.21 |
| Exemplified compound 1828 | A-204 | 20 | B-405 | 80 | 2.24 |
| Exemplified compound 1829 | A-205 | 49 | B-101 | 51 | 2.04 |
| Exemplified compound 1830 | A-205 | 80 | B-101 | 20 | 2.00 |
| Exemplified compound 1831 | A-205 | 35 | B-101 | 65 | 2.06 |
| Exemplified compound 1832 | A-205 | 20 | B-101 | 80 | 2.08 |

TABLE 7-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1833 | A-205 | 49 | B-102 | 51 | 2.10 |
| Exemplified compound 1834 | A-205 | 80 | B-102 | 20 | 2.02 |
| Exemplified compound 1835 | A-205 | 35 | B-102 | 65 | 2.13 |
| Exemplified compound 1836 | A-205 | 20 | B-102 | 80 | 2.16 |
| Exemplified compound 1837 | A-205 | 49 | B-103 | 51 | 2.04 |
| Exemplified compound 1838 | A-205 | 80 | B-103 | 20 | 2.00 |
| Exemplified compound 1839 | A-205 | 35 | B-103 | 65 | 2.06 |
| Exemplified compound 1840 | A-205 | 20 | B-103 | 80 | 2.08 |

TABLE 8

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1841 | A-205 | 49 | B-104 | 51 | 2.02 |
| Exemplified compound 1842 | A-205 | 80 | B-104 | 20 | 1.99 |
| Exemplified compound 1843 | A-205 | 35 | B-104 | 65 | 2.04 |
| Exemplified compound 1844 | A-205 | 20 | B-104 | 80 | 2.05 |
| Exemplified compound 1845 | A-205 | 49 | B-105 | 51 | 2.04 |
| Exemplified compound 1846 | A-205 | 80 | B-105 | 20 | 2.00 |
| Exemplified compound 1847 | A-205 | 35 | B-105 | 65 | 2.05 |
| Exemplified compound 1848 | A-205 | 20 | B-105 | 80 | 2.07 |
| Exemplified compound 1849 | A-205 | 49 | B-201 | 51 | 2.09 |
| Exemplified compound 1850 | A-205 | 80 | B-201 | 20 | 2.02 |
| Exemplified compound 1851 | A-205 | 35 | B-201 | 65 | 2.12 |
| Exemplified compound 1852 | A-205 | 20 | B-201 | 80 | 2.16 |
| Exemplified compound 1853 | A-205 | 49 | B-202 | 51 | 2.03 |
| Exemplified compound 1854 | A-205 | 80 | B-202 | 20 | 2.00 |
| Exemplified compound 1855 | A-205 | 35 | B-202 | 65 | 2.05 |
| Exemplified compound 1856 | A-205 | 20 | B-202 | 80 | 2.07 |
| Exemplified compound 1857 | A-205 | 49 | B-203 | 51 | 2.07 |
| Exemplified compound 1858 | A-205 | 80 | B-203 | 20 | 2.01 |
| Exemplified compound 1859 | A-205 | 35 | B-203 | 65 | 2.09 |
| Exemplified compound 1860 | A-205 | 20 | B-203 | 80 | 2.12 |
| Exemplified compound 1861 | A-205 | 49 | B-204 | 51 | 2.03 |
| Exemplified compound 1862 | A-205 | 80 | B-204 | 20 | 2.00 |
| Exemplified compound 1863 | A-205 | 35 | B-204 | 65 | 2.04 |
| Exemplified compound 1864 | A-205 | 20 | B-204 | 80 | 2.05 |
| Exemplified compound 1865 | A-205 | 49 | B-205 | 51 | 2.06 |
| Exemplified compound 1866 | A-205 | 80 | B-205 | 20 | 2.01 |
| Exemplified compound 1867 | A-205 | 35 | B-205 | 65 | 2.09 |
| Exemplified compound 1868 | A-205 | 20 | B-205 | 80 | 2.11 |
| Exemplified compound 1869 | A-205 | 49 | B-301 | 51 | 2.06 |
| Exemplified compound 1870 | A-205 | 80 | B-301 | 20 | 2.01 |
| Exemplified compound 1871 | A-205 | 35 | B-301 | 65 | 2.08 |
| Exemplified compound 1872 | A-205 | 20 | B-301 | 80 | 2.10 |
| Exemplified compound 1873 | A-205 | 49 | B-302 | 51 | 2.05 |
| Exemplified compound 1874 | A-205 | 80 | B-302 | 20 | 2.01 |
| Exemplified compound 1875 | A-205 | 35 | B-302 | 65 | 2.08 |
| Exemplified compound 1876 | A-205 | 20 | B-302 | 80 | 2.10 |
| Exemplified compound 1877 | A-205 | 49 | B-303 | 51 | 2.07 |
| Exemplified compound 1878 | A-205 | 80 | B-303 | 20 | 2.01 |
| Exemplified compound 1879 | A-205 | 35 | B-303 | 65 | 2.09 |
| Exemplified compound 1880 | A-205 | 20 | B-303 | 80 | 2.12 |
| Exemplified compound 1881 | A-205 | 49 | B-304 | 51 | 2.06 |
| Exemplified compound 1882 | A-205 | 80 | B-304 | 20 | 2.01 |
| Exemplified compound 1883 | A-205 | 35 | B-304 | 65 | 2.08 |
| Exemplified compound 1884 | A-205 | 20 | B-304 | 80 | 2.11 |
| Exemplified compound 1885 | A-205 | 49 | B-305 | 51 | 2.01 |
| Exemplified compound 1886 | A-205 | 80 | B-305 | 20 | 1.99 |
| Exemplified compound 1887 | A-205 | 35 | B-305 | 65 | 2.01 |
| Exemplified compound 1888 | A-205 | 20 | B-305 | 80 | 2.02 |
| Exemplified compound 1889 | A-205 | 49 | B-306 | 51 | 2.07 |
| Exemplified compound 1890 | A-205 | 80 | B-306 | 20 | 2.01 |
| Exemplified compound 1891 | A-205 | 35 | B-306 | 65 | 2.10 |
| Exemplified compound 1892 | A-205 | 20 | B-306 | 80 | 2.13 |

TABLE 8-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1893 | A-205 | 49 | B-307 | 51 | 2.05 |
| Exemplified compound 1894 | A-205 | 80 | B-307 | 20 | 2.01 |
| Exemplified compound 1895 | A-205 | 35 | B-307 | 65 | 2.08 |
| Exemplified compound 1896 | A-205 | 20 | B-307 | 80 | 2.10 |
| Exemplified compound 1897 | A-205 | 49 | B-308 | 51 | 2.06 |
| Exemplified compound 1898 | A-205 | 80 | B-308 | 20 | 2.01 |
| Exemplified compound 1899 | A-205 | 35 | B-308 | 65 | 2.09 |
| Exemplified compound 1900 | A-205 | 20 | B-308 | 80 | 2.11 |
| Exemplified compound 1901 | A-205 | 49 | B-401 | 51 | 2.10 |
| Exemplified compound 1902 | A-205 | 80 | B-401 | 20 | 2.02 |
| Exemplified compound 1903 | A-205 | 35 | B-401 | 65 | 2.13 |
| Exemplified compound 1904 | A-205 | 20 | B-401 | 80 | 2.17 |
| Exemplified compound 1905 | A-205 | 49 | B-402 | 51 | 2.14 |
| Exemplified compound 1906 | A-205 | 80 | B-402 | 20 | 2.04 |
| Exemplified compound 1907 | A-205 | 35 | B-402 | 65 | 2.19 |
| Exemplified compound 1908 | A-205 | 20 | B-402 | 80 | 2.24 |
| Exemplified compound 1909 | A-205 | 49 | B-403 | 51 | 2.19 |
| Exemplified compound 1910 | A-205 | 80 | B-403 | 20 | 2.06 |
| Exemplified compound 1911 | A-205 | 35 | B-403 | 65 | 2.26 |
| Exemplified compound 1912 | A-205 | 20 | B-403 | 80 | 2.32 |
| Exemplified compound 1913 | A-205 | 49 | B-404 | 51 | 2.07 |
| Exemplified compound 1914 | A-205 | 80 | B-404 | 20 | 2.01 |
| Exemplified compound 1915 | A-205 | 35 | B-404 | 65 | 2.10 |
| Exemplified compound 1916 | A-205 | 20 | B-404 | 80 | 2.13 |
| Exemplified compound 1917 | A-205 | 49 | B-405 | 51 | 2.13 |
| Exemplified compound 1918 | A-205 | 80 | B-405 | 20 | 2.04 |
| Exemplified compound 1919 | A-205 | 35 | B-405 | 65 | 2.18 |
| Exemplified compound 1920 | A-205 | 20 | B-405 | 80 | 2.22 |
| Exemplified compound 2281 | A-401 | 49 | B-101 | 51 | 2.11 |
| Exemplified compound 2282 | A-401 | 80 | B-101 | 20 | 2.11 |
| Exemplified compound 2283 | A-401 | 35 | B-101 | 65 | 2.11 |
| Exemplified compound 2284 | A-401 | 20 | B-101 | 80 | 2.11 |
| Exemplified compound 2285 | A-401 | 49 | B-102 | 51 | 2.16 |
| Exemplified compound 2286 | A-401 | 80 | B-102 | 20 | 2.13 |
| Exemplified compound 2287 | A-401 | 35 | B-102 | 65 | 2.18 |
| Exemplified compound 2288 | A-401 | 20 | B-102 | 80 | 2.19 |
| Exemplified compound 2289 | A-401 | 49 | B-103 | 51 | 2.11 |
| Exemplified compound 2290 | A-401 | 80 | B-103 | 20 | 2.11 |
| Exemplified compound 2291 | A-401 | 35 | B-103 | 65 | 2.11 |
| Exemplified compound 2292 | A-401 | 20 | B-103 | 80 | 2.11 |
| Exemplified compound 2293 | A-401 | 49 | B-104 | 51 | 2.09 |
| Exemplified compound 2294 | A-401 | 80 | B-104 | 20 | 2.10 |
| Exemplified compound 2295 | A-401 | 35 | B-104 | 65 | 2.08 |
| Exemplified compound 2296 | A-401 | 20 | B-104 | 80 | 2.08 |
| Exemplified compound 2297 | A-401 | 49 | B-105 | 51 | 2.10 |
| Exemplified compound 2298 | A-401 | 80 | B-105 | 20 | 2.11 |
| Exemplified compound 2299 | A-401 | 35 | B-105 | 65 | 2.10 |
| Exemplified compound 2300 | A-401 | 20 | B-105 | 80 | 2.10 |
| Exemplified compound 2301 | A-401 | 49 | B-201 | 51 | 2.16 |
| Exemplified compound 2302 | A-401 | 80 | B-201 | 20 | 2.13 |
| Exemplified compound 2303 | A-401 | 35 | B-201 | 65 | 2.17 |
| Exemplified compound 2304 | A-401 | 20 | B-201 | 80 | 2.18 |
| Exemplified compound 2305 | A-401 | 49 | B-202 | 51 | 2.10 |
| Exemplified compound 2306 | A-401 | 80 | B-202 | 20 | 2.11 |
| Exemplified compound 2307 | A-401 | 35 | B-202 | 65 | 2.10 |
| Exemplified compound 2308 | A-401 | 20 | B-202 | 80 | 2.09 |
| Exemplified compound 2309 | A-401 | 49 | B-203 | 51 | 2.13 |
| Exemplified compound 2310 | A-401 | 80 | B-203 | 20 | 2.12 |
| Exemplified compound 2311 | A-401 | 35 | B-203 | 65 | 2.14 |
| Exemplified compound 2312 | A-401 | 20 | B-203 | 80 | 2.14 |
| Exemplified compound 2313 | A-401 | 49 | B-204 | 51 | 2.09 |
| Exemplified compound 2314 | A-401 | 80 | B-204 | 20 | 2.11 |
| Exemplified compound 2315 | A-401 | 35 | B-204 | 65 | 2.09 |
| Exemplified compound 2316 | A-401 | 20 | B-204 | 80 | 2.08 |
| Exemplified compound 2317 | A-401 | 49 | B-205 | 51 | 2.13 |
| Exemplified compound 2318 | A-401 | 80 | B-205 | 20 | 2.12 |
| Exemplified compound 2319 | A-401 | 35 | B-205 | 65 | 2.14 |
| Exemplified compound 2320 | A-401 | 20 | B-205 | 80 | 2.14 |

TABLE 9

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2321 | A-401 | 49 | B-301 | 51 | 2.12 |
| Exemplified compound 2322 | A-401 | 80 | B-301 | 20 | 2.12 |
| Exemplified compound 2323 | A-401 | 35 | B-301 | 65 | 2.13 |
| Exemplified compound 2324 | A-401 | 20 | B-301 | 80 | 2.13 |
| Exemplified compound 2325 | A-401 | 49 | B-302 | 51 | 2.12 |
| Exemplified compound 2326 | A-401 | 80 | B-302 | 20 | 2.12 |
| Exemplified compound 2327 | A-401 | 35 | B-302 | 65 | 2.12 |
| Exemplified compound 2328 | A-401 | 20 | B-302 | 80 | 2.13 |
| Exemplified compound 2329 | A-401 | 49 | B-303 | 51 | 2.13 |
| Exemplified compound 2330 | A-401 | 80 | B-303 | 20 | 2.12 |
| Exemplified compound 2331 | A-401 | 35 | B-303 | 65 | 2.14 |
| Exemplified compound 2332 | A-401 | 20 | B-303 | 80 | 2.14 |
| Exemplified compound 2333 | A-401 | 49 | B-304 | 51 | 2.13 |
| Exemplified compound 2334 | A-401 | 80 | B-304 | 20 | 2.12 |
| Exemplified compound 2335 | A-401 | 35 | B-304 | 65 | 2.13 |
| Exemplified compound 2336 | A-401 | 20 | B-304 | 80 | 2.13 |
| Exemplified compound 2337 | A-401 | 49 | B-305 | 51 | 2.07 |
| Exemplified compound 2338 | A-401 | 80 | B-305 | 20 | 2.10 |
| Exemplified compound 2339 | A-401 | 35 | B-305 | 65 | 2.06 |
| Exemplified compound 2340 | A-401 | 20 | B-305 | 80 | 2.05 |
| Exemplified compound 2341 | A-401 | 49 | B-306 | 51 | 2.14 |
| Exemplified compound 2342 | A-401 | 80 | B-306 | 20 | 2.12 |
| Exemplified compound 2343 | A-401 | 35 | B-306 | 65 | 2.15 |
| Exemplified compound 2344 | A-401 | 20 | B-306 | 80 | 2.15 |
| Exemplified compound 2345 | A-401 | 49 | B-307 | 51 | 2.12 |
| Exemplified compound 2346 | A-401 | 80 | B-307 | 20 | 2.12 |
| Exemplified compound 2347 | A-401 | 35 | B-307 | 65 | 2.12 |
| Exemplified compound 2348 | A-401 | 20 | B-307 | 80 | 2.13 |
| Exemplified compound 2349 | A-401 | 49 | B-308 | 51 | 2.13 |
| Exemplified compound 2350 | A-401 | 80 | B-308 | 20 | 2.12 |
| Exemplified compound 2351 | A-401 | 35 | B-308 | 65 | 2.14 |
| Exemplified compound 2352 | A-401 | 20 | B-308 | 80 | 2.14 |
| Exemplified compound 2353 | A-401 | 49 | B-401 | 51 | 2.17 |
| Exemplified compound 2354 | A-401 | 80 | B-401 | 20 | 2.13 |
| Exemplified compound 2355 | A-401 | 35 | B-401 | 65 | 2.18 |
| Exemplified compound 2356 | A-401 | 20 | B-401 | 80 | 2.20 |
| Exemplified compound 2357 | A-401 | 49 | B-402 | 51 | 2.21 |
| Exemplified compound 2358 | A-401 | 80 | B-402 | 20 | 2.15 |
| Exemplified compound 2359 | A-401 | 35 | B-402 | 65 | 2.23 |
| Exemplified compound 2360 | A-401 | 20 | B-402 | 80 | 2.26 |
| Exemplified compound 2361 | A-401 | 49 | B-403 | 51 | 2.26 |
| Exemplified compound 2362 | A-401 | 80 | B-403 | 20 | 2.17 |
| Exemplified compound 2363 | A-401 | 35 | B-403 | 65 | 2.30 |
| Exemplified compound 2364 | A-401 | 20 | B-403 | 80 | 2.35 |
| Exemplified compound 2365 | A-401 | 49 | B-404 | 51 | 2.14 |
| Exemplified compound 2366 | A-401 | 80 | B-404 | 20 | 2.12 |
| Exemplified compound 2367 | A-401 | 35 | B-404 | 65 | 2.15 |
| Exemplified compound 2368 | A-401 | 20 | B-404 | 80 | 2.16 |
| Exemplified compound 2369 | A-401 | 49 | B-405 | 51 | 2.20 |
| Exemplified compound 2370 | A-401 | 80 | B-405 | 20 | 2.15 |
| Exemplified compound 2371 | A-401 | 35 | B-405 | 65 | 2.23 |
| Exemplified compound 2372 | A-401 | 20 | B-405 | 80 | 2.25 |
| Exemplified compound 2373 | A-402 | 49 | B-101 | 51 | 2.08 |
| Exemplified compound 2374 | A-402 | 80 | B-101 | 20 | 2.07 |
| Exemplified compound 2375 | A-402 | 35 | B-101 | 65 | 2.09 |
| Exemplified compound 2376 | A-402 | 20 | B-101 | 80 | 2.10 |
| Exemplified compound 2377 | A-402 | 49 | B-102 | 51 | 2.14 |
| Exemplified compound 2378 | A-402 | 80 | B-102 | 20 | 2.09 |
| Exemplified compound 2379 | A-402 | 35 | B-102 | 65 | 2.16 |
| Exemplified compound 2380 | A-402 | 20 | B-102 | 80 | 2.18 |
| Exemplified compound 2381 | A-402 | 49 | B-103 | 51 | 2.08 |
| Exemplified compound 2382 | A-402 | 80 | B-103 | 20 | 2.07 |
| Exemplified compound 2383 | A-402 | 35 | B-103 | 65 | 2.09 |
| Exemplified compound 2384 | A-402 | 20 | B-103 | 80 | 2.10 |
| Exemplified compound 2385 | A-402 | 49 | B-104 | 51 | 2.06 |
| Exemplified compound 2386 | A-402 | 80 | B-104 | 20 | 2.06 |
| Exemplified compound 2387 | A-402 | 35 | B-104 | 65 | 2.06 |
| Exemplified compound 2388 | A-402 | 20 | B-104 | 80 | 2.07 |
| Exemplified compound 2389 | A-402 | 49 | B-105 | 51 | 2.08 |
| Exemplified compound 2390 | A-402 | 80 | B-105 | 20 | 2.06 |
| Exemplified compound 2391 | A-402 | 35 | B-105 | 65 | 2.08 |
| Exemplified compound 2392 | A-402 | 20 | B-105 | 80 | 2.09 |
| Exemplified compound 2393 | A-402 | 49 | B-201 | 51 | 2.13 |

TABLE 9-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 2394 | A-402 | 80 | B-201 | 20 | 2.09 |
| Exemplified compound 2395 | A-402 | 35 | B-201 | 65 | 2.15 |
| Exemplified compound 2396 | A-402 | 20 | B-201 | 80 | 2.17 |
| Exemplified compound 2397 | A-402 | 49 | B-202 | 51 | 2.07 |
| Exemplified compound 2398 | A-402 | 80 | B-202 | 20 | 2.06 |
| Exemplified compound 2399 | A-402 | 35 | B-202 | 65 | 2.08 |
| Exemplified compound 2400 | A-402 | 20 | B-202 | 80 | 2.08 |
| Exemplified compound 2401 | A-402 | 49 | B-203 | 51 | 2.11 |
| Exemplified compound 2402 | A-402 | 80 | B-203 | 20 | 2.08 |
| Exemplified compound 2403 | A-402 | 35 | B-203 | 65 | 2.12 |
| Exemplified compound 2404 | A-402 | 20 | B-203 | 80 | 2.13 |
| Exemplified compound 2405 | A-402 | 49 | B-204 | 51 | 2.07 |
| Exemplified compound 2406 | A-402 | 80 | B-204 | 20 | 2.06 |
| Exemplified compound 2407 | A-402 | 35 | B-204 | 65 | 2.07 |
| Exemplified compound 2408 | A-402 | 20 | B-204 | 80 | 2.07 |
| Exemplified compound 2409 | A-402 | 49 | B-205 | 51 | 2.10 |
| Exemplified compound 2410 | A-402 | 80 | B-205 | 20 | 2.07 |
| Exemplified compound 2411 | A-402 | 35 | B-205 | 65 | 2.12 |
| Exemplified compound 2412 | A-402 | 20 | B-205 | 80 | 2.13 |
| Exemplified compound 2413 | A-402 | 49 | B-301 | 51 | 2.10 |
| Exemplified compound 2414 | A-402 | 80 | B-301 | 20 | 2.07 |
| Exemplified compound 2415 | A-402 | 35 | B-301 | 65 | 2.11 |
| Exemplified compound 2416 | A-402 | 20 | B-301 | 80 | 2.12 |
| Exemplified compound 2417 | A-402 | 49 | B-302 | 51 | 2.09 |
| Exemplified compound 2418 | A-402 | 80 | B-302 | 20 | 2.07 |
| Exemplified compound 2419 | A-402 | 35 | B-302 | 65 | 2.10 |
| Exemplified compound 2420 | A-402 | 20 | B-302 | 80 | 2.12 |
| Exemplified compound 2421 | A-402 | 49 | B-303 | 51 | 2.11 |
| Exemplified compound 2422 | A-402 | 80 | B-303 | 20 | 2.08 |
| Exemplified compound 2423 | A-402 | 35 | B-303 | 65 | 2.12 |
| Exemplified compound 2424 | A-402 | 20 | B-303 | 80 | 2.13 |
| Exemplified compound 2425 | A-402 | 49 | B-304 | 51 | 2.10 |
| Exemplified compound 2426 | A-402 | 80 | B-304 | 20 | 2.07 |
| Exemplified compound 2427 | A-402 | 35 | B-304 | 65 | 2.11 |
| Exemplified compound 2428 | A-402 | 20 | B-304 | 80 | 2.12 |
| Exemplified compound 2429 | A-402 | 49 | B-305 | 51 | 2.04 |
| Exemplified compound 2430 | A-402 | 80 | B-305 | 20 | 2.05 |
| Exemplified compound 2431 | A-402 | 35 | B-305 | 65 | 2.04 |
| Exemplified compound 2432 | A-402 | 20 | B-305 | 80 | 2.04 |
| Exemplified compound 2433 | A-402 | 49 | B-306 | 51 | 2.11 |
| Exemplified compound 2434 | A-402 | 80 | B-306 | 20 | 2.08 |
| Exemplified compound 2435 | A-402 | 35 | B-306 | 65 | 2.13 |
| Exemplified compound 2436 | A-402 | 20 | B-306 | 80 | 2.14 |
| Exemplified compound 2437 | A-402 | 49 | B-307 | 51 | 2.09 |
| Exemplified compound 2438 | A-402 | 80 | B-307 | 20 | 2.07 |
| Exemplified compound 2439 | A-402 | 35 | B-307 | 65 | 2.10 |
| Exemplified compound 2440 | A-402 | 20 | B-307 | 80 | 2.11 |

TABLE 10

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 2441 | A-402 | 49 | B-308 | 51 | 2.10 |
| Exemplified compound 2442 | A-402 | 80 | B-308 | 20 | 2.07 |
| Exemplified compound 2443 | A-402 | 35 | B-308 | 65 | 2.12 |
| Exemplified compound 2444 | A-402 | 20 | B-308 | 80 | 2.13 |
| Exemplified compound 2445 | A-402 | 49 | B-401 | 51 | 2.14 |
| Exemplified compound 2446 | A-402 | 80 | B-401 | 20 | 2.09 |

TABLE 10-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 2447 | A-402 | 35 | B-401 | 65 | 2.16 |
| Exemplified compound 2448 | A-402 | 20 | B-401 | 80 | 2.19 |
| Exemplified compound 2449 | A-402 | 49 | B-402 | 51 | 2.18 |
| Exemplified compound 2450 | A-402 | 80 | B-402 | 20 | 2.10 |
| Exemplified compound 2451 | A-402 | 35 | B-402 | 65 | 2.21 |
| Exemplified compound 2452 | A-402 | 20 | B-402 | 80 | 2.25 |

TABLE 10-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2453 | A-402 | 49 | B-403 | 51 | 2.23 |
| Exemplified compound 2454 | A-402 | 80 | B-403 | 20 | 2.13 |
| Exemplified compound 2455 | A-402 | 35 | B-403 | 65 | 2.28 |
| Exemplified compound 2456 | A-402 | 20 | B-403 | 80 | 2.34 |
| Exemplified compound 2457 | A-402 | 49 | B-404 | 51 | 2.11 |
| Exemplified compound 2458 | A-402 | 80 | B-404 | 20 | 2.08 |
| Exemplified compound 2459 | A-402 | 35 | B-404 | 65 | 2.13 |
| Exemplified compound 2460 | A-402 | 20 | B-404 | 80 | 2.14 |
| Exemplified compound 2461 | A-402 | 49 | B-405 | 51 | 2.17 |
| Exemplified compound 2462 | A-402 | 80 | B-405 | 20 | 2.10 |
| Exemplified compound 2463 | A-402 | 35 | B-405 | 65 | 2.21 |
| Exemplified compound 2464 | A-402 | 20 | B-405 | 80 | 2.24 |
| Exemplified compound 2465 | A-403 | 49 | B-101 | 51 | 2.04 |
| Exemplified compound 2466 | A-403 | 80 | B-101 | 20 | 2.00 |
| Exemplified compound 2467 | A-403 | 35 | B-101 | 65 | 2.06 |
| Exemplified compound 2468 | A-403 | 20 | B-101 | 80 | 2.08 |
| Exemplified compound 2469 | A-403 | 49 | B-102 | 51 | 2.10 |
| Exemplified compound 2470 | A-403 | 80 | B-102 | 20 | 2.02 |
| Exemplified compound 2471 | A-403 | 35 | B-102 | 65 | 2.13 |
| Exemplified compound 2472 | A-403 | 20 | B-102 | 80 | 2.16 |
| Exemplified compound 2473 | A-403 | 49 | B-103 | 51 | 2.04 |
| Exemplified compound 2474 | A-403 | 80 | B-103 | 20 | 2.00 |
| Exemplified compound 2475 | A-403 | 35 | B-103 | 65 | 2.06 |
| Exemplified compound 2476 | A-403 | 20 | B-103 | 80 | 2.08 |
| Exemplified compound 2477 | A-403 | 49 | B-104 | 51 | 2.02 |
| Exemplified compound 2478 | A-403 | 80 | B-104 | 20 | 1.99 |
| Exemplified compound 2479 | A-403 | 35 | B-104 | 65 | 2.04 |
| Exemplified compound 2480 | A-403 | 20 | B-104 | 80 | 2.05 |
| Exemplified compound 2481 | A-403 | 49 | B-105 | 51 | 2.04 |
| Exemplified compound 2482 | A-403 | 80 | B-105 | 20 | 2.00 |
| Exemplified compound 2483 | A-403 | 35 | B-105 | 65 | 2.05 |
| Exemplified compound 2484 | A-403 | 20 | B-105 | 80 | 2.07 |
| Exemplified compound 2485 | A-403 | 49 | B-201 | 51 | 2.09 |
| Exemplified compound 2486 | A-403 | 80 | B-201 | 20 | 2.02 |
| Exemplified compound 2487 | A-403 | 35 | B-201 | 65 | 2.12 |
| Exemplified compound 2488 | A-403 | 20 | B-201 | 80 | 2.16 |
| Exemplified compound 2489 | A-403 | 49 | B-202 | 51 | 2.03 |
| Exemplified compound 2490 | A-403 | 80 | B-202 | 20 | 2.00 |
| Exemplified compound 2491 | A-403 | 35 | B-202 | 65 | 2.05 |
| Exemplified compound 2492 | A-403 | 20 | B-202 | 80 | 2.07 |
| Exemplified compound 2493 | A-403 | 49 | B-203 | 51 | 2.07 |
| Exemplified compound 2494 | A-403 | 80 | B-203 | 20 | 2.01 |
| Exemplified compound 2495 | A-403 | 35 | B-203 | 65 | 2.09 |
| Exemplified compound 2496 | A-403 | 20 | B-203 | 80 | 2.12 |
| Exemplified compound 2497 | A-403 | 49 | B-204 | 51 | 2.03 |
| Exemplified compound 2498 | A-403 | 80 | B-204 | 20 | 2.00 |
| Exemplified compound 2499 | A-403 | 35 | B-204 | 65 | 2.04 |
| Exemplified compound 2500 | A-403 | 20 | B-204 | 80 | 2.05 |
| Exemplified compound 2501 | A-403 | 49 | B-205 | 51 | 2.06 |
| Exemplified compound 2502 | A-403 | 80 | B-205 | 20 | 2.01 |
| Exemplified compound 2503 | A-403 | 35 | B-205 | 65 | 2.09 |
| Exemplified compound 2504 | A-403 | 20 | B-205 | 80 | 2.11 |
| Exemplified compound 2505 | A-403 | 49 | B-301 | 51 | 2.06 |
| Exemplified compound 2506 | A-403 | 80 | B-301 | 20 | 2.01 |
| Exemplified compound 2507 | A-403 | 35 | B-301 | 65 | 2.08 |
| Exemplified compound 2508 | A-403 | 20 | B-301 | 80 | 2.10 |
| Exemplified compound 2509 | A-403 | 49 | B-302 | 51 | 2.06 |
| Exemplified compound 2510 | A-403 | 80 | B-302 | 20 | 2.01 |
| Exemplified compound 2511 | A-403 | 35 | B-302 | 65 | 2.08 |
| Exemplified compound 2512 | A-403 | 20 | B-302 | 80 | 2.10 |
| Exemplified compound 2513 | A-403 | 49 | B-303 | 51 | 2.07 |
| Exemplified compound 2514 | A-403 | 80 | B-303 | 20 | 2.01 |
| Exemplified compound 2515 | A-403 | 35 | B-303 | 65 | 2.09 |
| Exemplified compound 2516 | A-403 | 20 | B-303 | 80 | 2.12 |
| Exemplified compound 2517 | A-403 | 49 | B-304 | 51 | 2.06 |
| Exemplified compound 2518 | A-403 | 80 | B-304 | 20 | 2.01 |
| Exemplified compound 2519 | A-403 | 35 | B-304 | 65 | 2.08 |
| Exemplified compound 2520 | A-403 | 20 | B-304 | 80 | 2.11 |
| Exemplified compound 2521 | A-403 | 49 | B-305 | 51 | 2.01 |
| Exemplified compound 2522 | A-403 | 80 | B-305 | 20 | 1.99 |
| Exemplified compound 2523 | A-403 | 35 | B-305 | 65 | 2.01 |
| Exemplified compound 2524 | A-403 | 20 | B-305 | 80 | 2.02 |

TABLE 10-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2525 | A-403 | 49 | B-306 | 51 | 2.07 |
| Exemplified compound 2526 | A-403 | 80 | B-306 | 20 | 2.01 |
| Exemplified compound 2527 | A-403 | 35 | B-306 | 65 | 2.10 |
| Exemplified compound 2528 | A-403 | 20 | B-306 | 80 | 2.13 |
| Exemplified compound 2529 | A-403 | 49 | B-307 | 51 | 2.05 |
| Exemplified compound 2530 | A-403 | 80 | B-307 | 20 | 2.01 |
| Exemplified compound 2531 | A-403 | 35 | B-307 | 65 | 2.08 |
| Exemplified compound 2532 | A-403 | 20 | B-307 | 80 | 2.10 |
| Exemplified compound 2533 | A-403 | 49 | B-308 | 51 | 2.06 |
| Exemplified compound 2534 | A-403 | 80 | B-308 | 20 | 2.01 |
| Exemplified compound 2535 | A-403 | 35 | B-308 | 65 | 2.09 |
| Exemplified compound 2536 | A-403 | 20 | B-308 | 80 | 2.11 |
| Exemplified compound 2537 | A-403 | 49 | B-401 | 51 | 2.10 |
| Exemplified compound 2538 | A-403 | 80 | B-401 | 20 | 2.03 |
| Exemplified compound 2539 | A-403 | 35 | B-401 | 65 | 2.13 |
| Exemplified compound 2540 | A-403 | 20 | B-401 | 80 | 2.17 |
| Exemplified compound 2541 | A-403 | 49 | B-402 | 51 | 2.14 |
| Exemplified compound 2542 | A-403 | 80 | B-402 | 20 | 2.04 |
| Exemplified compound 2543 | A-403 | 35 | B-402 | 65 | 2.19 |
| Exemplified compound 2544 | A-403 | 20 | B-402 | 80 | 2.24 |
| Exemplified compound 2545 | A-403 | 49 | B-403 | 51 | 2.20 |
| Exemplified compound 2546 | A-403 | 80 | B-403 | 20 | 2.06 |
| Exemplified compound 2547 | A-403 | 35 | B-403 | 65 | 2.26 |
| Exemplified compound 2548 | A-403 | 20 | B-403 | 80 | 2.32 |
| Exemplified compound 2549 | A-403 | 49 | B-404 | 51 | 2.07 |
| Exemplified compound 2550 | A-403 | 80 | B-404 | 20 | 2.01 |
| Exemplified compound 2551 | A-403 | 35 | B-404 | 65 | 2.10 |
| Exemplified compound 2552 | A-403 | 20 | B-404 | 80 | 2.13 |
| Exemplified compound 2553 | A-403 | 49 | B-405 | 51 | 2.13 |
| Exemplified compound 2554 | A-403 | 80 | B-405 | 20 | 2.04 |
| Exemplified compound 2555 | A-403 | 35 | B-405 | 65 | 2.18 |
| Exemplified compound 2556 | A-403 | 20 | B-405 | 80 | 2.22 |
| Exemplified compound 2557 | A-404 | 49 | B-101 | 51 | 2.08 |
| Exemplified compound 2558 | A-404 | 80 | B-101 | 20 | 2.07 |
| Exemplified compound 2559 | A-404 | 35 | B-101 | 65 | 2.09 |

TABLE 10-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2560 | A-404 | 20 | B-101 | 80 | 2.10 |

TABLE 11

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2561 | A-404 | 49 | B-102 | 51 | 2.14 |
| Exemplified compound 2562 | A-404 | 80 | B-102 | 20 | 2.09 |
| Exemplified compound 2563 | A-404 | 35 | B-102 | 65 | 2.16 |
| Exemplified compound 2564 | A-404 | 20 | B-102 | 80 | 2.18 |
| Exemplified compound 2565 | A-404 | 49 | B-103 | 51 | 2.08 |
| Exemplified compound 2566 | A-404 | 80 | B-103 | 20 | 2.07 |
| Exemplified compound 2567 | A-404 | 35 | B-103 | 65 | 2.09 |
| Exemplified compound 2568 | A-404 | 20 | B-103 | 80 | 2.10 |
| Exemplified compound 2569 | A-404 | 49 | B-104 | 51 | 2.06 |
| Exemplified compound 2570 | A-404 | 80 | B-104 | 20 | 2.06 |
| Exemplified compound 2571 | A-404 | 35 | B-104 | 65 | 2.06 |
| Exemplified compound 2572 | A-404 | 20 | B-104 | 80 | 2.07 |
| Exemplified compound 2573 | A-404 | 49 | B-105 | 51 | 2.08 |
| Exemplified compound 2574 | A-404 | 80 | B-105 | 20 | 2.07 |
| Exemplified compound 2575 | A-404 | 35 | B-105 | 65 | 2.08 |
| Exemplified compound 2576 | A-404 | 20 | B-105 | 80 | 2.09 |
| Exemplified compound 2577 | A-404 | 49 | B-201 | 51 | 2.13 |
| Exemplified compound 2578 | A-404 | 80 | B-201 | 20 | 2.09 |
| Exemplified compound 2579 | A-404 | 35 | B-201 | 65 | 2.15 |
| Exemplified compound 2580 | A-404 | 20 | B-201 | 80 | 2.17 |
| Exemplified compound 2581 | A-404 | 49 | B-202 | 51 | 2.07 |
| Exemplified compound 2582 | A-404 | 80 | B-202 | 20 | 2.06 |
| Exemplified compound 2583 | A-404 | 35 | B-202 | 65 | 2.08 |
| Exemplified compound 2584 | A-404 | 20 | B-202 | 80 | 2.08 |
| Exemplified compound 2585 | A-404 | 49 | B-203 | 51 | 2.11 |
| Exemplified compound 2586 | A-404 | 80 | B-203 | 20 | 2.08 |
| Exemplified compound 2587 | A-404 | 35 | B-203 | 65 | 2.12 |
| Exemplified compound 2588 | A-404 | 20 | B-203 | 80 | 2.13 |

TABLE 11-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2589 | A-404 | 49 | B-204 | 51 | 2.07 |
| Exemplified compound 2590 | A-404 | 80 | B-204 | 20 | 2.06 |
| Exemplified compound 2591 | A-404 | 35 | B-204 | 65 | 2.07 |
| Exemplified compound 2592 | A-404 | 20 | B-204 | 80 | 2.07 |
| Exemplified compound 2593 | A-404 | 49 | B-205 | 51 | 2.10 |
| Exemplified compound 2594 | A-404 | 80 | B-205 | 20 | 2.08 |
| Exemplified compound 2595 | A-404 | 35 | B-205 | 65 | 2.12 |
| Exemplified compound 2596 | A-404 | 20 | B-205 | 80 | 2.13 |
| Exemplified compound 2597 | A-404 | 49 | B-301 | 51 | 2.10 |
| Exemplified compound 2598 | A-404 | 80 | B-301 | 20 | 2.07 |
| Exemplified compound 2599 | A-404 | 35 | B-301 | 65 | 2.11 |
| Exemplified compound 2600 | A-404 | 20 | B-301 | 80 | 2.12 |
| Exemplified compound 2601 | A-404 | 49 | B-302 | 51 | 2.10 |
| Exemplified compound 2602 | A-404 | 80 | B-302 | 20 | 2.07 |
| Exemplified compound 2603 | A-404 | 35 | B-302 | 65 | 2.11 |
| Exemplified compound 2604 | A-404 | 20 | B-302 | 80 | 2.12 |
| Exemplified compound 2605 | A-404 | 49 | B-303 | 51 | 2.11 |
| Exemplified compound 2606 | A-404 | 80 | B-303 | 20 | 2.08 |
| Exemplified compound 2607 | A-404 | 35 | B-303 | 65 | 2.12 |
| Exemplified compound 2608 | A-404 | 20 | B-303 | 80 | 2.13 |
| Exemplified compound 2609 | A-404 | 49 | B-304 | 51 | 2.10 |
| Exemplified compound 2610 | A-404 | 80 | B-304 | 20 | 2.07 |
| Exemplified compound 2611 | A-404 | 35 | B-304 | 65 | 2.11 |
| Exemplified compound 2612 | A-404 | 20 | B-304 | 80 | 2.12 |
| Exemplified compound 2613 | A-404 | 49 | B-305 | 51 | 2.05 |
| Exemplified compound 2614 | A-404 | 80 | B-305 | 20 | 2.05 |
| Exemplified compound 2615 | A-404 | 35 | B-305 | 65 | 2.04 |
| Exemplified compound 2616 | A-404 | 20 | B-305 | 80 | 2.04 |
| Exemplified compound 2617 | A-404 | 49 | B-306 | 51 | 2.11 |
| Exemplified compound 2618 | A-404 | 80 | B-306 | 20 | 2.08 |
| Exemplified compound 2619 | A-404 | 35 | B-306 | 65 | 2.13 |
| Exemplified compound 2620 | A-404 | 20 | B-306 | 80 | 2.14 |
| Exemplified compound 2621 | A-404 | 49 | B-307 | 51 | 2.09 |
| Exemplified compound 2622 | A-404 | 80 | B-307 | 20 | 2.07 |
| Exemplified compound 2623 | A-404 | 35 | B-307 | 65 | 2.10 |
| Exemplified compound 2624 | A-404 | 20 | B-307 | 80 | 2.12 |

TABLE 11-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2625 | A-404 | 49 | B-308 | 51 | 2.10 |
| Exemplified compound 2626 | A-404 | 80 | B-308 | 20 | 2.08 |
| Exemplified compound 2627 | A-404 | 35 | B-308 | 65 | 2.12 |
| Exemplified compound 2628 | A-404 | 20 | B-308 | 80 | 2.13 |
| Exemplified compound 2629 | A-404 | 49 | B-401 | 51 | 2.14 |
| Exemplified compound 2630 | A-404 | 80 | B-401 | 20 | 2.09 |
| Exemplified compound 2631 | A-404 | 35 | B-401 | 65 | 2.16 |
| Exemplified compound 2632 | A-404 | 20 | B-401 | 80 | 2.19 |
| Exemplified compound 2633 | A-404 | 49 | B-402 | 51 | 2.18 |
| Exemplified compound 2634 | A-404 | 80 | B-402 | 20 | 2.11 |
| Exemplified compound 2635 | A-404 | 35 | B-402 | 65 | 2.22 |
| Exemplified compound 2636 | A-404 | 20 | B-402 | 80 | 2.25 |
| Exemplified compound 2637 | A-404 | 49 | B-403 | 51 | 2.24 |
| Exemplified compound 2638 | A-404 | 80 | B-403 | 20 | 2.13 |
| Exemplified compound 2639 | A-404 | 35 | B-403 | 65 | 2.28 |
| Exemplified compound 2640 | A-404 | 20 | B-403 | 80 | 2.34 |
| Exemplified compound 2641 | A-404 | 49 | B-404 | 51 | 2.11 |
| Exemplified compound 2642 | A-404 | 80 | B-404 | 20 | 2.08 |
| Exemplified compound 2643 | A-404 | 35 | B-404 | 65 | 2.13 |
| Exemplified compound 2644 | A-404 | 20 | B-404 | 80 | 2.14 |
| Exemplified compound 2645 | A-404 | 49 | B-405 | 51 | 2.17 |
| Exemplified compound 2646 | A-404 | 80 | B-405 | 20 | 2.10 |
| Exemplified compound 2647 | A-404 | 35 | B-405 | 65 | 2.21 |
| Exemplified compound 2648 | A-404 | 20 | B-405 | 80 | 2.24 |
| Exemplified compound 2649 | A-405 | 49 | B-101 | 51 | 2.07 |
| Exemplified compound 2650 | A-405 | 80 | B-101 | 20 | 2.04 |
| Exemplified compound 2651 | A-405 | 35 | B-101 | 65 | 2.08 |
| Exemplified compound 2652 | A-405 | 20 | B-101 | 80 | 2.09 |
| Exemplified compound 2653 | A-405 | 49 | B-102 | 51 | 2.12 |
| Exemplified compound 2654 | A-405 | 80 | B-102 | 20 | 2.06 |
| Exemplified compound 2655 | A-405 | 35 | B-102 | 65 | 2.14 |
| Exemplified compound 2656 | A-405 | 20 | B-102 | 80 | 2.17 |
| Exemplified compound 2657 | A-405 | 49 | B-103 | 51 | 2.07 |
| Exemplified compound 2658 | A-405 | 80 | B-103 | 20 | 2.04 |
| Exemplified compound 2659 | A-405 | 35 | B-103 | 65 | 2.08 |
| Exemplified compound 2660 | A-405 | 20 | B-103 | 80 | 2.09 |

TABLE 11-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2661 | A-405 | 49 | B-104 | 51 | 2.04 |
| Exemplified compound 2662 | A-405 | 80 | B-104 | 20 | 2.03 |
| Exemplified compound 2663 | A-405 | 35 | B-104 | 65 | 2.05 |
| Exemplified compound 2664 | A-405 | 20 | B-104 | 80 | 2.06 |
| Exemplified compound 2665 | A-405 | 49 | B-105 | 51 | 2.06 |
| Exemplified compound 2666 | A-405 | 80 | B-105 | 20 | 2.04 |
| Exemplified compound 2667 | A-405 | 35 | B-105 | 65 | 2.07 |
| Exemplified compound 2668 | A-405 | 20 | B-105 | 80 | 2.08 |
| Exemplified compound 2669 | A-405 | 49 | B-201 | 51 | 2.11 |
| Exemplified compound 2670 | A-405 | 80 | B-201 | 20 | 2.06 |

TABLE 11-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2671 | A-405 | 35 | B-201 | 65 | 2.14 |
| Exemplified compound 2672 | A-405 | 20 | B-201 | 80 | 2.17 |
| Exemplified compound 2673 | A-405 | 49 | B-202 | 51 | 2.06 |
| Exemplified compound 2674 | A-405 | 80 | B-202 | 20 | 2.04 |
| Exemplified compound 2675 | A-405 | 35 | B-202 | 65 | 2.07 |
| Exemplified compound 2676 | A-405 | 20 | B-202 | 80 | 2.08 |
| Exemplified compound 2677 | A-405 | 49 | B-203 | 51 | 2.09 |
| Exemplified compound 2678 | A-405 | 80 | B-203 | 20 | 2.05 |
| Exemplified compound 2679 | A-405 | 35 | B-203 | 65 | 2.11 |
| Exemplified compound 2680 | A-405 | 20 | B-203 | 80 | 2.13 |

TABLE 12

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2681 | A-405 | 49 | B-204 | 51 | 2.05 |
| Exemplified compound 2682 | A-405 | 80 | B-204 | 20 | 2.03 |
| Exemplified compound 2683 | A-405 | 35 | B-204 | 65 | 2.06 |
| Exemplified compound 2684 | A-405 | 20 | B-204 | 80 | 2.06 |
| Exemplified compound 2685 | A-405 | 49 | B-205 | 51 | 2.09 |
| Exemplified compound 2686 | A-405 | 80 | B-205 | 20 | 2.05 |
| Exemplified compound 2687 | A-405 | 35 | B-205 | 65 | 2.10 |
| Exemplified compound 2688 | A-405 | 20 | B-205 | 80 | 2.12 |
| Exemplified compound 2689 | A-405 | 49 | B-301 | 51 | 2.08 |
| Exemplified compound 2690 | A-405 | 80 | B-301 | 20 | 2.04 |
| Exemplified compound 2691 | A-405 | 35 | B-301 | 65 | 2.09 |
| Exemplified compound 2692 | A-405 | 20 | B-301 | 80 | 2.11 |
| Exemplified compound 2693 | A-405 | 49 | B-302 | 51 | 2.08 |
| Exemplified compound 2694 | A-405 | 80 | B-302 | 20 | 2.04 |
| Exemplified compound 2695 | A-405 | 35 | B-302 | 65 | 2.09 |
| Exemplified compound 2696 | A-405 | 20 | B-302 | 80 | 2.11 |
| Exemplified compound 2697 | A-405 | 49 | B-303 | 51 | 2.09 |
| Exemplified compound 2698 | A-405 | 80 | B-303 | 20 | 2.05 |
| Exemplified compound 2699 | A-405 | 35 | B-303 | 65 | 2.11 |

| Exemplified compound No. | Group A Structural unit | Group A Proportion (mol %) | Group B Structural unit | Group B Proportion (mol %) | Dielectric constant |
|---|---|---|---|---|---|
| Exemplified compound 2681 | A-405 | 49 | B-204 | 51 | 2.05 |
| Exemplified compound 2682 | A-405 | 80 | B-204 | 20 | 2.03 |
| Exemplified compound 2683 | A-405 | 35 | B-204 | 65 | 2.06 |
| Exemplified compound 2684 | A-405 | 20 | B-204 | 80 | 2.06 |
| Exemplified compound 2685 | A-405 | 49 | B-205 | 51 | 2.09 |
| Exemplified compound 2686 | A-405 | 80 | B-205 | 20 | 2.05 |
| Exemplified compound 2687 | A-405 | 35 | B-205 | 65 | 2.10 |
| Exemplified compound 2688 | A-405 | 20 | B-205 | 80 | 2.12 |
| Exemplified compound 2689 | A-405 | 49 | B-301 | 51 | 2.08 |
| Exemplified compound 2690 | A-405 | 80 | B-301 | 20 | 2.04 |
| Exemplified compound 2691 | A-405 | 35 | B-301 | 65 | 2.09 |
| Exemplified compound 2692 | A-405 | 20 | B-301 | 80 | 2.11 |
| Exemplified compound 2693 | A-405 | 49 | B-302 | 51 | 2.08 |
| Exemplified compound 2694 | A-405 | 80 | B-302 | 20 | 2.04 |
| Exemplified compound 2695 | A-405 | 35 | B-302 | 65 | 2.09 |
| Exemplified compound 2696 | A-405 | 20 | B-302 | 80 | 2.11 |
| Exemplified compound 2697 | A-405 | 49 | B-303 | 51 | 2.09 |
| Exemplified compound 2698 | A-405 | 80 | B-303 | 20 | 2.05 |
| Exemplified compound 2699 | A-405 | 35 | B-303 | 65 | 2.11 |

TABLE 12-continued

Specific examples of polycarbonate resins

| Exemplified compound No. | Group A Structural unit | Group A Proportion (mol %) | Group B Structural unit | Group B Proportion (mol %) | Dielectric constant | Exemplified compound No. | Group A Structural unit | Group A Proportion (mol %) | Group B Structural unit | Group B Proportion (mol %) | Dielectric constant |
|---|---|---|---|---|---|---|---|---|---|---|---|
| Exemplified compound 2700 | A-405 | 20 | B-303 | 80 | 2.13 | Exemplified compound 2700 | A-405 | 20 | B-303 | 80 | 2.13 |
| Exemplified compound 2701 | A-405 | 49 | B-304 | 51 | 2.08 | Exemplified compound 2701 | A-405 | 49 | B-304 | 51 | 2.08 |
| Exemplified compound 2702 | A-405 | 80 | B-304 | 20 | 2.05 | Exemplified compound 2702 | A-405 | 80 | B-304 | 20 | 2.05 |
| Exemplified compound 2703 | A-405 | 35 | B-304 | 65 | 2.10 | Exemplified compound 2703 | A-405 | 35 | B-304 | 65 | 2.10 |
| Exemplified compound 2704 | A-405 | 20 | B-304 | 80 | 2.12 | Exemplified compound 2704 | A-405 | 20 | B-304 | 80 | 2.12 |
| Exemplified compound 2705 | A-405 | 49 | B-305 | 51 | 2.03 | Exemplified compound 2705 | A-405 | 49 | B-305 | 51 | 2.03 |
| Exemplified compound 2706 | A-405 | 80 | B-305 | 20 | 2.02 | Exemplified compound 2706 | A-405 | 80 | B-305 | 20 | 2.02 |
| Exemplified compound 2707 | A-405 | 35 | B-305 | 65 | 2.03 | Exemplified compound 2707 | A-405 | 35 | B-305 | 65 | 2.03 |
| Exemplified compound 2708 | A-405 | 20 | B-305 | 80 | 2.03 | Exemplified compound 2708 | A-405 | 20 | B-305 | 80 | 2.03 |
| Exemplified compound 2709 | A-405 | 49 | B-306 | 51 | 2.09 | Exemplified compound 2709 | A-405 | 49 | B-306 | 51 | 2.09 |
| Exemplified compound 2710 | A-405 | 80 | B-306 | 20 | 2.05 | Exemplified compound 2710 | A-405 | 80 | B-306 | 20 | 2.05 |
| Exemplified compound 2711 | A-405 | 35 | B-306 | 65 | 2.11 | Exemplified compound 2711 | A-405 | 35 | B-306 | 65 | 2.11 |
| Exemplified compound 2712 | A-405 | 20 | B-306 | 80 | 2.14 | Exemplified compound 2712 | A-405 | 20 | B-306 | 80 | 2.14 |
| Exemplified compound 2713 | A-405 | 49 | B-307 | 51 | 2.08 | Exemplified compound 2713 | A-405 | 49 | B-307 | 51 | 2.08 |
| Exemplified compound 2714 | A-405 | 80 | B-307 | 20 | 2.04 | Exemplified compound 2714 | A-405 | 80 | B-307 | 20 | 2.04 |
| Exemplified compound 2715 | A-405 | 35 | B-307 | 65 | 2.09 | Exemplified compound 2715 | A-405 | 35 | B-307 | 65 | 2.09 |
| Exemplified compound 2716 | A-405 | 20 | B-307 | 80 | 2.11 | Exemplified compound 2716 | A-405 | 20 | B-307 | 80 | 2.11 |
| Exemplified compound 2717 | A-405 | 49 | B-308 | 51 | 2.09 | Exemplified compound 2717 | A-405 | 49 | B-308 | 51 | 2.09 |
| Exemplified compound 2718 | A-405 | 80 | B-308 | 20 | 2.05 | Exemplified compound 2718 | A-405 | 80 | B-308 | 20 | 2.05 |
| Exemplified compound 2719 | A-405 | 35 | B-308 | 65 | 2.10 | Exemplified compound 2719 | A-405 | 35 | B-308 | 65 | 2.10 |
| Exemplified compound 2720 | A-405 | 20 | B-308 | 80 | 2.12 | Exemplified compound 2720 | A-405 | 20 | B-308 | 80 | 2.12 |
| Exemplified compound 2721 | A-405 | 49 | B-401 | 51 | 2.12 | Exemplified compound 2721 | A-405 | 49 | B-401 | 51 | 2.12 |
| Exemplified compound 2722 | A-405 | 80 | B-401 | 20 | 2.06 | Exemplified compound 2722 | A-405 | 80 | B-401 | 20 | 2.06 |
| Exemplified compound 2723 | A-405 | 35 | B-401 | 65 | 2.15 | Exemplified compound 2723 | A-405 | 35 | B-401 | 65 | 2.15 |
| Exemplified compound 2724 | A-405 | 20 | B-401 | 80 | 2.18 | Exemplified compound 2724 | A-405 | 20 | B-401 | 80 | 2.18 |
| Exemplified compound 2725 | A-405 | 49 | B-402 | 51 | 2.16 | Exemplified compound 2725 | A-405 | 49 | B-402 | 51 | 2.16 |
| Exemplified compound 2726 | A-405 | 80 | B-402 | 20 | 2.08 | Exemplified compound 2726 | A-405 | 80 | B-402 | 20 | 2.08 |
| Exemplified compound 2727 | A-405 | 35 | B-402 | 65 | 2.20 | Exemplified compound 2727 | A-405 | 35 | B-402 | 65 | 2.20 |
| Exemplified compound 2728 | A-405 | 20 | B-402 | 80 | 2.24 | Exemplified compound 2728 | A-405 | 20 | B-402 | 80 | 2.24 |
| Exemplified compound 2729 | A-405 | 49 | B-403 | 51 | 2.22 | Exemplified compound 2729 | A-405 | 49 | B-403 | 51 | 2.22 |
| Exemplified compound 2730 | A-405 | 80 | B-403 | 20 | 2.10 | Exemplified compound 2730 | A-405 | 80 | B-403 | 20 | 2.10 |
| Exemplified compound 2731 | A-405 | 35 | B-403 | 65 | 2.27 | Exemplified compound 2731 | A-405 | 35 | B-403 | 65 | 2.27 |
| Exemplified compound 2732 | A-405 | 20 | B-403 | 80 | 2.33 | Exemplified compound 2732 | A-405 | 20 | B-403 | 80 | 2.33 |
| Exemplified compound 2733 | A-405 | 49 | B-404 | 51 | 2.10 | Exemplified compound 2733 | A-405 | 49 | B-404 | 51 | 2.10 |
| Exemplified compound 2734 | A-405 | 80 | B-404 | 20 | 2.05 | Exemplified compound 2734 | A-405 | 80 | B-404 | 20 | 2.05 |
| Exemplified compound 2735 | A-405 | 35 | B-404 | 65 | 2.12 | Exemplified compound 2735 | A-405 | 35 | B-404 | 65 | 2.12 |

TABLE 12-continued

Specific examples of polycarbonate resins

| Exemplified compound No. | Group A Structural unit | Group A Proportion (mol %) | Group B Structural unit | Group B Proportion (mol %) | Dielectric constant | Exemplified compound No. | Group A Structural unit | Group A Proportion (mol %) | Group B Structural unit | Group B Proportion (mol %) | Dielectric constant |
|---|---|---|---|---|---|---|---|---|---|---|---|
| Exemplified compound 2736 | A-405 | 20 | B-404 | 80 | 2.14 | Exemplified compound 2736 | A-405 | 20 | B-404 | 80 | 2.14 |
| Exemplified compound 2737 | A-405 | 49 | B-405 | 51 | 2.16 | Exemplified compound 2737 | A-405 | 49 | B-405 | 51 | 2.16 |
| Exemplified compound 2738 | A-405 | 80 | B-405 | 20 | 2.07 | Exemplified compound 2738 | A-405 | 80 | B-405 | 20 | 2.07 |
| Exemplified compound 2739 | A-405 | 35 | B-405 | 65 | 2.19 | Exemplified compound 2739 | A-405 | 35 | B-405 | 65 | 2.19 |
| Exemplified compound 2740 | A-405 | 20 | B-405 | 80 | 2.23 | Exemplified compound 2740 | A-405 | 20 | B-405 | 80 | 2.23 |

Synthesis of the Polycarbonate Resin

The following describes a method for synthesizing exemplified compound 1001 by way of example. The other polycarbonate resins can be synthesized using appropriate group-A and group-B structural raw materials (raw materials from which the structural units selected from group A and group B, respectively, are produced) in appropriate amounts in the method described in Synthesis of exemplified compound. 1001 below. The weight-average molecular weight of the resin can be adjusted by controlling the amount of the molecular-weight modifier.

Synthesis of Exemplified Compound 1001

The following materials were dissolved in 1100 ml of a 5% by mass aqueous solution of sodium hydroxide: 53.0 g (0.196 mol) of 2,2-bis(4-hydroxyphenyl)-4-methyl pentane (Tokyo Chemical Industry, product code D3267) as group-A structural raw material, 41.2 g (0.204 mol) of bis (4-hydroxyphenyl)ether (Tokyo Chemical Industry, product code 132121) as group-B structural raw material, and 0.1 g of hydrosulfide. After the addition of 500 ml of methylene chloride, 60 g of phosgene was blown into the solution over 60 minutes with stirring, with the temperature maintained at 15° C.

The reaction solution into which the phosgene had been blown was stirred with 1.3 g of p-t-butylphenol (Tokyo Chemical Industry, product code B0383) as a molecular-weight modifier until emulsification. The resulting emulsion was stirred at 23° C. for 1 hour with 0.4 ml of triethylamine for polymerization.

After the completion of polymerization, the reaction solution was separated into aqueous and organic phases. The organic phase was neutralized with phosphoric acid and then repeatedly washed with water unitl the conductivity of the washing (aqueous phase) was 10 μS/cm or less. The resulting solution of polymer was added dropwise into warm water kept at 45° C., and the solvent was evaporated away. This yielded a white powdery precipitate. This precipitate was collected through filtration and dried at 110° C. for 24 hours. In this way, the exemplified compound 1001 polycarbonate resin was obtained as a copolymer composed of group-A structural unit A-101 and group-B structural unit B-101.

The obtained polycarbonate resin was analyzed using infrared absorption spectroscopy the spectrum had a carbonyl absorption at around 1770 am.$^{-1}$ and an ether absorption at around 1240 cm$^{-1}$, identifying the product to be a polycarbonate resin.

Electrophotographic Photosensitive Member

An electrophotographic photosensitive member according to an aspect of the invention has a support, a charge generation layer, and a charge transport layer as a surface layer in this order. There may be other layers between the support and the charge transport layer. The details of the individual layers are given below.

This electrophotographdc photosensitive member can be manufactured through, for example, preparation of coating liquids for forming the layers described below and subsequent application and drying of these liquids in the desired order of layers. Examples of methods that can be used to apply the coating liquids include dip coating, spray coating, curtain coating, and spin coating. In particular, dip coating provides excellent efficiency and productivity.

Support in an embodiment of the invention, the support can be a conductive support, i.e., a support having electroconductivity. Examples of conductive supports include supports made of aluminum, iron, nickel, copper, gold, or other metals or alloys and supports composed of an insulating substrate, such as polyester resin, polycarbonate resin, polyimide resin, or glass, and any of the following thin films thereon: a thin film of aluminum, chromium, silver, gold, or similar metals; a thin film of inddum oxide, tin oxide, zinc oxide, or similar conductive materials; and a thin film of a conductive ink containing silver nanowires.

The surface of the support may have been treated. for the purpose of improved electrical characteristics and reduced interference fringes. Examples of treatments Include anodization and other electrochemical processes, wet honing, blasting, and cutting.

With regard to shape, the support can be, for example, a cylinder or a film.

Conductive Layer

In an embodiment of the invention, there may be a conductive layer on the support. Such a conductive layer prevents interference fringes by covering irregularities and defects on the support. The average thickness of the conductive layer can be 5 μm or more and 40 μm or less, preferably 10 μm or more and 30 μm or less.

The conductive layer may contain conducive particles and a binder resin. The conductive particles can be carbon black, metallic particles, metal oxide particles, or similar.

The metal oxide particles can be particles of zinc oxide, white lead, aluminum oxide, indium oxide, silicon oxide, zirconium oxide, tin oxide, titanium oxide, magnesium oxide, antimony oxide, bismuth oxide, tin-doped indium oxide, antinomy- or tantalum-doped tin oxide, or similar. A combination of two or more of these particles can also be used. Particles of zinc oxide, tin oxide, and titanium oxide are preferred. In particular, titanium oxide particles, absorbing little of visible and near-infrared light and white in color, provide high sensitivity. Titanium oxide has several crystal forms, such as rutile, anatase, brookite, and amorphous, and any of these crystal forms can be used, preferably rutile. It is also possible to use needle or granular crystals of titanium oxide. The number-average primary particle diameter of the metal oxide particles can be in the range of 0.05 to 1 μm, preferably 0.1 to 0.5 μm.

The binder resin can be phenolic, polyurethane, polyamide, polyimide, polyamide-imide, polyvinyl acetal, epoxy, acrylic, melamine, polyester, or similar resins. A combination of two or more of these resins can also be used. In particular, curable resins render the conductive layer highly resistant to solvents that can be used in the coating liquids for the formation of other layers and highly adhesive to a conductive support, without compromising the dispersibility and dispersion stability of metal oxide particles. Such a curable resin can be a thermosetting resin. Examples of thermosetting resins include thermosetting phenolic resins and thermosetting polyurethane resins.

Undercoat Layer

In an embodiment of the invention, there may be an undercoat layer on the support or the conductive layer. Such an undercoat layer provides enhanced barrier properties and adhesiveness. The average thickness of the undercoat layer can be 0.3 μm or more and 5.0 μm or less.

The undercoat layer may contain a binder resin and either an electron transport material or metal oxide particles. Such a structure provides a pathway through which electrons generated in a charge generation layer, one of the two kinds of electric charge generated in the charge generation layer, can be transported to the support. This prevents any increase in the occurrence of charge deactivation and trapping in the charge generation layer associated with improving capacity of the charge transport layer to transport charge. As a result, the initial electrical characteristics and the electrical characteristics after repeated use are improved.

Examples of electron transport materials include quinone, imide, benzimidazole, cyclopentadienylidene, fluorenone, xanthone, benzophenone, cyanovinyl, naphthylimide, and peryleneimide compounds. The electron transport material may have a polymerizable functional group, such as a hydroxy, thiol, amino, carboxy, or methoxy group.

For the metal oxide particles and the binder resin, the details are the same as in the foregoing "Conductive layer" section.

Charge Generation Layer

In an embodiment of the invention, there is a charge generation layer between the support and the charge transport layer. The charge generation layer may be contiguous to the charge transport layer. The thickness of the charge generation layer can be 0.05 μm or more and 1 μm or less, preferably 0.1 μm or more and 0.3 μm or less.

In an embodiment of the invention, the charge generation layer may contain a charge generation material and a binder resin.

The charge generation material content of the charge generation layer can be 40% by mass or more and 85% by mass or less, preferably 60% by mass or more and 80% by mass or less.

Examples of charge generation materials include: monoazo, disazo, and trisazo pigments, and other azo pigments; phthalocyanine pigments including metal phthalocyanine complexes and metal-free phthalocyanine; indigo pigments; perylene pigments; polycyclic quinone pigments; squarylium dyes; thiapyrylium salts; quinacridone pigments; azulenium salt pigments; cyanine dyes; xanthene dyes; quinone imine dyes; and styryl dyes. It is preferred that the charge generation material be a phthalocyanine pigment, more preferably crystalline gallium phthalocyanine.

Crystalline hydroxygallium phthalocyanine, crystalline chlorogallium phthalocyanine, crystalline bromogallium phthalocyanine, and crystalline iodogallium phthalocyanine have excellent sensitivity compared to other crystalline gallium phthalocyanines. Crystalline hydroxygallium phthalocyanine and crystalline chlorogallium phthalocyanine are particularly preferred. In crystalline hydroxygallium phthalocyanine, the gallium atom is coordinated by hydroxy groups as axial ligands. In crystalline chlorogallium phthalocyanine, the gallium atom is coordinated by chlorine atoms as axial ligands. In crystalline bromogallium phthalocyanine, the gallium atom is coordinated by bromine atoms as axial ligands. In crystalline iodogallium phthalocyanine, the gallium atom is coordinated by iodine atoms as axial ligands. Particularly high sensitivity is obtained with the use of a crystalline hydroxygallium phthalocyanine that exhibits peaks at Bragg angles 2θ of 7.4°±0.3° and 28.3°±0.3° in its CuKα X-ray diffraction pattern or a crystalline chlorogallium phthalocyanine that exhibits peaks at Bragg angles 2θ±0.2° of 7.4°, 16.6°, 25.5°, and 28.3° in its CuKα X-ray diffraction pattern.

The crystalline gallium phthalocyanine may contain an amide compound represented by the formula below in its crystal structure.

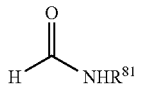

(In this formula, $R^{81}$ represents a methyl, propyl, or vinyl group.)

Specific examples of such amide compounds include N-methylformamide, N-propylformamide, and N-vinylformamide.

The amide compound content can be 0.1% by mass or more and 1.9% by mass or less, preferably 0.3% by mass or more and 1.5% by mass or less, with respect to the gallium phthalocyanine complex in the crystalline gallium phthalocyanine. When the amide compound content is 0.1% by mass or more and 1.9% by mass or less, the dark current from the charge generation layer at increased electric field intensity is small in the opinion of the inventors, making the charge transport layer according to this embodiment of the invention more effective in reducing fog. The amide compound content can be measured using $^{1}H$ NMR spectroscopy.

The crystalline gallium phthalocyanine containing an amide compound in its crystal structure can be obtained through a transformation process in which acid-pasted or dry-milled gallium phthalocyanine is wet-milled in a solvent containing the amide compound.

This process of wet milling is performed using a milling apparatus, such as a sand mill or a ball mill, with a dispersant, such as glass beads, steel beads, or alumina balls.

As for the binder resin, examples include resins such as polyester, acrylic resin, polycarbonate, polyvinyl butyral, polystyrene, polyvinyl acetate, polysulfone, acrylonitrile copolymers, and polyvinyl benzal. In particular, polyvinyl butyral and polyvinyl benzal are effective in dispersing crystalline gallium phthalocyanine.

Charge Transport Layer

In an embodiment of the invention, the charge transport layer contains a charge transport material and a polycarbonate resin that has a structural unit selected from group A and a structural unit selected from group B. The charge transport layer may optionally contain additives, such as a release agent for more efficient transfer of toner, an anti-fingerprint agent to reduce soiling or similar, filler to reduce scraping, and lubricant for higher lubricity.

In an embodiment of the invention, the charge transport layer can be formed by preparing a coating liquid for the formation of the charge transport layer by mi wing the charge transport material and the polycarbonate resin with a solvent, applying this coating liquid for the formation of the charge transport layer to form a wet coating, and drying this wet coating.

The solvent used in the coating liquid for the formation of the charge transport layer can be, for example, a ketone-based solvent, such as acetone or methyl ethyl ketone; an ester-based solvent, such as methyl acetate or ethyl acetate; an aromatic hydrocarbon solvent, such as toluene, xylene, or chlorobenzene; an ether-based solvent, such as 1,4-dioxane or tetrahydrofuran; or a halogenated hydrocarbon solvent, such as chloroform. A combination of two or more of these solvents can also be used. Solvents having a dipole moment of 1.0 D or less are preferred. Examples of solvents having a dipole moment of 1.0 D or less include o-xylene (dipole moment=0.64 D) and methylal (dipole moment=0.91 D).

The thickness of the charge transport layer can be 5 μm or more and 40 μm or less, preferably 7 μm or more and 25 μm or less.

The charge transport material content of the charge transport layer can be 20% by mass or more and 80% by mass or less, preferably 40% by mass or more and 70% by mass or less for more effective reduction of fog and higher long-term storage stability of the electrophotographic photosensitive member.

The molecular weight of the charge transport material can be 300 or more and 1,000 or less. For better electrical characteristics after repeated use and higher long-term storage stab., it is preferred that the molecular weight of the charge transport material be 600 or more and 800 or less. For more effective prevention of photomemories and higher long-term storage stability, it is preferred that the molecular weight of the charge transport material be 350 or more and 600 or less.

The charge transport material can be, for example, a triarylamine, hydrazone, stilbene, pyrazoline, oxazole, thiazole, or triallylamine compound, preferably a triarylamine compound. A combination of two or more of these compounds can also be used. The following are some specific examples of charge transport materials, represented by general formulae and exemplified compounds for each general formula.

(CTM-1)

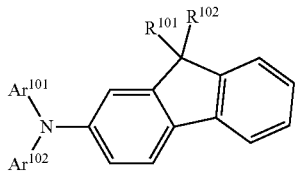

(In this formula, $Ar^{101}$ and $Ar^{102}$ each independently represent a substituted or unsubstituted aryl group. $R^{101}$ and $R^{102}$ each independently represent a hydrogen atom, an alkyl group, or a substituted or unsubstituted aryl group. Possible substituents for an aryl group are alkyl and alkoxy groups and a halogen atom.)

Here are some exemplified compounds for (CTM-1).

(101)

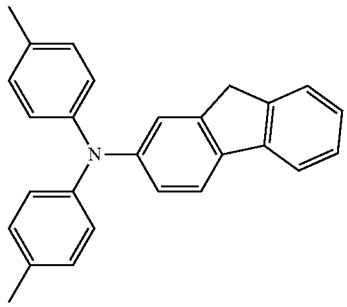

(102)

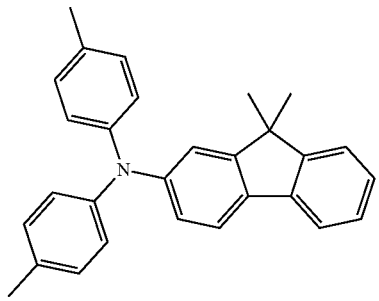

(103)

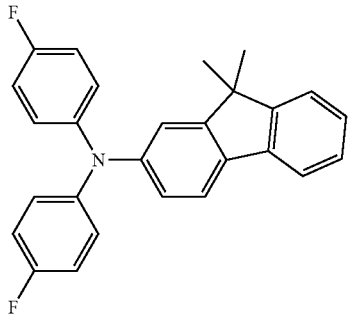

-continued (104)

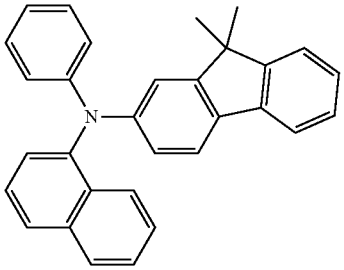

(105)

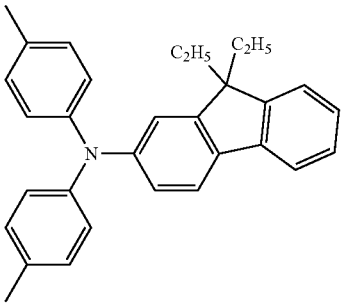

(106)

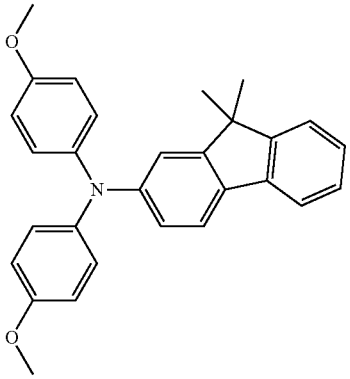

-continued (107)

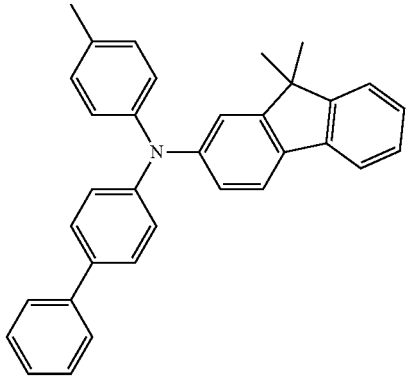

(108)

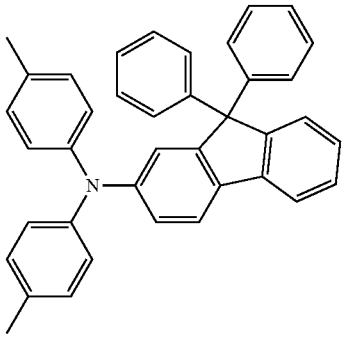

(CTM-2)

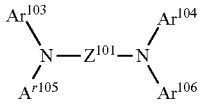

(In this formula, $Ar^{103}$ to $Ar^{106}$ each independently represent a substituted or unsubstituted aryl group. $Z^{101}$ represents a substituted or unsubstituted arylene group or a divalent group in which multiple arylene groups are linked via a vinylene group. There may be a ring formed by two adjacent substituents on $Ar^{103}$ to $Ar^{106}$ Possible substituents for an aryl or arylene group are alkyl and alkoxy groups and a halogen atom.)

Here are some exemplified compounds for (CTM-2).

(201)

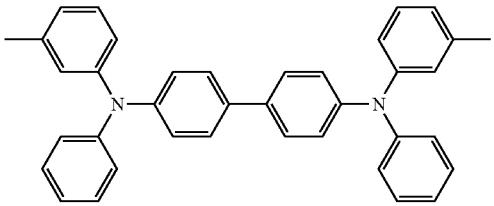

(202)

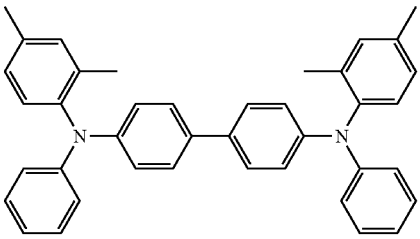

(203)

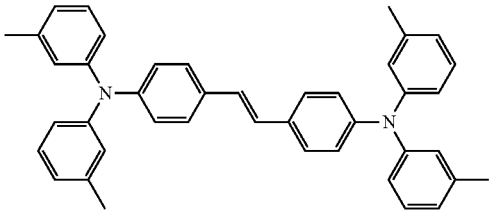

(204)

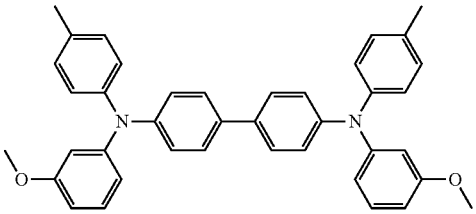

-continued
(205)
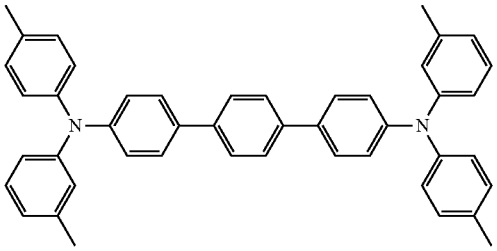
(206)
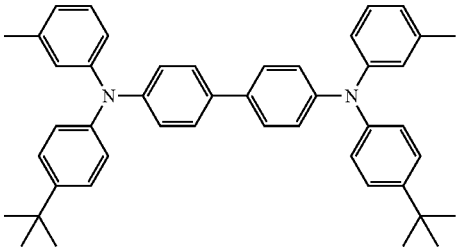
(207)
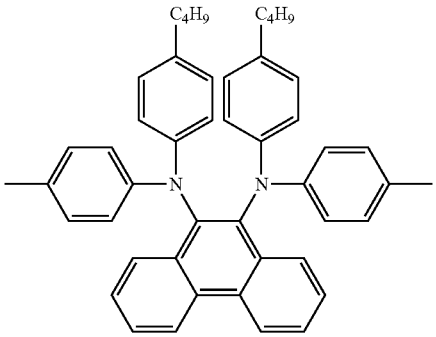
(208)
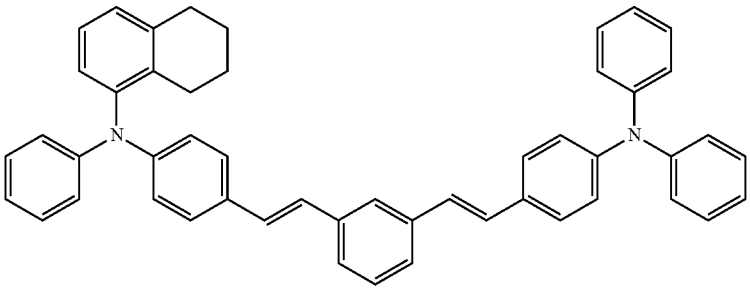
(209)'
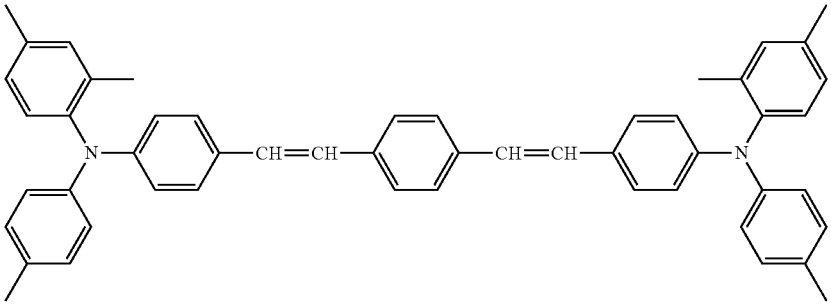
(210)
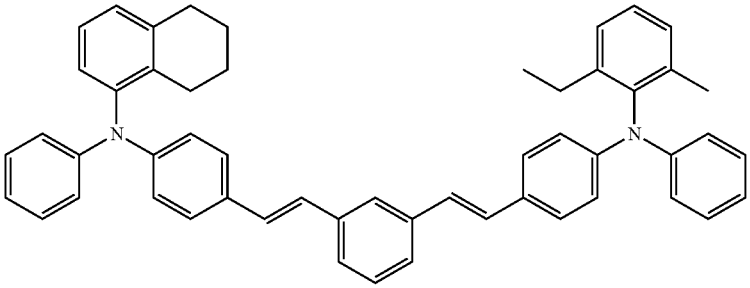

-continued (211)

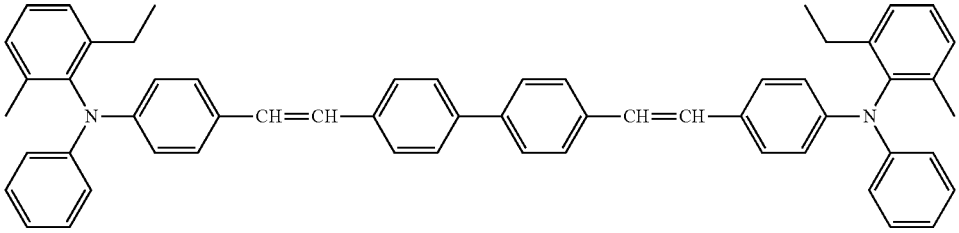

(212)

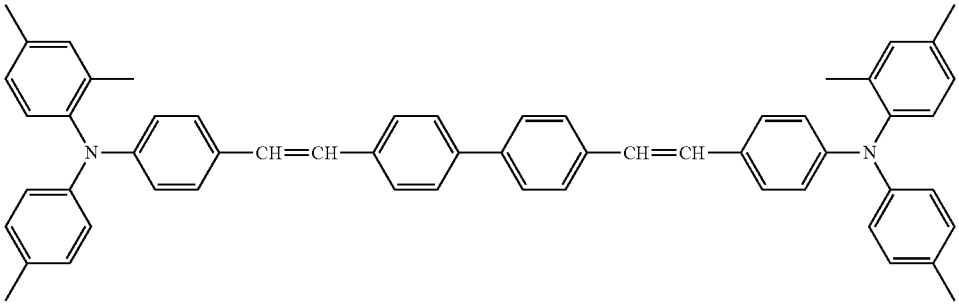

(CTM-3)

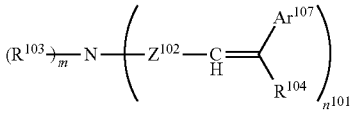

(In this formula, $R^{103}$ represents an alkyl group, a cycloalkyl group, or a substituted or unsubstituted aryl group. $R^{104}$ represents a hydrogen atom, an alkyl group, or a substituted or unsubstituted aryl group. $Ar^{107}$ represents a substituted or unsubstituted aryl group. $Z^{102}$ represents a substituted or unsubstituted arylene group. $n^{101}$ and m are integers of 1 to 3 and 0 to 2, respectively, with $m+n^{101}=3$. When m is 2, the two $R^{103}$ groups may be groups of the same kind or different groups, and there may be a ring formed by two adjacent substituents on the two $R^{103}$ groups. There may be a ring formed by $R^{103}$ and $Z^{102}$. Furthermore, there may be a ring formed by $Ar^{107}$ and $R^{104}$ involving a linking vinylene group. Possible substituents for an aryl or arylene group are alkyl and alkoxy groups and a halogen atom.)

Here are some exemplified compounds for (CTM-3).

(301)

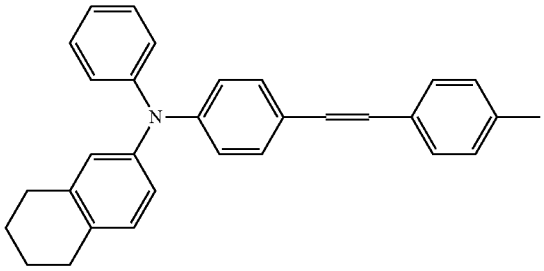

-continued (302)

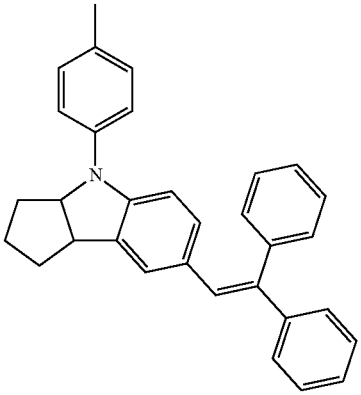

(303)

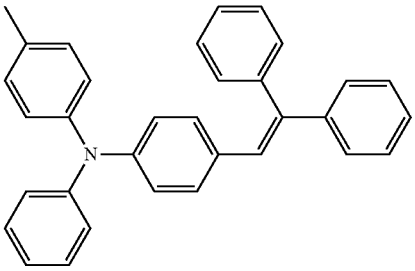

-continued
(304)
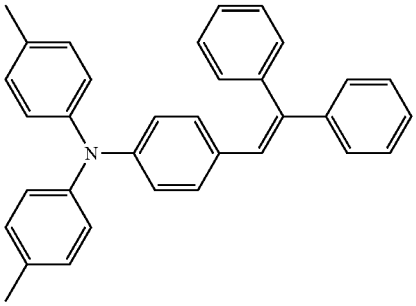
(305)
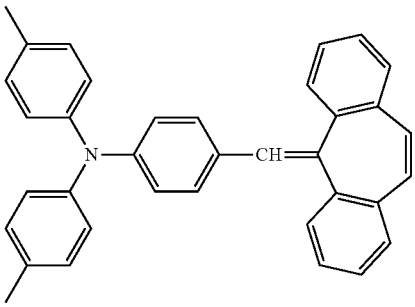
(306)
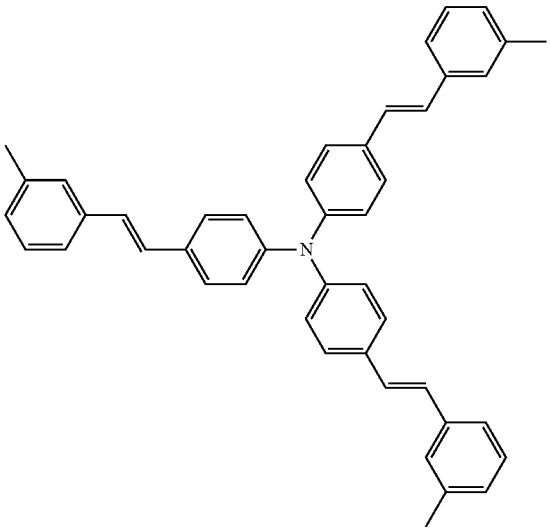
(307)
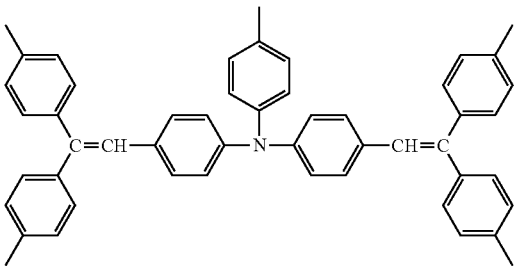
-continued
(308)
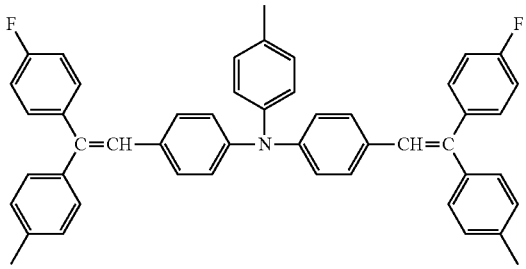
(309)
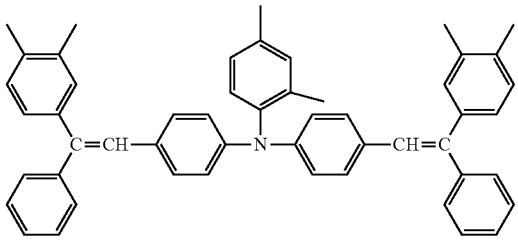
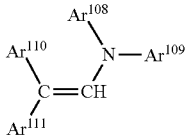
(In this formula, $Ar^{108}$ to $Ar^{111}$ each independently represent a substituted or unsubstituted aryl group. Possible substituents for an aryl group are an alkyl group, an alkoxyl group, a halogen atom, and a 4-phenyl-buta-1,3-dienyl group.)
Here are some exemplified compounds for (CTM-4).
(401)
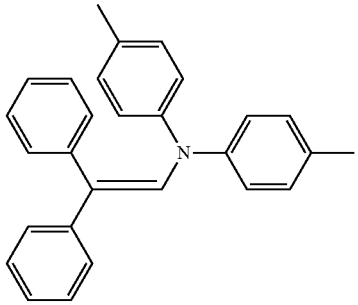
(402)
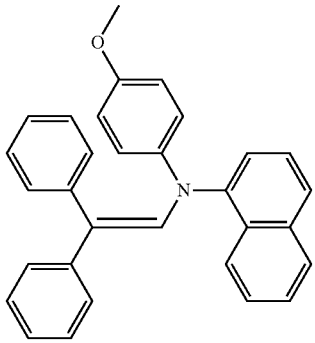

-continued (403)

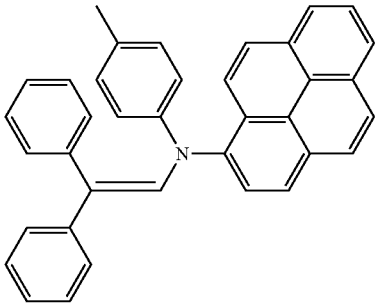

(404)

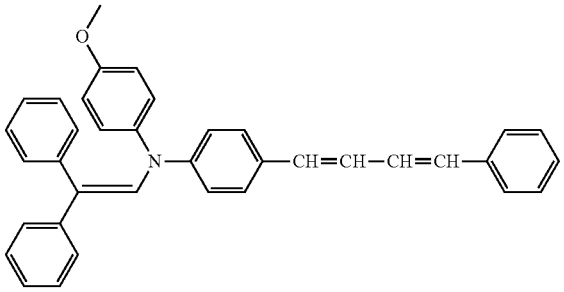

-continued (405)

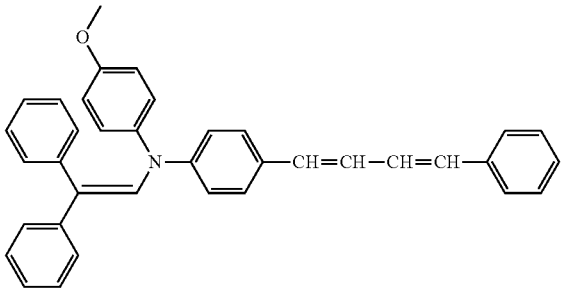

(CTM-5)

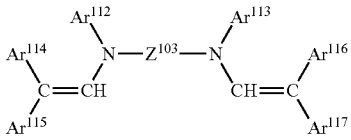

(In this formula, $Ar^{112}$ to $Ar^{117}$ each independently represent a substituted or unsubstituted aryl group. $Z^{103}$ represents a phenylene group, a biphenylene group, or a divalent group in which two phenylene groups are linked via an alkylene group. Possible substituents for an aryl group are alkyl and alkoxyl groups and a halogen atom.)

Here are some exemplified compounds for (CTM-5).

(501)

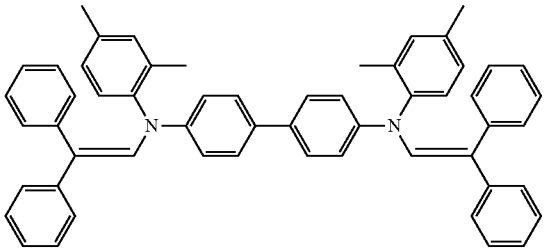

(502)

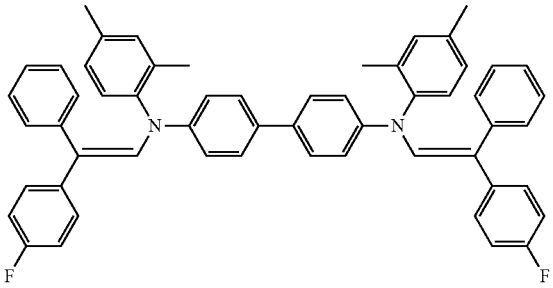

(503)

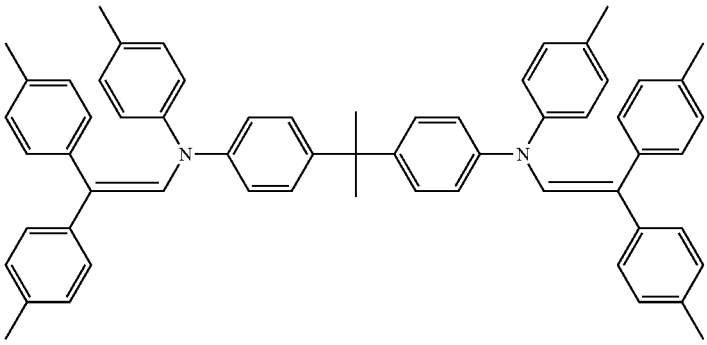

-continued (504)

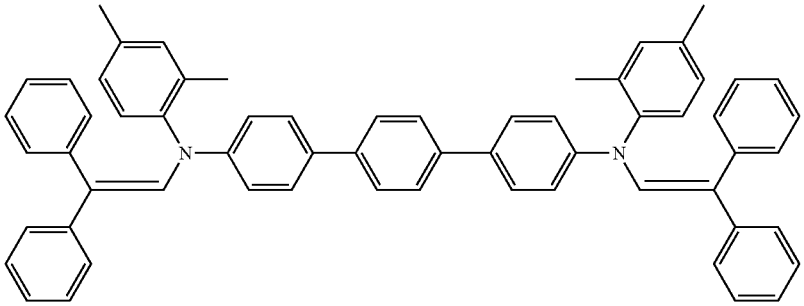

(505)

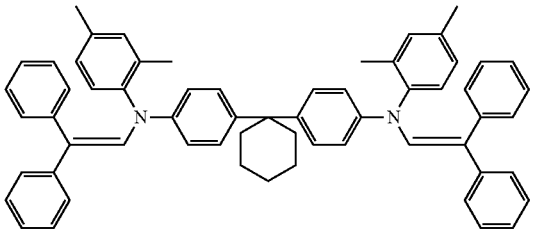

(506)

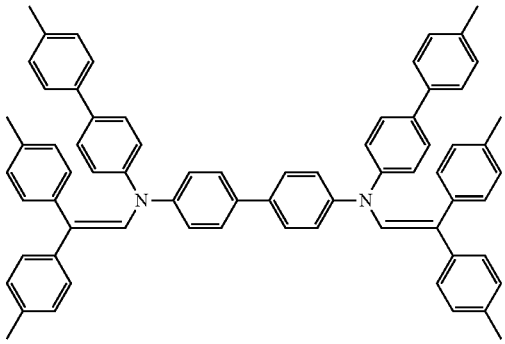

(CTM-6)

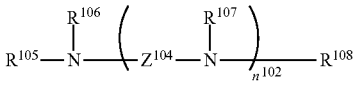

(In this formula, $R^{105}$ to $R^{108}$ each independently represent a monovalent group according to the formula below or an alkyl group or a substituted or unsubstituted aryl group, with at least one being a monovalent group according to the formula below. $Z^{104}$ represents a substitute or unsubstituted aryl cue group or a divalent group in which multiple arylene groups are linked via a vinylene group. $n^{102}$ is 0 or 1. Possible substituents for an aryl or arylene group are alkyl and alkoxy groups and a halogen atom.)

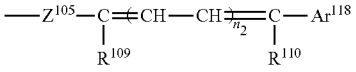

(In this formula, $R^{109}$ and $R^{110}$ each independently represent a hydrogen atom, an alkyl group, or a substituted or unsubstituted aryl group. $Ar^{110}$ represents a substituted or unsubstituted aryl group. $Z^{105}$ represents a substituted or unsubstituted arylene group. $n_2$ is an integer of 1 to 3. Possible substituents for an aryl group are alkyl, alkoxy, dialkylamino, and diarylamino groups. Possible substituents for the arylene group are alkyl and alkoxy groups and a halogen atom.)

Here are some exemplified compounds for (CTM-6).

(601)

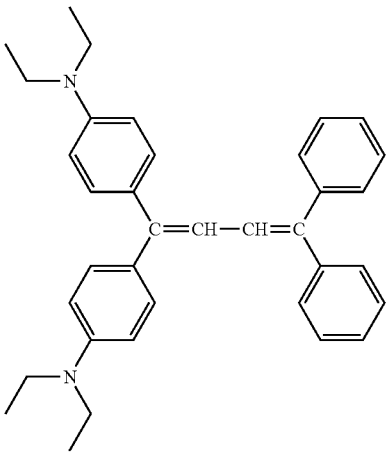

-continued
(602)
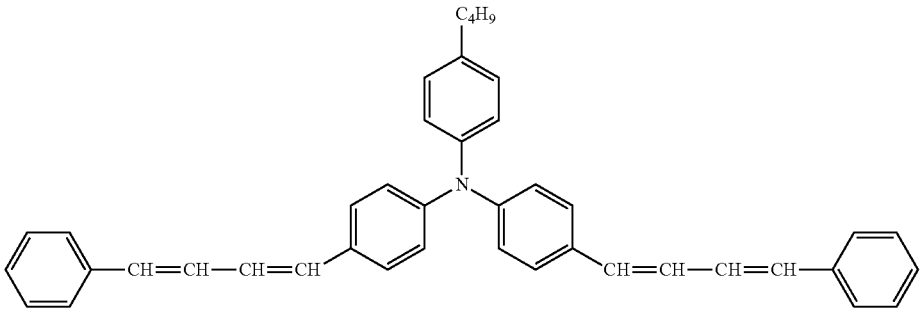
(603)
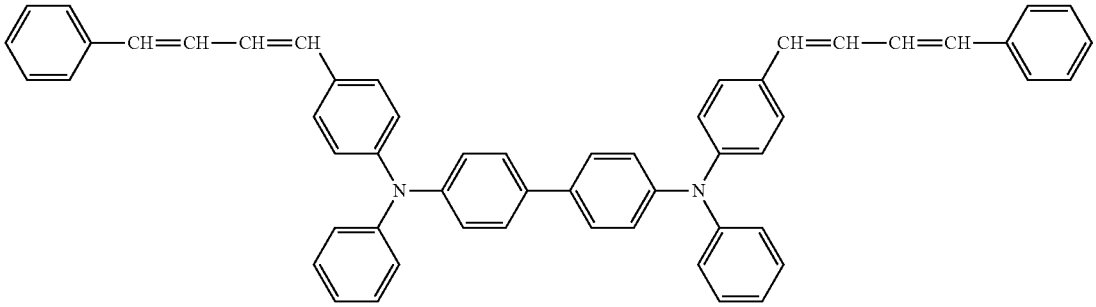
(604)
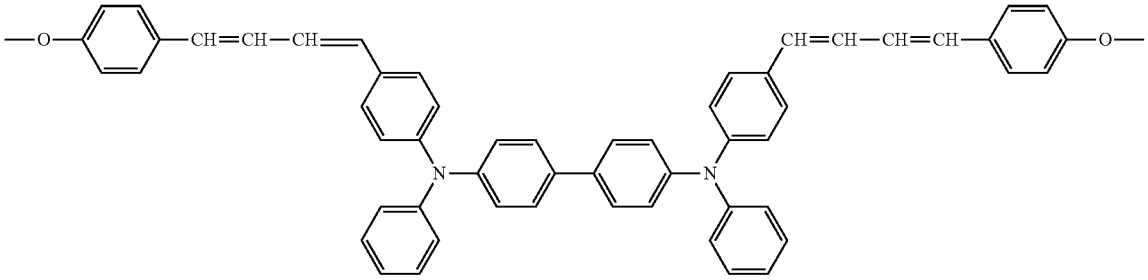
(605)
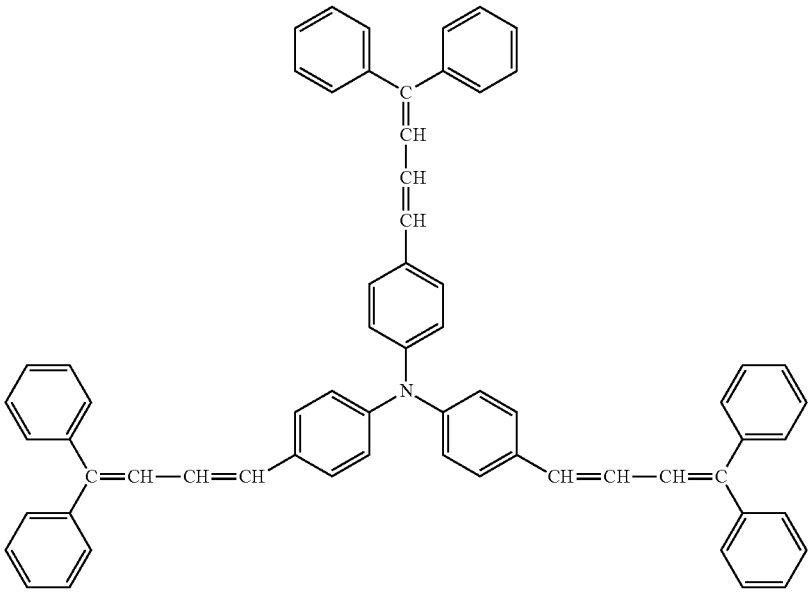

-continued (606)

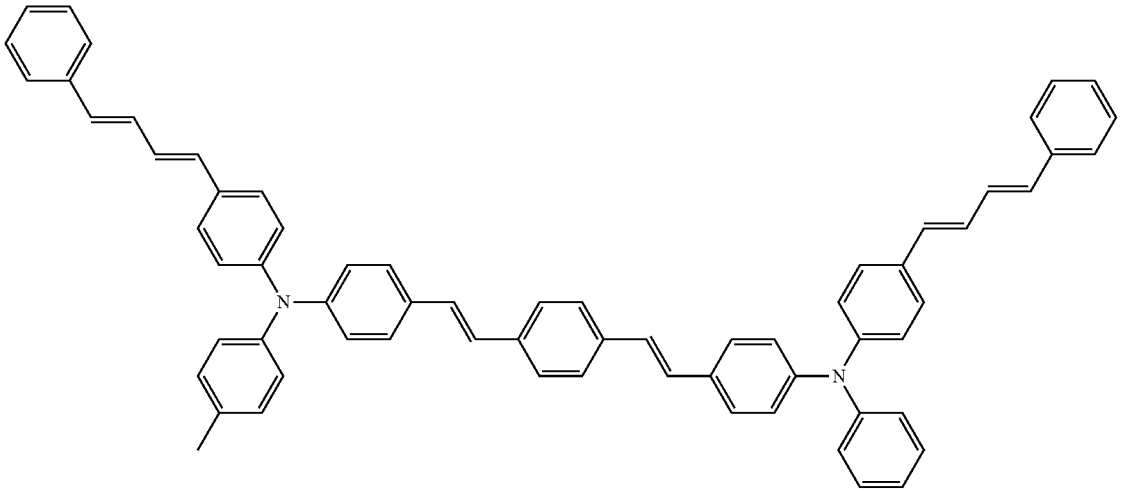

(CTM-7)

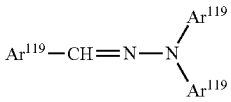

(In this formula, $Ar^{119}$ represents a substituted or unsubstituted aryl group or a monovalent group according to formula (7-1) or (7-2). $Ar^{120}$ and $Ar^{121}$ each independently represent a substituted or unsubstituted aryl group. Possible substituents for an aryl group are alkyl and alkoxy groups and a halogen atom.)

(7-1)

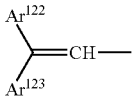

(In this formula, $Ar^{122}$ and $Ar^{123}$ independently represent a substituted or unsubstituted aryl group or a substituted or unsubstituted aralkyl group. Possible substituents for an aryl and aralkyl group are alkyl and alkoxy groups and a halogen atom.)

(7-2)

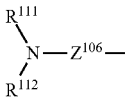

(In this formula, $R^{111}$ and $R^{112}$ each independently represent a substituted or unsubstituted aryl group. $Z^{106}$ represents a substituted or unsubstituted arylene group. Possible substituents for an aryl and arylene group are alkyl and alkoxy groups and a halogen atom.

Here are some exemplified compounds for (CTM-7).

(701)

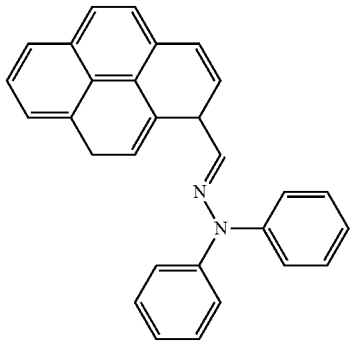

(702)

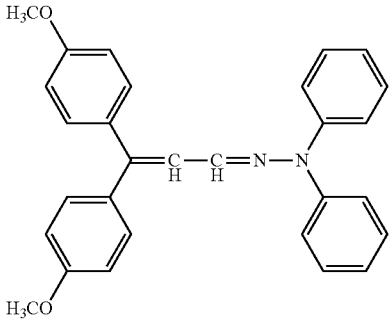

(703)

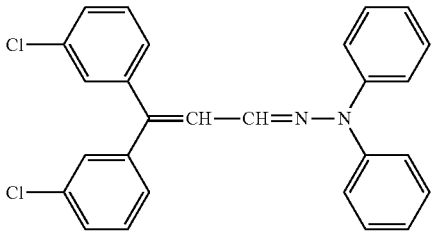

-continued (704)

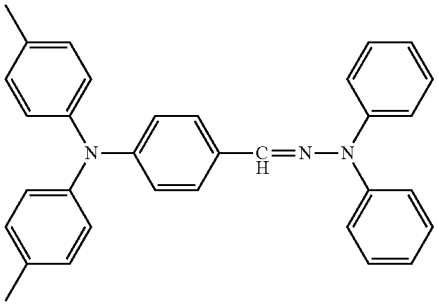

(705)

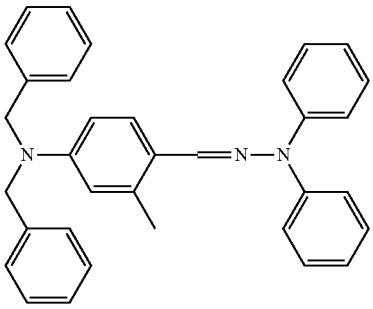

(706)

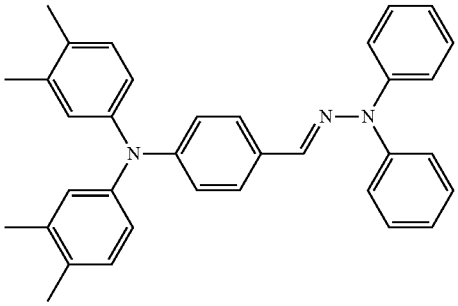

Process Cartridge and Electrophotographic Apparatus

FIG. 1 illustrates an example of a schematic structure of an electrophotographic apparatus installed with a process cartridge that incorporates an electrophotographic photosensitive member according to an aspect of the invention.

A cylindrical (drum-shaped) electrophotographic photosensitive member 1 is driven to rotate around a shaft in the direction of the arrow at a predetermined circumferential velocity (process speed). During rotation, the surface of the electrophotographic photosensitive member 1 is charged to a predetermined positive or negative potential by a charging unit 3. The charged surface of the electrophotographic photosensitive member 1 is then irradiated with exposure light 4 emitted from an exposure unit (not illustrated). This produces an electrostatic latent image corresponding to the intended image information. The exposure light 4 is, for example, light emitted from an image exposure unit, such as a slit exposure or laser scanning exposure unit, and intensity-modulated according to the time-sequence electric digital pixel signal of the intended image information.

The electrostatic latent image formed on the surface of the electrophotographic photosensitive member 1 is then developed (normal development or reversal development) using toner contained in a development unit 5. This produces a toner image on the surface of the electrophotographic photosensitive member 1. The toner image formed on the surface of the electrophotographic photosensitive member 1 is transferred to a transfer medium 7 by a transfer unit 6. To the transfer unit 6, a bias power supply (not illustrated) applies a bias voltage having the opposite polarity with respect to the charge the toner has. When the transfer medium 7 is paper, the transfer medium 7 is discharged from a feeding section (not Illustrated) in synchronization with the rotation of the electrophotographic photosensitive member 1 and fed into the space between the electrophotographic photosensitive member 1 and the transfer unit 6.

The transfer medium 7 carrying the toner image transferred from the electrophotographic photosensitive member 1 is separated from the surface of the electrophotographic photosensitive member 1 and conveyed to a fixing unit 8, at which the toner image is fixed. As a result, an image-bearing, article (a photographic print or copy) is printed out of the electrophotographic apparatus.

The surface of the electrophotographic photosensitive member 1 following transferring the toner image to the transfer medium 7 is cleaned by a cleaning unit 9 to remove any adhering substance, such as toner (residual toner). It is also possible to collect any residual toner directly with the development element or any other component, thanks to the advent of clearnerless systems in recent years. The surface of the electrophotographic photosensitive member 1 is again used to form the image after the charge is removed through irradiation with pre-exposure light 10 emitted from a pre-exposure unit (not illustrated). When the charging unit 3 is a contact charging unit, i.e., a roller-based or similar charging unit, the pre-exposure unit may be unnecessary.

In an embodiment of the invention, two or more of these structural elements including the electrophotographic photosensitive member 1, the charging unit 3, the development unit 5, and the cleaning unit 9 may be integrally held in a container to form a process cartridge. This process cartridge may be configured to be detachably attached to the main body of an electrophotographic apparatus. For example, at least one selected from the charging unit 3, the development unit 5, the transfer unit 6, and the cleaning unit 9 and the electrophotographic photosensitive member 1 are integrally held and assembled into a cartridge, forming a process cartridge 11 that can be detachably attached to the main body of an electrophotographic apparatus using a guiding unit 12, such as rails, on the main body of the electrophotographic apparatus.

When the electrophotographic apparatus is a photocopier or a printing machine, the exposure light 4 may be a light reflected from or transmitted through the original document, and can also be a light emitted as a result of scanning with a laser beam, driving of an LED array or liquid crystal shutter array, or similar processes performed according to a signal obtained by scanning the original document with a sensor and converting it into a digital image.

The electrophotographic photosensitive member 1 according to an embodiment of the invention also has a wide range of applications in the field of applied electrophotography, including laser beam printers, CRT printers, LED printers, fax machines, liquid-crystal printers, and laser platemaking.

EXAMPLES

The following describes certain aspects of the invention in further detail using examples and comparative examples. No aspect of the invention is limited to these examples while within the scope of the invention. The term. "parts" in the following examples and comparative examples is based on mass unless otherwise specified.

Synthesis of Polycarbonate Resins

Polycarbonate resins were synthesized as follows. Table 13 summarizes the proportions (mol %) of the individual structural units and the weight-average molecular weight.

Polycarbonate Synthesis Example 1

The following materials were dissolved in 1100 ml of a 5% by mass aqueous solution of sodium hydroxide: 53.0 g (0.196 mol) of 2,2-bis(4-hydroxyphenyl)-4-methyl pentane (BPMP; Tokyo Chemical Industry, product code D3267), 41.2 g (0.204 mol) of bis(4-hydroxyphenyl)ether (DHPE; Tokyo Chemical Industry, product code D2121), and 0.1 g of hydrosuffite. After the addition of 500 ml of methylene chloride, 60 g of phosgene was blown into the solution over 60 minutes with stirring, with the temperature maintained at 15° C.

The reaction solution into which the phosgene had been blown was stirred with 1.3 g of p-t-butylphenol (PTBP; Tokyo Chemical Industry, product code B0383) as a molecular-weight modifier until emulsification. The resulting emulsion was stirred at 23° C. for 1 hour with 0.4 ml of triethylamine for polymerization.

After the completion of polymerization, the reaction solution was separated into aqueous and organic phases. The organic phase was neutralized with phosphoric acid and then repeatedly washed with water until the conductivity of the washing (aqueous phase) was 10 μS/cm or less. The resulting solution of polymer was added dropwise into warm water kept at 45° C., and the solvent was evaporated away. This yielded a white powdery precipitate. This precipitate was collected through filtration and dried at 110° C. for 24 hours. This yielded a polycarbonate resin (PC-1) having the structural units according to formulae (A-101) and (B-101).

The molecular weight of this polycarbonate resin as measured by GPC was Mw=63000. The obtained polycarbonate resin was also analyzed using infrared absorption spectroscopy, and the spectrum had a carbonyl absorption at around 1770 $cm^{-1}$ an ether absorption at around 1240 $cm^{-1}$, identifying the product to be a polycarbonate resin.

Polycarbonate Synthesis Example 2

A polycarbonate resin was synthesized in the same way as in polycarbonate synthesis example 1, except that the amount of the molecular-weight modifier PTBP was 1.0 g. This yielded a polycarbonate resin with Mw=78000 (PC-2).

Polycarbonate Synthesis Example 3

A polycarbonate resin was synthesized in the same way as in polycarbonate synthesis example 1, except that the amount of the molecular-weight modifier PTBP was 1.7 g. This yielded a polycarbonate resin with Mw=50000 (PC-3).

Polycarbonate Synthesis Example 4

A polycarbonate resin was synthesized in the same way as in polycarbonate synthesis example 1, except that the amount of the molecular-weight modifier PTBP was 1.1 g. This yielded a polycarbonate resin with Mw 72000 (PC-4).

Polycarbonate Synthesis Example 5

A polycarbonate resin was synthesized in the same way as in polycarbonate synthesis example 1, except that the amount of the molecular-weight modifier PTBP was 2.7 g. This yielded a polycarbonate resin with Mw=34000 (PC-5).

Polycarbonate Synthesis Example 6

A polycarbonate resin was synthesized in the same way as in polycarbonate synthesis example 1, except that the amount of the molecular-weight modifier PTBP was 0.8 g. This yielded a polycarbonate resin with Mw=94000 (PC-6).

Polycarbonate Synthesis Example 7

A polycarbonate resin was synthesized in the same way as in polycarbonate synthesis example 1, except that the amounts of BPMP, DHPE, and the molecular-weight modifier PTBP were 43.3 g, 48.5 g, and 1.4 g, respective. This yielded a polycarbonate resin with Mw=59000 (PC-7).

Polycarbonate Synthesis Example 8

A polycarbonate resin was synthesized in the same way as in polycarbonate synthesis example 1, except that the amounts of BPMP, DHPE, and the molecular-weight modifier PTBP were 27.0 g, 60.6 g, and 1.6 g, respectively. This yielded a polycarbonate resin with Mw=53000 (PC-8)

Polycarbonate Synthesis Example 9

A polycarbonate resin was synthesized in the same way as in polycarbonate synthesis example 1, except that the amounts of BPMP, DHPE, and the molecular-weight modifier PTBP were 21.6 g, 64.7 g, and 1.6 g, respectively. This yielded a polycarbonate resin with Mw=52000 (PC-9).

Polycarbonate Synthesis Example 10

A polycarbonate resin was synthesized in the same way as in polycarbonate synthesis example 1, except that the amounts of BPMP, DHPE, and the molecular-weight modifier PTBP were 75.7 g, 24.3 g, and 1.0 g, respectively. This yielded a polycarbonate resin with Mw=79000 (PC-10).

Polycarbonate Synthesis Example 11

A polycarbonate resin was synthesized in the same way as in polycarbonate synthesis example 1, except that. DHPE was changed to 38.0 g of 4,4'-dihydroxybiphenyl (Tokyo Chemical Industry, product code B0464). This yielded a polycarbonate resin with Mw=60000 (PC-11). This polycarbonate resin has the structural units according to formulae (A-101) and (B-201).

Polycarbonate Synthesis Example 12

A polycarbonate resin was synthesized in the same way as in polycarbonate synthesis example 11, except that the amount of the molecular-weight modifier PTBP was 1.0 g. This yielded a polycarbonate resin with Mw=75000 (PC-12).

Polycarbonate Synthesis Example 13

A polycarbonate resin was synthesized in the same way as in polycarbonate synthesis example 11, except that the amount of the molecular-weight modifier PTBP was 1.6 g. This yielded a polycarbonate resin with Mw=50000 (PC-13).

Polycarbonate Synthesis Example 14

A polycarbonate resin was synthesized in the same way as in polycarbonate synthesis example 11, except that the amount of the molecular-weight modifier PTBP was 1.1 g. This yielded a polycarbonate resin with Mw=69000 (PC-14).

Polycarbonate Synthesis Example 15

A polycarbonate resin was synthesized in the same way as in polycarbonate synthesis example 11, except that the amount of the molecular-weight modifier PTBP was 2.7 g This yielded a polycarbonate resin with Mw=33000 (PC-15).

Polycarbonate Synthesis Example 16

A polycarbonate resin was synthesized in the same way as in polycarbonate synthesis example 11, except that the amount of the molecular-weight modifier PTBP was 0.8 g. This yielded a polycarbonate resin with Mw=91000 (PC-16).

Polycarbonate Synthesis Example 17

A polycarbonate resin was synthesized in the same way as in polycarbonate synthesis example 11, except that the amounts of BPMP, 4,4T-dihydroxybiphenyl, and the molecular-weight modifier PTBP were 43.3 g, 44.7 g, and 1.2 g, respectively. This yielded a polycarbonate resin with Mw=65000 (PC-17).

Polycarbonate Synthesis Example 18

A polycarbonate resin was synthesized in the same way as in polycarbonate synthesis example 11, except that the amounts of BPMP, 4,4T-dihydroxybiphenyl, and the molecular-weight modifier PTBP were 27.0 g, 55.9 g, and 1.5 g, respectively. This yielded a polycarbonate resin with Mw=54000 (PC-18).

Polycarbonate Synthesis Example 19

A polycarbonate resin was synthesized in the same way as in polycarbonate synthesis example 11, except that the amounts of BPMP, 4,4'-dihydroxybiphenyl, and the molecular-weight modifier PTBP were 21.6 g, 59.7 g, and 1.6 g, respectively. This yielded a polycarbonate resin with Mw=50000 (PC-19).

Polycarbonate Synthesis Example 20

A polycarbonate resin was synthesized in the same way as in polycarbonate synthesis example 11, except that the amounts of BPMP, 4,4'-dihydroxybiphenyl, and the molecular-weight modifier PTBP were 75.7 g, 22.4 g, and 1.0 g, respectively. This yielded a polycarbonate resin with Mw=75000 (PC-20).

Polycarbonate Synthesis Example 21

A polycarbonate resin was synthesized in the same way as in polycarbonate synthesis example 1, except that DHPE was changed to 52.3 g of 2,2-bis(3-methyl-4-hydroxyphenyl)propane (BPC; Honshu Chemical Industry). This yielded a polycarbonate resin with Mw=64000 (PC-21). This polycarbonate resin has the structural units according to formulae (A-101) and (B-307).

Polycarbonate Synthesis Example 22

A polycarbonate resin was synthesized in the same way as in polycarbonate synthesis example 21, except that the amount of the molecular-weight modifier PTBP was 1.0 g. This yielded a polycarbonate resin with Mw=80000 (PC-22).

Polycarbonate Synthesis Example 23

A polycarbonate resin was synthesized in the same way as in polycarbonate synthesis example 21, except that the amount of the molecular-weight modifier PTBP was 1.6 g. This yielded a polycarbonate resin with Mw=54000 (PC-23).

Polycarbonate Synthesis Example 24

A polycarbonate resin was synthesized in the same way as in polycarbonate synthesis example 21, except that the amount of the molecular-weight modifier PTBP was 1.1 g. This yielded a polycarbonate resin with Mw=74000 (PC-24).

Polycarbonate Synthesis Example 25

A polycarbonate resin was synthesized in the same way as in polycarbonate synthesis example 21, except that the amount of the molecular-weight modifier PTBP was 2 7 g. This yielded a polycarbonate resin with Mw=35000 (PC-25).

Polycarbonate Synthesis Example 26

A polycarbonate resin was synthesized in the same way as in polycarbonate synthesis example 21, except that the amount of the molecular-weight modifier PTBP was 0.8 g. This yielded a polycarbonate resin with Mw=96000 (PC-26).

Polycarbonate Synthesis Example 27

A polycarbonate resin was synthesized in the same way as in polycarbonate synthesis example 21, except that the amounts of BPMP, BPC, and the molecular-weight modifier PTBP were 43.3 g, 61.5 g, and 1.2 g, respectively. This yielded a polycarbonate resin with Mw=69000 (PC-27).

Polycarbonate Synthesis Example 28

A polycarbonate resin was synthesized in the same way as in polycarbonate synthesis example 21, except that the amounts of PPMP, BPC, and the molecular-weight modifier PTBP were 27.0 g, 76.9 g, and 1.5 g, respectively. This yielded a polycarbonate resin with MW=57000 (PC-28).

Polycarbonate Synthesis Example 29

A polycarbonate resin was synthesized in the same way as in polycarbonate synthesis example 21, except that the amounts of PPMP, BPC, and the molecular-weight modifier PTBP were 21.6 g, 82.0 g, and 1.6 g, respectively. This yielded a polycarbonate resin with MW=54000 (PC29).

Polycarbonate Synthesis Example 30

A polycarbonate resin was synthesized in the same way as in polycarbonate synthesis example 21, except that the amounts of BPMP, BPC, and the molecular-weight modifier PTBP were 75.7 g, 30.8 g, and 1.0 g, respectively. This yielded a polycarbonate resin with Mw=80000 (PC-30).

Polycarbonate Synthesis Example 31

A polycarbonate resin was synthesized in the same way as in polycarbonate synthesis example 1, except that BPMP was changed to 55.7 c of 2,2-bis(4-hydroxyphenyl)5-methylhexane derived from 5-methyl-2-hexanone (Tokyo Chemical Industry, product code 10087). This yielded a polycarbonate resin with Mw=66000 (PC-31). This polycarbonate resin has the structural units according to formulae (A-102) and (B-101).

Polycarbonate Synthesis Example 32

A polycarbonate resin was synthesized in the same way as in polycarbonate synthesis example 1, except that BPMP was changed to 57.31 g of 3,3-bis(4-hydroxyphenyl)5-methylheptane derived from 5-methyl-3-heptanone (Tokyo Chemical Industry, product code M0335). This yielded a polycarbonate resin with Mw=68000 (PC-32). This polycarbonate resin has the structural units according to formulae (A-201) and (B-101).

Polycarbonate Synthesis Example 33

A polycarbonate resin was synthesized in the same way as in polycarbonate synthesis example 1, except that BPMP was changed to 65.2 g of 1,1-bis(4-hydroxyphenyl)-1-phenyl-3-methylbutane derived from isobutyl phenyl ketone (Tokyo Chemical Industry, product code 10296). This yielded a polycarbonate resin with Mw=77000 (PC-33). This polycarbonate resin has the structural units according to formulae (A-103) and (B-101).

Comparative Polycarbonate Synthesis Example 1

A polycarbonate resin was synthesized in the same way as in polycarbonate synthesis example 1, except that BPMP was changed to 56.9 g of 1,1-bis(4-hydroxyphenyl)-1-phenylethane (Honshu Chemical Industry). This yielded a polycarbonate resin with. Mw=65000 (PC-34). This polycarbonate resin has the structural unit represented by the formula below (comparative structure) and the structural unit according to formula (B-101).

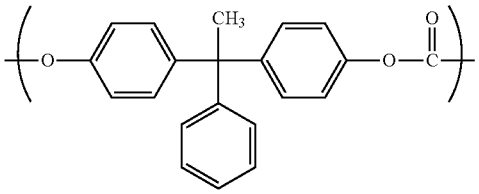

Comparative Polycarbonate Synthesis Example 2

A polycarbonate resin was synthesized in the same way as in polycarbonate synthesis example 1, except that BPMP was not used and the amount of DHPE was 80.8 g. This yielded a polycarbonate resin (PC-35). This polycarbonate resin has the structural unit according to formula (B-101).

TABLE 13

Characteristics of polycarbonate resins

| Polycarbonate resin No. | Group A proportion (mol %) | Group B proportion (mol %) | Weight-average molecular weight Mw |
|---|---|---|---|
| PC-1 | 49 | 51 | 63000 |
| PC-2 | 49 | 51 | 78000 |
| PC-3 | 49 | 51 | 50000 |
| PC-4 | 49 | 51 | 72000 |
| PC-5 | 49 | 51 | 34000 |
| PC-6 | 49 | 51 | 94000 |
| PC-7 | 40 | 60 | 59000 |
| PC-8 | 25 | 75 | 53000 |
| PC-9 | 20 | 80 | 52000 |
| PC-10 | 70 | 30 | 79000 |
| PC-11 | 49 | 51 | 60000 |
| PC-12 | 49 | 51 | 75000 |
| PC-13 | 49 | 51 | 50000 |
| PC-14 | 49 | 51 | 69000 |
| PC-15 | 49 | 51 | 33000 |
| PC-16 | 49 | 51 | 91000 |
| PC-17 | 40 | 60 | 65000 |
| PC-18 | 25 | 75 | 54000 |
| PC-19 | 20 | 80 | 50000 |
| PC-20 | 70 | 30 | 75000 |
| PC-21 | 49 | 51 | 64000 |
| PC-22 | 49 | 51 | 80000 |
| PC-23 | 49 | 51 | 54000 |
| PC-24 | 49 | 51 | 74000 |
| PC-25 | 49 | 51 | 35000 |
| PC-26 | 49 | 51 | 96000 |
| PC-27 | 40 | 60 | 69000 |
| PC-28 | 25 | 75 | 57000 |
| PC-29 | 20 | 80 | 54000 |
| PC-30 | 70 | 30 | 80000 |
| PC-31 | 49 | 51 | 66000 |
| PC-32 | 49 | 51 | 68000 |
| PC-33 | 49 | 51 | 77000 |
| PC-34 | 49 | 51 | 65000 |
| PC-35 | 0 | 100 | 63000 |

Synthesis of Crystal Line Gallium Phthalocyanines

Crystalline gallium phthalocyanines for use as charge generation materials were synthesized as follows. Synthesis of hydroxygallium phthalocyanine Ga-0

Under a nitrogen flow in a reactor, 5.46 parts of phthalonitrile and 45 parts of α-chloronaphthalene were heated to 30° C. and maintained at this temperature. At the same temperature (30° C.), 3.75 parts of gallium trichloride was added. The water content of the liquid mixture at the addition of gallium trichloride was 150 ppm. The temperature was then increased to 200° C. The mixture was allowed to react at a temperature of 200° C. for 4.5 hours under a nitrogen flow and then cooled. When the temperature reached. 150° C., the mixture containing the product was filtered. The residue was washed through dispersion in N,N-dimethylformamide at a temperature of 140° C. for 2 hours, and the obtained liquid dispersion was filtered. The residue was washed with ethanol and dried. This yielded. 4.65 parts (71% yield) of chlorogallium phthalocyanine (C1Ga).

The obtained. ClGa, 4.65 parts, was dissolved in 139.5 parts of concentrated sulfuric acid at a temperature of 10° C. The resulting solution was added dropwise to 620 parts of iced water for reprecipitation, and the resulting mixture was filtered using a filter press. The obtained wet cake (residue) was washed through dispersion in 2% aqueous ammonia, and the resulting liquid dispersion was filtered using a filter press. The obtained wet cake (residue) was then purified through three cycles of dispersion and washing in ion-exchanged water and filtration using a filter press, yielding a hydroxygallium phthalocyanine pigment with a solids content of 23% (wet hydroxygallium phthalocyanine pigment).

Then 6.6 kg of the obtained hydroxygallium phthalocyanine pigment (wet hydroxygallium phthalocyanine pigment) was dried using HYPER-DRY HD-06R drying oven (Biocon (Japan); frequency (oscillation frequency), 2455 MHz±15 MHz) as follows.

A cake of the hydroxygallium phthalocyanine pigment freshly removed from the filter press (the thickness of the wet cake being 4 cm or less) was placed on a dedicated round plastic tray. The far-infrared radiation was off, and the temperature setting for the inner wall of the drying oven was 50° C. During the microwave irradiation, the vacuum pump and the leak valve were adjusted to keep the degree of vacuum in the range of 4.0 to 10.0 kPa.

In step 1, the hydroxygallium phthalocyanine pigment was irradiated with microwaves of 4.8 kW for 50 minutes. The microwaves were then turned off, and the leak valve was closed to make a high degree of vacuum of 2 kPa or less. The solids content of the hydroxygallium phthalocyanine pigment at this point was 88%. In step 2, OF the leak valve was adjusted to make the degree of vacuum (pressure in the drying oven) fall within the above parameter range (4.0 to 10.0 kPa). Then the hydroxygallium phthalocyanine pigment was irradiated with microwaves of 1.2 kW for 5 minutes. The microwaves were turned off, and the leak valve was closed to make a high degree of vacuum of 2 kPa or less. Step 2 was repeated once more (a total of twice). The solids content of the hydroxygallium phthalocyanine pigment at this point was 98%. In step 3, microwave irradiation was performed in the same way as in step 2 except that the microwave output power was changed from 1.2 kW to 0.8 kW. Step 3 was repeated once more (a total of twice). In step 4, the leak valve was adjusted to make the degree of vacuum (pressure in the drying oven) fall within the above parameter range (4.0 to 10.0 kPa) again. Then the hydroxygallium phthalocyanine pigment was irradiated with microwaves of 0.4 kW for 3 minutes. The microwaves were turned off, and the leak valve was closed to make a high degree of vacuum of 2 kPa or less. Step 4 was repeated seven more times (a total of eight times). This yielded 1.52 kg of a hydroxygallium phthalocyanine pigment (Ga-0) containing 1% or less water, taking a total of 3 hours.

Synthesis of Crystalline Gallium Phthalocyanine Ga-1

Figure 2:
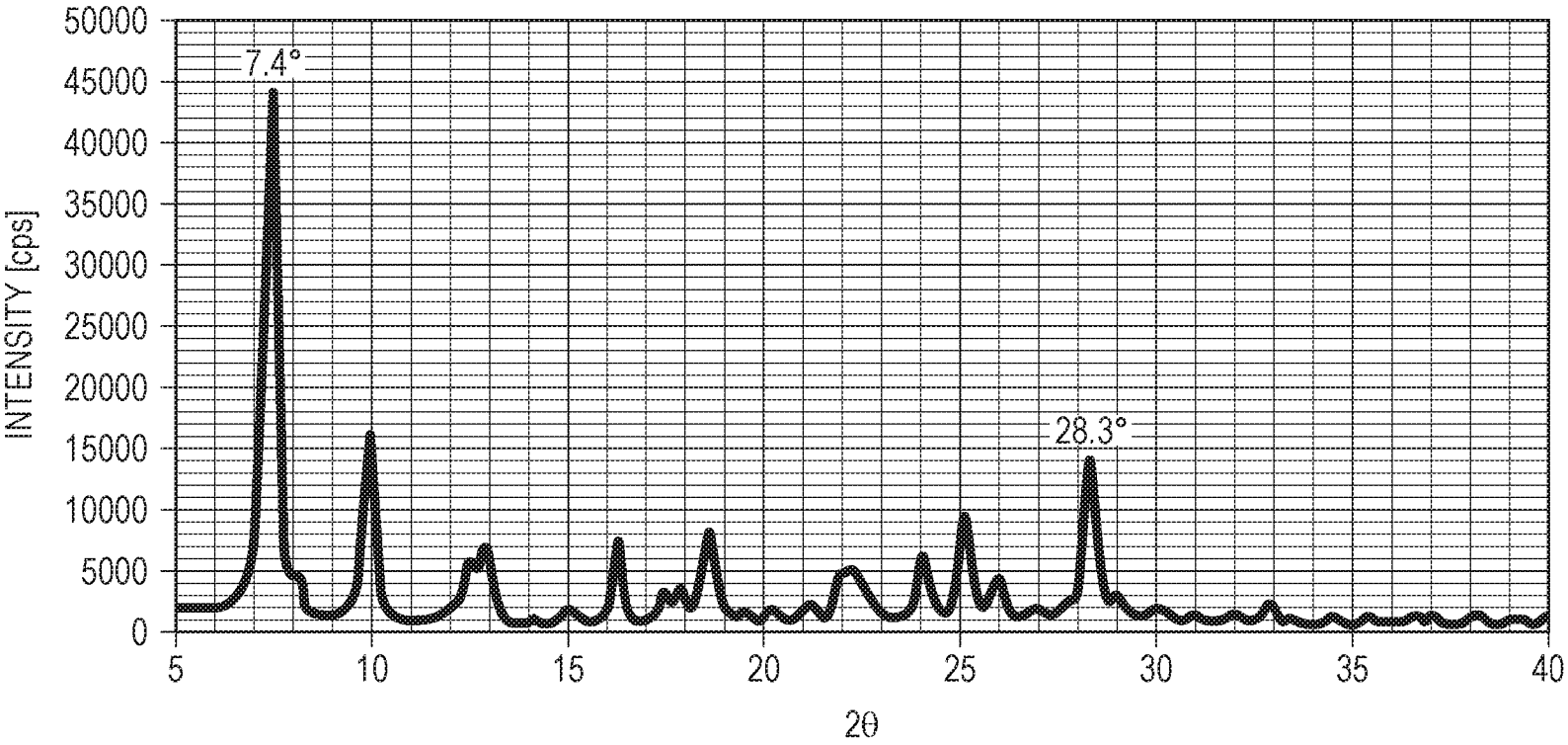
FIG. 2 is a powder X-ray diffraction pattern of a crystalline hydroxygallium phthalocyanine used in Examples.

In a ball mill, 0.5 parts of the obtained hydroxygallium phthalocyanine Ga-0 and 10 parts of N-methylformamide were milled with 20 parts of 0.8-mm diameter glass beads at room temperature (23° C.) and 120 rpm for 300 hours. Crystalline gallium phthalocyanine removed from this liquid dispersion using N,N-dimethylformamide was collected through filtration, and the surface of the filter was thoroughly washed with tetrahydrofuran. The residue was dried in vacuum, yielding 0.45 parts of crystalline hydroxygallium phthalocyanine Ga-1. FIG. 2 is a powder X-ray diffraction pattern of the obtained crystals.

$^{1}$H-NMR spectroscopy was performed using deuterated sulfuric acid as solvent [on AVANCE III 500 spectrometer (Bruker)], confirming that crystals of Ga-1 contained 0.9% by mass N-methylformamide.

Synthesis of Crystalline Gallium Phthalocyanine Ga-2

Crystalline gallium phthalocyanine was synthesized in the same way as in the synthesis of crystalline gallium phthalocyanine Ga-1, except that parts of N-methylformamide was changed to 10 parts of N,N-dimethylformamide and the duration of milling was changed from 300 hours to 400 hours. This yielded 0.40 parts of crystalline hydroxygallium phthalocyanine Ga-2. The powder X-ray diffraction pattern of Ga-2 was similar to that in FIG. 2. NMR measurement demonstrated that crystals of Ga-2 contained 1.4% by mass N,N-dimethylformamide, as determined from the relative abundance of protons.

Synthesis of Crystalline Gallium Phthalocyanine Ga-3

Crystalline gallium phthalocyanine was synthesized in the same way as in the synthesis of crystalline gallium phthalocyanine Ga-1, except that 10 parts of N-methylformamide was changed to 10 parts of N,N-propylformamide and the duration of milling was changed from 300 hours to 500 hours. This yielded 0.40 parts of crystalline hydroxygallium phthalocyanine Ga-3. The powder X-ray diffraction pattern of Ga-3 was similar to that in FIG. 2. NMR measurement demonstrated that crystals of Ga-3 contained 1.4% by mass N-propylformamide, as determined from the relative abundance of protons.

Synthesis of Crystalline Gallium Phthalocyanine Ga-4

Crystalline gallium phthalocyanine was synthesized in the same way as in the synthesis of crystalline gallium phthalocyanine Ga-1, except that 10 parts of N-methylformamide was changed to 10 parts of N,N-vinylformamide and the duration of milling was changed from 300 hours to 100 hours. This yielded 0.40 parts of crystalline hydroxygallium phthalocyanine Ga-4. The powder X-ray diffraction pattern of Ga-4 was similar to that in FIG. 2. NMR measurement demonstrated that crystals of Ga--4 contained 1.8% by mass N-vinylformamide, as determined from the relative abundance of protons.

Synthesis of Crystalline Gallium Phthalocyanine Ga-5

Figure 3:
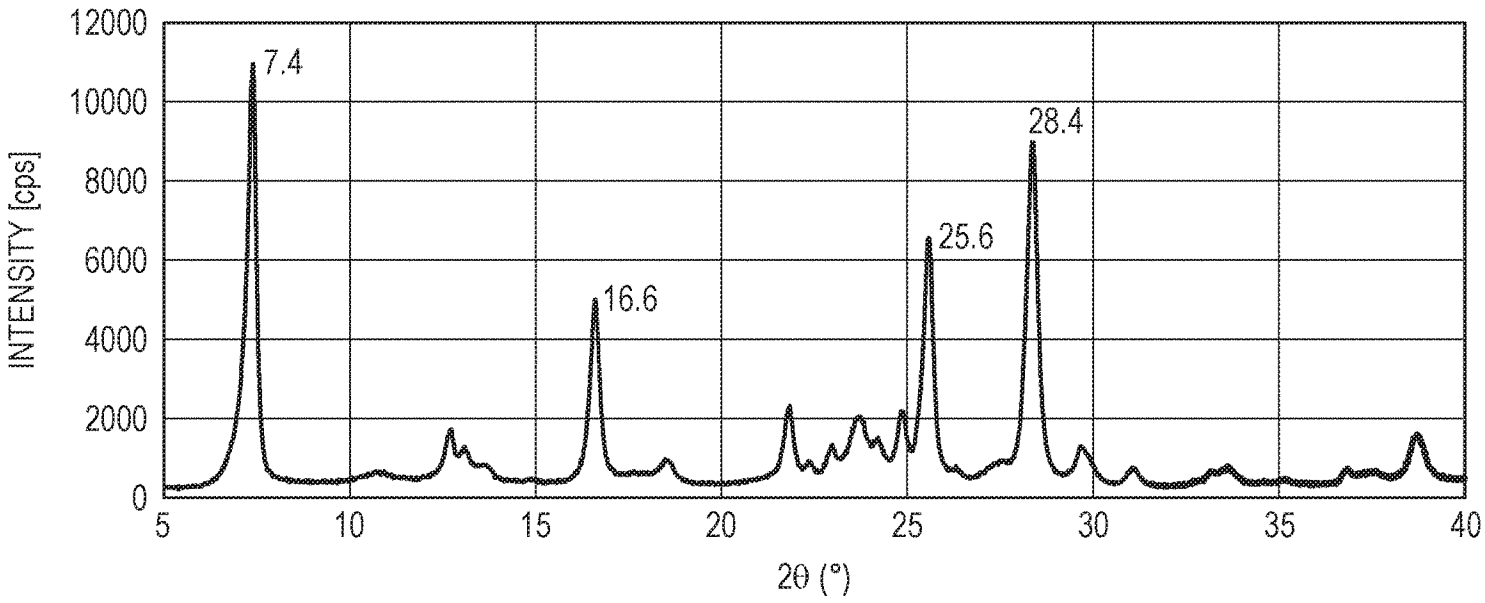
FIG. 3 is a powder X-ray diffraction pattern of a crystalline chlorogallium phthalocyanine used in Examples.

In a ball mill, 0.5 parts of the chlorogallium phthalocyanine (ClGa) obtained above was dry-milled with 20 parts of 0.8-mm diameter glass beads at room temperature (23° C.) for 40 hours. Ten parts of N,N-dimethylformamide was added, and wet-milling was performed at room temperature (23° C.) for 100 hours. Crystalline gallium phthalocyanine removed from this liquid dispersion using N,N-dimethylformamide was collected through filtration, and the surface of the filter was thoroughly washed with tetrahydrofuran. The residue was dried in vacuum, yielding 0.44 parts of crystalline chlorogallium phthalocyanine Ga-S. FIG. 3 is a powder X-ray diffraction pattern of the obtained crystals.

$^{-}$H-NMR spectroscopy was performed using deuterated sulfuric acid as solvent [on AVANCE III 500 spectrometer (Bruker)], confirming that crystals of Ga-5 contained 1.0% by mass N,N-dimethylformamide.

Synthesis of Crystalline Gallium Phthalocyanine Ga-6

Crystalline gallium phthalocyanine was synthesized in the same way as in the synthesis of crystalline gallium phthalocyanine Ga-2, except that the duration of milling was changed from 400 hours to 48 hours. This yielded 0.46 parts of crystalline hydroxygallium phthalocyanine Ga-6. NMR measurement demonstrated that crystals of Ga-6 contained 2.1% by mass N,N-dimethylformamide, as determined from the relative abundance of protons.

Synthesis of Crystalline Gallium Phthalocyanine Ga-7

Figure 4:
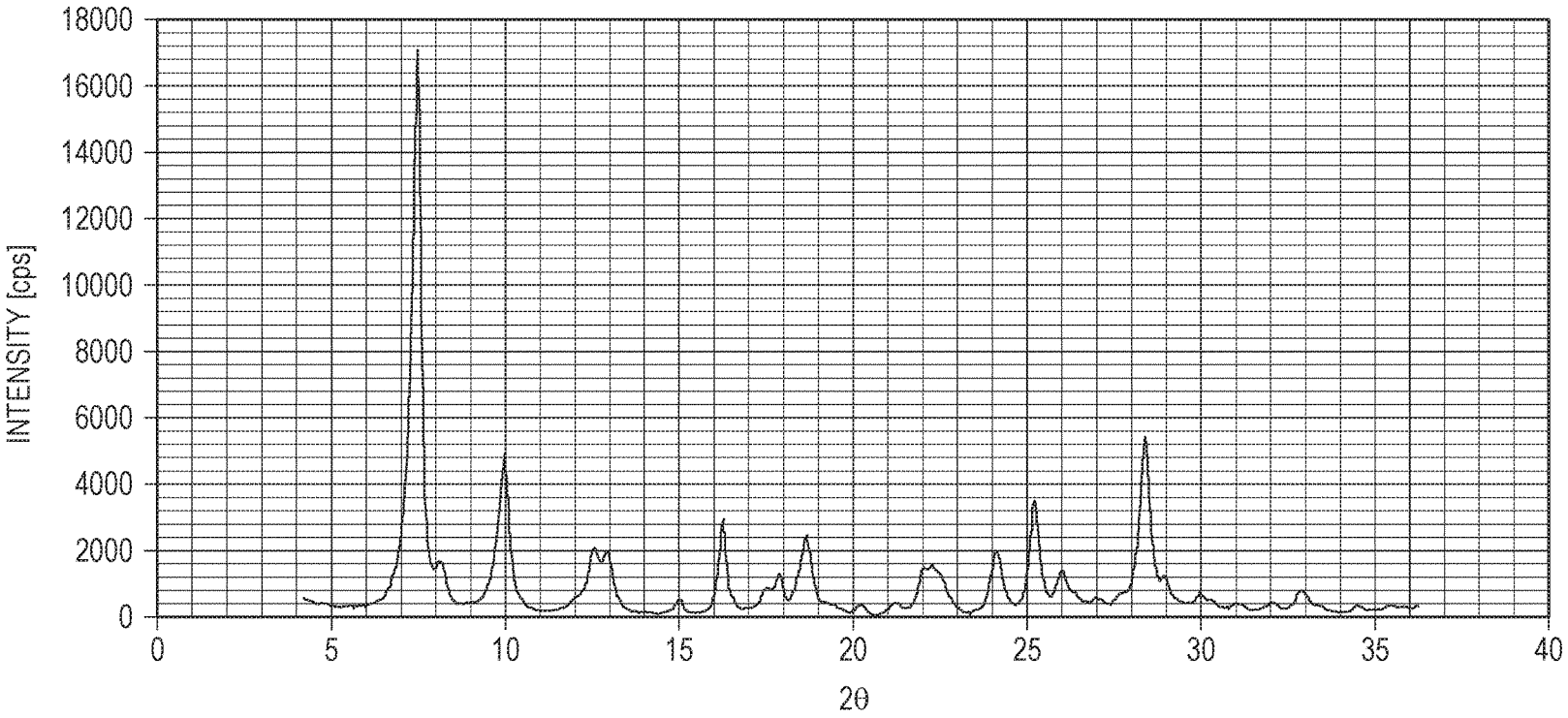
FIG. 4 is a powder X-ray diffraction pattern of a crystalline hydroxygallium phthalocyanine used in Examples.
Figure 5:
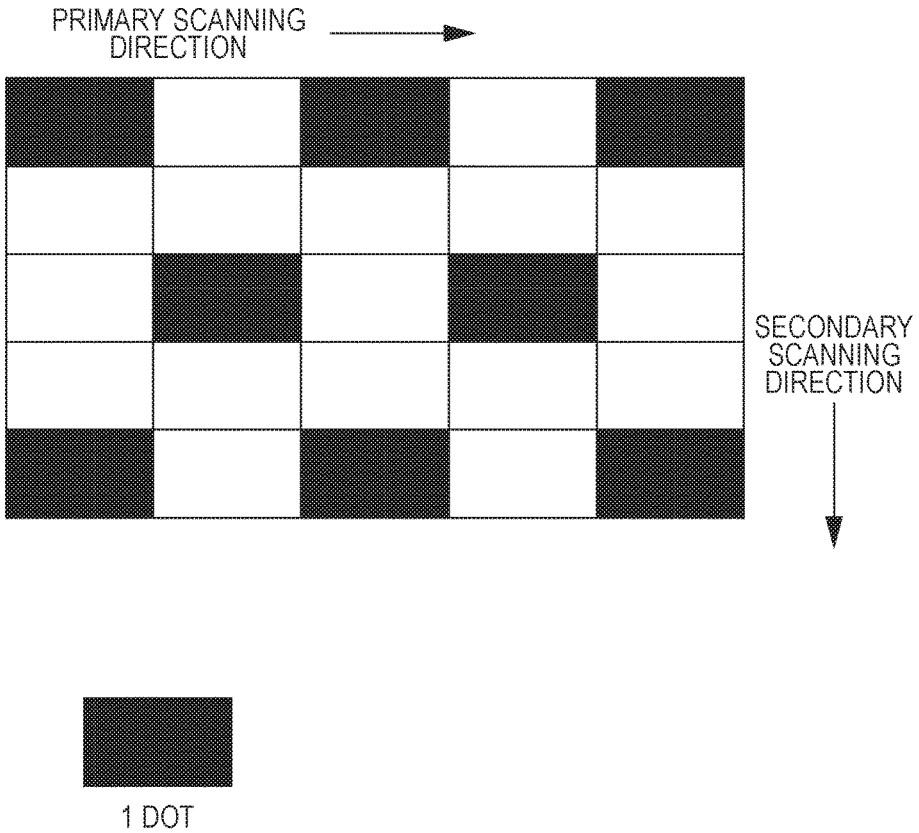
FIG. 5 is a diagram for describing a 1-dot "knight move in chess" pattern image.

Crystalline hydroxygsallium phthalocyanine was synthesized in the same way as in the synthesis of crystalline gallium phthalocyanine Ga-1, except that 10 parts of N-methylformamide was changed to 10 parts of N,N-dimethylformamide and the duration of milling was changed from 300 hours to 100 hours. This yielded 0.40 parts of crystalline hydroxygallium phthalocyanine Ga-7. FIG. 4 is a powder X-ray diffraction pattern of the obtained crystals. NMR measurement demonstrated that crystals of Ga-7 contained 2.2% by mass N,N-dimethylformamide, as determined from the relative abundance of protons.

Production of Electrophotographic Photosensitive Members

In the following, the thickness of the individual layers of the electrophotographic photosensitive members is a measured value obtained using Fischerscope eddy-current coating thickness gauge (Fischer Instruments) or a calculated result based on the mass per unit area and the specific gravity.

Examples 1-1 to 1-37 and Comparative Examples 1-1 to 1-3 Example 1-1

A solution composed of the following materials was subjected to 20 hours of dispersion in a ball mill: 60 parts of barium sulfate particles coated with tin oxide (trade name, Passtran PC1; Mitsui Mining & Smelting), 15 parts of titanium oxide particles (trade name, TITANIX JR; Tayca Corporation), 43 parts of resol-type phenolic resin (trade name, PHENOLITE J-325; DIC Corporation; solids content, 70% by mass), 0.015 parts of silicone oil (trade name, SH28PA; Dow Corning Toray), 3.6 parts of silicone resin (trade name, Tospearl 120; Toshiba Silicones), 50 parts of 1-methoxy-2-propanol, and 50 parts of methanol. In this way, a coating liquid for the formation of a conductive layer was prepared.

This coating liquid for the formation of a conductive layer was applied to an aluminum cylinder 261.5 mm long and 24 mm in diameter (JIS-A3003 aluminum alloy) for use as support by dip coating, and the obtained wet coating was dried at 140° C. for 30 minutes. In this way, a 15-μm thick conductive layer was formed.

Then 10 parts of copolymeric nylon resin (trade name, AMILAN CM8000; Toray) and 30 parts of methoxymethylated nylon 6 resin (trade name, Toresin EF-30T; Teikoku Kagaku Sangyo KK.) were dissolved in a solvent mixture of 400 parts of methanol and 200 parts of n-butanol, producing a coating Liquid for the formation of an undercoat layer. This coating liquid for the formation of an undercoat layer was applied to the conductive layer by dip coating, and the obtained wet coating was dried. In this way, a 0.7-μm thick undercoat layer (UCL-1) was formed.

Then 10 parts of crystalline gallium phthalocyanine Ga-1 (charge generation material), 5 parts of polyvinyl butyral resin (trade name, S-LEC BX-1; Sekisui Chemical), and 250 parts of cyclohexanone were subjected to 6 hours of dispersion in a sand mill with 1.0-mm diameter glass beads. This liquid dispersion was diluted with 250 parts of ethyl acetate, producing a coating liquid for the formation of a charge generation layer. This coating liquid for the formation of a charge generation layer was applied to the undercoat layer by dip coating, and the obtained wet coating was dried at 100° C. for 10 minutes. In this way, a 0.22-μm thick charge generation layer was formed.

Then 10 parts of polycarbonate resin PC-1 and 9 parts of a mixture of the compounds according to formula (102) and the formula below as charge transport materials (in a 6:3 mixing ratio) were dissolved in 70 parts of o-xylene (Xy) and 20 parts of dimethoxymethane (DMM), producing a coating liquid for the formation of a charge transport layer. This coating liquid for the formation of a charge transport layer was applied to the charge generation layer by dip coating, and the obtained wet coating was dried at 125° C. for 1 hour. In this way, a 15.5-μm thick charge transport layer was formed.

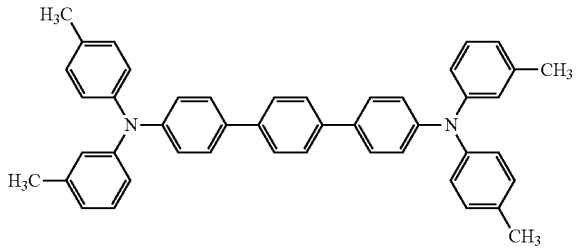

Examples 1-2 to 1-37 and Comparative Examples 1-1 to 1-3

Electrophotographic photosensitive members were produced, with changes made to the foregoing process (Example 1-1) in accordance with Table 14 in terms of the following conditions: the kind of charge generation material in the charge generation layer; the kind of resin and the kind and amount (parts) of solvent in the charge transport layer. For comparative example 1-3, the following testing of an electrophotographic photosensitive member was impossible because of undissolved solids in the coating liquid for the formation of a charge transport layer. In the table, THE stands for tetrahydrofuran.

Testing

The following test was performed on the produced electrophotographic photosensitive members. The test results are summarized in Table 14.

Effect in the Reduction of Fog

A CP-4525 laser beam printer (Hewlett Packard) was used as test apparatus after modifications to allow for the adjustment of the charging potential (dark-area potential) for the electrophotographic photosensitive member used therewith. The charging potential (dark-area potential) setting was −600 V.

The produced electrophotographic photosensitive members were each installed in a process cartridge (c an) of the test apparatus. A test chart having a 1% image-recorded. area was continuously printed on 30,000 sheets of A4 plain paper under the conditions of a temperature of 23° C. and a relative humidity of 50%, in 3-sheet batches with 6-second pauses between batches.

After this 30,000-sheet durability test, reflectometry was performed using a reflectometer (TC-6DS reflectometer, Tokyo Denshoku co., Ltd.) to determine the worst reflection density within the white background of the image, F1, and the mean baseline reflection density on plain paper, F0. The difference F1-F0 was defined as the fog level with smaller fog levels meaning more effective reduction of fog. In these examples of the invention, grades AA to a in the criteria constituted favorable levels, whereas F and G unacceptable levels.

AA: The fog level was less than 1.0.

A: The fog level was 1.0 or more and less than 1.5.

B: The fog level was 1.5 or more and less than 2.0.

C: The fog level was 2.0 or more and less than 2.5.

D: The fog level was 2.5 or more and less than 3.0.

E. The fog level was 3.0 or more and less than 4.0.

F: The fog level was 4.0 or more and less than 5.0.

G: The fog level was 5.0 or more

TABLE 14

Conditions for the production of electrophotographic photosensitive members and test results

| Example No. | Charge generation layer Charge generation material | Charge transport layer Polycarbonate resin No. | Solvent(s) Type | Solvent(s) Parts | Result Fog reduction |
|---|---|---|---|---|---|
| Example 1-1 | Ga-1 | PC-1 | Xy/DMM | 70/20 | AA |
| Example 1-2 | Ga-1 | PC-2 | Xy/DMM | 70/20 | AA |
| Example 1-3 | Ga-2 | PC-3 | Xy/DMM | 70/20 | A |
| Example 1-4 | Ga-2 | PC-4 | Xy/DMM | 70/20 | A |
| Example 1-5 | Ga-2 | PC-5 | Xy/DMM | 70/20 | B |
| Example 1-6 | Ga-2 | PC-6 | Xy/DMM | 70/20 | B |
| Example 1-7 | Ga-2 | PC-5 | THF | 90 | C |
| Example 1-8 | Ga-2 | PC-1 | THF | 90 | B |
| Example 1-9 | Ga-2 | PC-7 | THF | 90 | B |
| Example 1-10 | Ga-2 | PC-8 | THF | 90 | B |
| Example 1-11 | Ga-2 | PC-9 | THF | 90 | C |
| Example 1-12 | Ga-2 | PC-10 | THF | 90 | C |
| Example 1-13 | Ga-2 | PC-13 | Xy/DMM | 70/20 | B |
| Example 1-14 | Ga-2 | PC-14 | Xy/DMM | 70/20 | B |
| Example 1-15 | Ga-2 | PC-15 | Xy/DMM | 70/20 | C |
| Example 1-16 | Ga-2 | PC-16 | Xy/DMM | 70/20 | C |
| Example 1-17 | Ga-2 | PC-15 | THF | 90 | D |
| Example 1-18 | Ga-2 | PC-11 | THF | 90 | C |
| Example 1-19 | Ga-2 | PC-17 | THF | 90 | C |
| Example 1-20 | Ga-2 | PC-18 | THF | 90 | C |
| Example 1-21 | Ga-2 | PC-19 | THF | 90 | B |
| Example 1-22 | Ga-2 | PC-20 | THF | 90 | B |
| Example 1-23 | Ga-2 | PC-23 | Xy/DMM | 70/20 | C |
| Example 1-24 | Ga-2 | PC-24 | Xy/DMM | 70/20 | C |
| Example 1-25 | Ga-2 | PC-25 | Xy/DMM | 70/20 | D |
| Example 1-26 | Ga-2 | PC-26 | Xy/DMM | 70/20 | D |
| Example 1-27 | Ga-2 | PC-25 | THF | 90 | E |
| Example 1-28 | Ga-2 | PC-21 | THF | 90 | D |
| Example 1-29 | Ga-2 | PC-27 | THF | 90 | D |
| Example 1-30 | Ga-2 | PC-28 | THF | 90 | D |
| Example 1-31 | Ga-2 | PC-29 | THF | 90 | C |
| Example 1-32 | Ga-2 | PC-30 | THF | 90 | C |
| Example 1-33 | Ga-3 | PC-31 | Xy/DMM | 70/20 | AA |
| Example 1-34 | Ga-4 | PC-32 | Xy/DMM | 70/20 | A |
| Example 1-35 | Ga-2 | PC-33 | Xy/DMM | 70/20 | D |
| Example 1-36 | Ga-5 | PC-12 | Xy/DMM | 70/20 | C |
| Example 1-37 | Ga-5 | PC-12 | Xy/DMM | 70/20 | C |
| Comparative Example 1-1 | Ga-6 | PC-34 | Xy/DMM | 70/20 | F |
| Comparative Example 1-2 | Ga-6 | PC-34 | THF | 90 | G |
| Comparative Example 1-3 | Ga-6 | PC-35 | Xy/DMM | 70/20 | — |

Examples 2-1 to 2-287 and Comparative Examples 2-1 to 2-8 Example 2-1

A solution composed of the following materials was subjected to 20 hours of dispersion in a ball mill: 60 parts of barium sulfate particles coated with tin oxide (trade name, Passtran PCI; Mitsui Mining & Smelting), 15 parts of titanium oxide particles (trade name, TITANIX JR; Tayca Corporation), 43 parts of resol-type phenolic resin (trade name, PHENOLITE J-325; DIC Corporation; solids content, 70% by mass), 0.015 parts of silicone oil (trade name, SH28PA; Dow Corning Toray), 3.6 parts of silicone resin (trade name, Tospearl 120; Toshiba Silicones), 50 parts of 1-methoxy-2-propanol, and 50 parts of methanol. In this way, a coating liquid for the formation of a conductive layer was prepared.

This coating liquid for the formation of a conductive layer was applied to an aluminum cylinder 261.5 mm long and 24 mm in diameter (JIS-A3003 aluminum alloy) for use as support by dip coating, and the obtained wet coating was dried at 140° C. for 30 minutes. In this way, a 30-μm thick conductive layer was formed.

Then 10 parts of copolymeric nylon resin (trade name, AMILAN CM8000; Toray) and 30 parts of methoxymethylated nylon 6 resin (trade name, Toresin EF-30T; Teikoku Kagaku Sangyo K.K.) were dissolved in a solvent mixture of 400 parts of methanol and 200 parts of n-butanol, producing a coating liquid for the formation of an undercoat layer. This coating liquid for the formation of an undercoat layer was applied to the conductive layer by dip coating, and the obtained wet coating was dried. In this way, a 0.8-μm thick undercoat layer (UCL-1) was formed.

Then 10 parts of crystalline gallium phthalocyanine Ga-1 (charge generation material), 5 parts of polyvinyl butyral (trade name, S-LEC BX-1; Sekisui Chemical), and 250 parts of cyclohexanone were subjected to 6 hours of dispersion in a sand mill with 1.0-mm diameter glass beads. This liquid dispersion was diluted with 250 parts of ethyl acetate, producing a coating liquid for the formation of a charge generation layer. This coating liquid for the formation of a charge generation layer was applied to the undercoat layer by dip coating, and the obtained wet coating was dried at 100° C. for 10 minutes. In this way, a 0.23-μm thick charge generation layer was formed.

Then 10 parts of exemplified compound 1001 (Mw: 63,000) as polycarbonate resin and 9 parts of a mixture of the compounds according to formulae (1(⁻) and (205) as charge transport materials (in a 9:1 mixing ratio) were dissolved in 70 parts of o-xylene (Xy) and 20 parts of dimethoxymethane (DMM), producing a coating liquid for the formation of a charge transport layer. This coating liquid for the formation of a charge transport layer was applied to the charge generation layer by dip coating, and the obtained wet coating was dried at 125° C. for 1 hour. In this way, a 20-μm thick charge transport layer was formed.

Examples 2-2 to 2-287 and Comparative Examples 2-1 to 2-8

Electrophotographic photosensitive members were produced, with changes made to the foregoing process (Example 2-1) in accordance with Tables 15 to 20 in terms of the following conditions: the use or omission of the conductive layer; the kind of the undercoat layer; the kind of charge generation material in the charge generation layer; the kind and weight-average molecular weight Mw of resin, the kind of charge transport material (s (and the ratio by mass if two materials were used in combination), the amounts (parts) of the charge transport material (s) and the resin, and the kind and amount (parts) of solvent in the charge transport layer. Exemplified compound 3001 is a polymer (a weight-average molecular weight of 63,000) of group-B structural unit B-101 (a dielectric constant of 2.11). Exemplified compound 3002 is a polymer (a weight-average molecular weight of 53,000) of group-B structural unit B-201 (a dielectric constant of 2.20). Exemplified compound 3003 is a polymer (a weight-average molecular weight of 36,000) of group--B structural unit B-403 (a dielectric constant of 2.41). Undercoat layers UCL-2 and UCL-3 and the charge generation layers containing charge generation material CGM-1 or CGM-2 were produced as follows. Undercoat layer UCL-2

Ten parts of the electron transport compound according to the following formula (ETM-1),

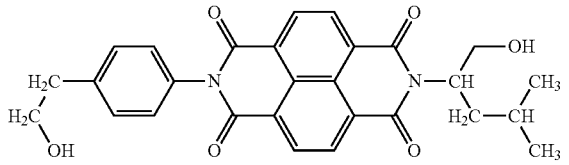

17 parts of the blocked isocyanate compound according to the following formula (trade name, Sumidur 3175; solids content, 75% by mass; Sumitomo Bayer Urethane) as a crosslinking agent,

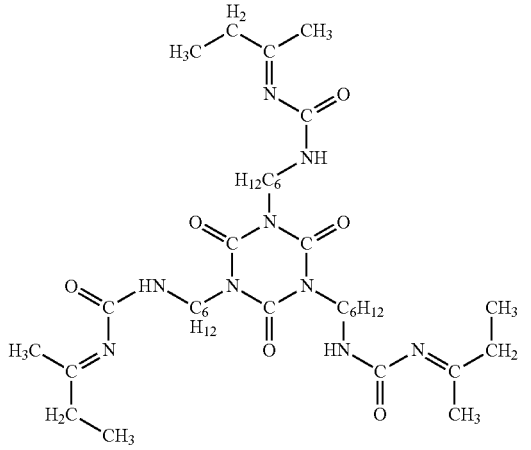

2 parts of polyvinyl butyral resin (trade name, S-LEC BX-1; Sekisui Chemical), and 0.2 parts of zinc (II) butyrate as an additive were dissolved in a solvent mixture of 100 parts of tetrahydrofuran and 100 parts of 1-methoxy-2-propanol, producing a coating liquid for the formation of an undercoat layer. This coating liquid for the formation of an undercoat layer was applied to the conductive layer by dip coating, and the obtained wet coating was heated at 160° C. for 30 minutes to dry and cure. In this way, a 0.7-11m thick undercoat layer UCL-2 was formed.

Undercoat Layer UCL-3

One hundred parts of zinc oxide particles (average primary particle diameter, 50 nm; specific surface area, 19 $m^2/g$; powder resistance, $4.7\times10^6$ Ω·cm; Tayca Corporation) was mixed into 500 parts of toluene with stirring. The resulting mixture was stirred with 1.25 parts of N-2-(aminoethyl)-3-aminopropylmethyldimethoxysilane (trade name, KBM602; Shin-Etsu Chemical) as a surface-treating agent for 6 hours. The toluene was then removed under reduced pressure, and the residue was dried at 130° C. for 6 hours, producing surface-treated zinc oxide particles. Then 75 parts of these surface-treated zinc oxide particles, 16 parts of the aforementioned blocked isocyanate compound (trade name, Sumidur 3175; solids content, 75% by mass; Sumitomo Bayer Urethane), 9 parts of polyvinyl butyral resin (trade name, S-LEC BM-1; Sekisui Chemical), and 1 part of 2,3,4-trihydroxybenzophenone (Tokyo Chemical Industry) were added to a solvent, mixture of 60 parts of methyl ethyl ketone and 60 parts of cyclohexanone, producing a liquid dispersion. This liquid dispersion was subjected to 3 hours of dispersion in a vertical ball mill with glass beads having an average particle diameter of 1.0 mm in an atmosphere at 23° C. at a rotational speed of 1,500 rpm. After the completion of dispersion, the liquid dispersion was stirred with 5 parts of crosslinked methyl methacrylate particles (trade name, SSX-103; average particle diameter, 3 μm; Sekisui Chemical) and 0.01 parts of silicone oil (trade name, SH28PA; Dow Corning Toray), producing a coating liquid for the formation of an undercoat layer. This coating liquid for the formation of an undercoat layer was applied to the support by dip coating, and the obtained wet coating was heated at 160° C. for 40 minutes for polymerization. In this way, a 30-μm thick undercoat layer (UCL-3) was formed.

Charge Generation Layer Containing Charge Generation Material CGM-1

Twelve parts of a Y-form crystalline oxytitanium phthalocyanine (charge generation material) having a peak at a Bragg angle (2θ±0.2°) of 27.3° in its CuKα characteristic X-ray diffraction pattern, 10 parts of polyvinyl butyral resin (trade name, S-LEC BX-1; Sekisui Chemical), and 250 parts of cyclohexanone were subjected to 3 hours of dispersion in a ball mill with 1.0-mm diameter glass beads, producing a liquid dispersion. This liquid dispersion was diluted with 500 parts of ethyl acetate, producing a coating liquid for the formation of a charge generation layer. This coating liquid for the formation of a charge generation layer was applied to the undercoat layer by dip coating, and the obtained wet coating was dried at 80° C. for 10 minutes. In this way, a 0.20-μm thick charge generation layer was formed.

Charge Generation Layer Containing Charge Generation Material CGM-2

Fifteen parts of charge generation material CGM-2, which was the bisazo pigment according to the following formula,

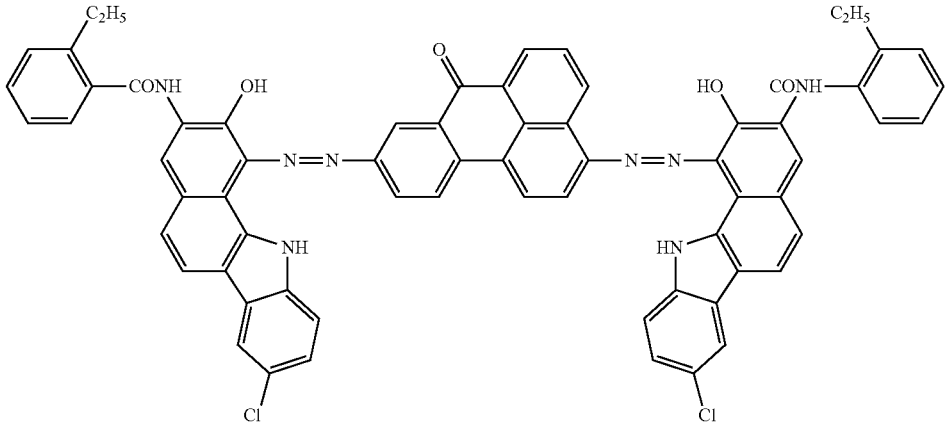

10 parts of polyvinyl butyral resin (trade name, S-LEC BX-1; Sekisui Chemical), and 250 parts of tetrahydrofuran were subjected to 3 hours of dispersion in a ball mill with 1.0-mm diameter glass beads, producing a liquid dispersion. This liquid dispersion was diluted with 100 parts of cyclohexanone and 500 parts of tetrahydrofuran, producing a coating liquid for the formation of a charge generation layer. This coating liquid for the formation of a charge generation layer was applied to the undercoat layer by dip coating, and the obtained wet coating was dried at 110° C. for 30 minutes. In this way, a 0.30-μm thick charge generation layer was formed.

TABLE 15

Conditions for the manufacture of photosensitive members

| | Conductive layer | Undercoat layer | Charge generation layer | Charge transport layer | | | | | | |
|---|---|---|---|---|---|---|---|---|---|---|
| | | | | Resin | | Charge transport material(s) | | Charge transport material(s)/resin | Solvent(s) | |
| Example No. | Used/ Not used | Type | Charge generation material | Type | Mw | Type | Mass ratio | in parts | Type | Parts |
| Example 2-1 | ○ | UCL-1 | Ga-1 | 1001 | 63000 | 102/205 | 9/1 | 9/10 | Xy/DMM | 70/20 |
| Example 2-2 | ○ | UCL-1 | Ga-7 | 1001 | 56000 | 102/205 | 9/1 | 9/10 | Xy/DMM | 70/20 |
| Example 2-3 | ○ | UCL-1 | Ga-7 | 1001 | 38000 | 102/205 | 9/1 | 9/10 | Xy/DMM | 70/20 |
| Example 2-4 | ○ | UCL-1 | Ga-7 | 1001 | 77000 | 102/205 | 9/1 | 9/10 | Xy/DMM | 70/20 |
| Example 2-5 | ○ | UCL-1 | Ga-7 | 1001 | 95000 | 102/205 | 9/1 | 9/10 | Xy/DMM | 70/20 |
| Example 2-6 | ○ | UCL-1 | Ga-7 | 1002 | 56000 | 102/205 | 9/1 | 9/10 | Xy/DMM | 70/20 |
| Example 2-7 | ○ | UCL-1 | Ga-7 | 1002 | 36000 | 102/205 | 9/1 | 9/10 | Xy/DMM | 70/20 |
| Example 2-8 | ○ | UCL-1 | Ga-7 | 1002 | 80000 | 102/205 | 9/1 | 9/10 | Xy/DMM | 70/20 |
| Example 2-9 | ○ | UCL-1 | Ga-7 | 1002 | 94000 | 102/205 | 9/1 | 9/10 | Xy/DMM | 70/20 |
| Example 2-10 | ○ | UCL-1 | Ga-7 | 1003 | 51000 | 102/205 | 9/1 | 9/10 | Xy/DMM | 70/20 |
| Example 2-11 | ○ | UCL-1 | Ga-7 | 1003 | 38000 | 102/205 | 9/1 | 9/10 | Xy/DMM | 70/20 |
| Example 2-12 | ○ | UCL-1 | Ga-7 | 1003 | 78000 | 102/205 | 9/1 | 9/10 | Xy/DMM | 70/20 |
| Example 2-13 | ○ | UCL-1 | Ga-7 | 1003 | 97000 | 102/205 | 9/1 | 9/10 | Xy/DMM | 70/20 |
| Example 2-14 | ○ | UCL-1 | Ga-7 | 1001 | 56000 | 102/205 | 9/1 | 6/10 | Xy/DMM | 70/20 |
| Example 2-15 | ○ | UCL-1 | Ga-7 | 1001 | 56000 | 102/305 | 9/1 | 9/10 | Xy/DMM | 70/20 |
| Example 2-16 | ○ | UCL-1 | Ga-7 | 1001 | 56000 | 102/201 | 9/1 | 9/10 | Xy/DMM | 70/20 |
| Example 2-17 | ○ | UCL-1 | Ga-7 | 1001 | 56000 | 405 | — | 9/10 | Xy/DMM | 70/20 |
| Example 2-18 | ○ | UCL-1 | Ga-7 | 1001 | 56000 | 302 | — | 9/10 | Xy/DMM | 70/20 |
| Example 2-19 | ○ | UCL-1 | Ga-7 | 1001 | 56000 | 705 | — | 9/10 | Xy/DMM | 70/20 |
| Example 2-20 | ○ | UCL-1 | Ga-7 | 1001 | 56000 | 603 | — | 9/10 | Xy/DMM | 70/20 |
| Example 2-21 | ○ | UCL-1 | Ga-7 | 1001 | 38000 | 603 | — | 9/10 | Xy/DMM | 70/20 |
| Example 2-22 | ○ | UCL-1 | Ga-7 | 1001 | 77000 | 603 | — | 9/10 | Xy/DMM | 70/20 |
| Example 2-23 | ○ | UCL-1 | Ga-7 | 1001 | 95000 | 603 | — | 9/10 | Xy/DMM | 70/20 |
| Example 2-24 | ○ | UCL-1 | Ga-7 | 1002 | 56000 | 603 | — | 9/10 | Xy/DMM | 70/20 |
| Example 2-25 | ○ | UCL-1 | Ga-7 | 1002 | 36000 | 603 | — | 9/10 | Xy/DMM | 70/20 |
| Example 2-26 | ○ | UCL-1 | Ga-7 | 1002 | 80000 | 603 | — | 9/10 | Xy/DMM | 70/20 |
| Example 2-27 | ○ | UCL-1 | Ga-7 | 1002 | 94000 | 603 | — | 9/10 | Xy/DMM | 70/20 |
| Example 2-28 | ○ | UCL-1 | Ga-7 | 1003 | 51000 | 603 | — | 9/10 | Xy/DMM | 70/20 |
| Example 2-29 | ○ | UCL-1 | Ga-7 | 1003 | 38000 | 603 | — | 9/10 | Xy/DMM | 70/20 |
| Example 2-30 | ○ | UCL-1 | Ga-7 | 1003 | 78000 | 603 | — | 9/10 | Xy/DMM | 70/20 |
| Example 2-31 | ○ | UCL-1 | Ga-7 | 1003 | 97000 | 603 | — | 9/10 | Xy/DMM | 70/20 |
| Example 2-32 | ○ | UCL-1 | Ga-7 | 1001 | 56000 | 603 | — | 6/10 | Xy/DMM | 70/20 |
| Example 2-33 | ○ | UCL-1 | Ga-7 | 1001 | 56000 | 603 | — | 4/10 | Xy/DMM | 70/20 |
| Example 2-34 | ○ | UCL-1 | Ga-7 | 1001 | 56000 | 211 | — | 9/10 | Xy/DMM | 70/20 |
| Example 2-35 | ○ | UCL-1 | Ga-7 | 1001 | 56000 | 501 | — | 9/10 | Xy/DMM | 70/20 |
| Example 2-36 | ○ | UCL-1 | Ga-7 | 1001 | 56000 | 309 | — | 9/10 | Xy/DMM | 70/20 |
| Example 2-37 | ○ | UCL-1 | Ga-7 | 1001 | 56000 | 605 | — | 9/10 | Xy/DMM | 70/20 |
| Example 2-38 | ○ | UCL-1 | Ga-7 | 1001 | 38000 | 605 | — | 9/10 | Xy/DMM | 70/20 |
| Example 2-39 | ○ | UCL-1 | Ga-7 | 1001 | 77000 | 605 | — | 9/10 | Xy/DMM | 70/20 |
| Example 2-40 | ○ | UCL-1 | Ga-7 | 1001 | 95000 | 605 | — | 9/10 | Xy/DMM | 70/20 |
| Example 2-41 | ○ | UCL-1 | Ga-7 | 1002 | 56000 | 605 | — | 9/10 | Xy/DMM | 70/20 |
| Example 2-42 | ○ | UCL-1 | Ga-7 | 1002 | 36000 | 605 | — | 9/10 | Xv/DMM | 70/20 |
| Example 2-43 | ○ | UCL-1 | Ga-7 | 1002 | 80000 | 605 | — | 9/10 | Xy/DMM | 70/20 |
| Example 2-44 | ○ | UCL-1 | Ga-7 | 1002 | 94000 | 605 | — | 9/10 | Xy/DMM | 70/20 |
| Example 2-45 | ○ | UCL-1 | Ga-7 | 1003 | 51000 | 605 | — | 9/10 | Xy/DMM | 70/20 |
| Example 2-46 | ○ | UCL-1 | Ga-7 | 1003 | 38000 | 605 | — | 9/10 | Xy/DMM | 70/20 |
| Example 2-47 | ○ | UCL-1 | Ga-7 | 1003 | 78000 | 605 | — | 9/10 | Xy/DMM | 70/20 |
| Example 2-48 | ○ | UCL-1 | Ga-7 | 1003 | 97000 | 605 | — | 9/10 | Xy/DMM | 70/20 |
| Example 2-49 | ○ | UCL-1 | Ga-7 | 1001 | 56000 | 605 | — | 6/10 | Xy/DMM | 70/20 |
| Example 2-50 | ○ | UCL-1 | Ga-7 | 1001 | 56000 | 605 | — | 4/10 | Xy/DMM | 70/20 |

TABLE 16

Conditions for the manufacture of photosensitive members

| Example No. | Conductive layer Used/ Not used | Undercoat layer Type | Charge generation layer Charge generation material | Charge transport layer: Resin Type | Resin Mw | Charge transport material(s) Type | Mass ratio | Charge transport material(s)/resin in parts | Solvent(s) Type | Solvent(s) Parts |
|---|---|---|---|---|---|---|---|---|---|---|
| Example 2-51 | ○ | UCL-1 | Ga-7 | 1001 | 56000 | 606 | — | 9/10 | Xy/DMM | 70/20 |
| Example 2-52 | ○ | UCL-1 | Ga-7 | 1001 | 56000 | 505 | — | 9/10 | Xy/DMM | 70/20 |
| Example 2-53 | ○ | UCL-1 | Ga-3 | 1001 | 56000 | 102/205 | 9/1 | 9/10 | Xy/DMM | 70/20 |
| Example 2-54 | ○ | UCL-1 | Ga-4 | 1001 | 56000 | 102/205 | 9/1 | 9/10 | Xy/DMM | 70/20 |
| Example 2-55 | ○ | UCL-2 | Ga-7 | 1001 | 56000 | 102/205 | 9/1 | 9/10 | Xy/DMM | 70/20 |
| Example 2-56 | — | UCL-3 | Ga-7 | 1001 | 56000 | 102/205 | 9/1 | 9/10 | Xy/DMM | 70/20 |
| Example 2-57 | ○ | UCL-1 | CGM-1 | 1001 | 56000 | 603 | — | 9/10 | Xy/DMM | 70/20 |
| Example 2-58 | ○ | UCL-1 | CGM-2 | 1001 | 56000 | 304 | — | 9/10 | Xy/DMM | 70/20 |
| Example 2-59 | ○ | UCL-1 | Ga-7 | 1001 | 56000 | 102/205 | 9/1 | 9/10 | THF | 90 |
| Example 2-60 | ○ | UCL-1 | Ga-7 | 1004 | 58000 | 102/205 | 9/1 | 9/10 | THF | 90 |
| Example 2-61 | ○ | UCL-1 | Ga-7 | 1005 | 52000 | 102/205 | 9/1 | 9/10 | Xy/DMM | 70/20 |
| Example 2-62 | ○ | UCL-1 | Ga-7 | 1009 | 51000 | 102/205 | 9/1 | 9/10 | Xy/DMM | 70/20 |
| Example 2-63 | ○ | UCL-1 | Ga-7 | 1093 | 51000 | 102/205 | 9/1 | 9/10 | Xy/DMM | 70/20 |
| Example 2-64 | ○ | UCL-1 | Ga-7 | 1097 | 52000 | 102/205 | 9/1 | 9/10 | Xy/DMM | 70/20 |
| Example 2-65 | ○ | UCL-1 | Ga-7 | 1101 | 50000 | 102/205 | 9/1 | 9/10 | Xy/DMM | 70/20 |
| Example 2-66 | ○ | UCL-1 | Ga-7 | 1021 | 50000 | 102/205 | 9/1 | 9/10 | Xy/DMM | 70/20 |
| Example 2-67 | ○ | UCL-1 | Ga-7 | 1021 | 34000 | 102/205 | 9/1 | 9/10 | Xy/DMM | 70/20 |
| Example 2-68 | ○ | UCL-1 | Ga-7 | 1021 | 75000 | 102/205 | 9/1 | 9/10 | Xy/DMM | 70/20 |
| Example 2-69 | ○ | UCL-1 | Ga-7 | 1022 | 57000 | 102/205 | 9/1 | 9/10 | Xy/DMM | 70/20 |
| Example 2-70 | ○ | UCL-1 | Ga-7 | 1022 | 34000 | 102/205 | 9/1 | 9/10 | Xy/DMM | 70/20 |
| Example 2-71 | ○ | UCL-1 | Ga-7 | 1022 | 78000 | 102/205 | 9/1 | 9/10 | Xy/DMM | 70/20 |
| Example 2-72 | ○ | UCL-1 | Ga-7 | 1021 | 50000 | 102/205 | 9/1 | 6/10 | Xy/DMM | 70/20 |
| Example 2-73 | ○ | UCL-1 | Ga-7 | 1021 | 50000 | 102/305 | 9/1 | 9/10 | Xy/DMM | 70/20 |
| Example 2-74 | ○ | UCL-1 | Ga-7 | 1021 | 50000 | 102/201 | 9/1 | 9/10 | Xy/DMM | 70/20 |
| Example 2-75 | ○ | UCL-1 | Ga-7 | 1021 | 50000 | 405 | — | 9/10 | Xy/DMM | 70/20 |
| Example 2-76 | ○ | UCL-1 | Ga-7 | 1021 | 50000 | 302 | — | 9/10 | Xy/DMM | 70/20 |
| Example 2-77 | ○ | UCL-1 | Ga-7 | 1021 | 50000 | 705 | — | 9/10 | Xy/DMM | 70/20 |
| Example 2-78 | ○ | UCL-1 | Ga-7 | 1021 | 50000 | 603 | — | 9/10 | Xy/DMM | 70/20 |
| Example 2-79 | ○ | UCL-1 | Ga-7 | 1021 | 34000 | 603 | — | 9/10 | Xy/DMM | 70/20 |
| Example 2-80 | ○ | UCL-1 | Ga-7 | 1021 | 75000 | 603 | — | 9/10 | Xy/DMM | 70/20 |
| Example 2-81 | ○ | UCL-1 | Ga-7 | 1022 | 57000 | 603 | — | 9/10 | Xy/DMM | 70/20 |
| Example 2-82 | ○ | UCL-1 | Ga-7 | 1022 | 34000 | 603 | — | 9/10 | Xy/DMM | 70/20 |
| Example 2-83 | ○ | UCL-1 | Ga-7 | 1022 | 78000 | 603 | — | 9/10 | Xy/DMM | 70/20 |
| Example 2-84 | ○ | UCL-1 | Ga-7 | 1021 | 50000 | 603 | — | 6/10 | Xy/DMM | 70/20 |
| Example 2-85 | ○ | UCL-1 | Ga-7 | 1021 | 50000 | 603 | — | 4/10 | Xy/DMM | 70/20 |
| Example 2-86 | ○ | UCL-1 | Ga-7 | 1021 | 50000 | 211 | — | 9/10 | Xy/DMM | 70/20 |
| Example 2-87 | ○ | UCL-1 | Ga-7 | 1021 | 50000 | 501 | — | 9/10 | Xy/DMM | 70/20 |
| Example 2-88 | ○ | UCL-1 | Ga-7 | 1021 | 50000 | 309 | — | 9/10 | Xy/DMM | 70/20 |
| Example 2-89 | ○ | UCL-1 | Ga-7 | 1021 | 50000 | 605 | — | 9/10 | Xy/DMM | 70/20 |
| Example 2-90 | ○ | UCL-1 | Ga-7 | 1021 | 34000 | 605 | — | 9/10 | Xy/DMM | 70/20 |
| Example 2-91 | ○ | UCL-1 | Ga-7 | 1021 | 75000 | 605 | — | 9/10 | Xy/DMM | 70/20 |
| Example 2-92 | ○ | UCL-1 | Ga-7 | 1022 | 57000 | 605 | — | 9/10 | Xy/DMM | 70/20 |
| Example 2-93 | ○ | UCL-1 | Ga-7 | 1022 | 34000 | 605 | — | 9/10 | Xy/DMM | 70/20 |
| Example 2-94 | ○ | UCL-1 | Ga-7 | 1022 | 78000 | 605 | — | 9/10 | Xy/DMM | 70/20 |
| Example 2-95 | ○ | UCL-1 | Ga-7 | 1021 | 50000 | 605 | — | 6/10 | Xy/DMM | 70/20 |
| Example 2-96 | ○ | UCL-1 | Ga-7 | 1021 | 50000 | 605 | — | 4/10 | Xy/DMM | 70/20 |
| Example 2-97 | ○ | UCL-1 | Ga-7 | 1021 | 50000 | 606 | — | 9/10 | Xy/DMM | 70/20 |
| Example 2-98 | ○ | UCL-1 | Ga-7 | 1021 | 50000 | 505 | — | 9/10 | Xy/DMM | 70/20 |
| Example 2-99 | ○ | UCL-1 | Ga-3 | 1021 | 50000 | 102/205 | 9/1 | 9/10 | Xy/DMM | 70/20 |
| Example 2-100 | ○ | UCL-1 | Ga-4 | 1021 | 50000 | 102/205 | 9/1 | 9/10 | Xy/DMM | 70/20 |

TABLE 17

Conditions for the manufacture of photosensitive members

| Example No. | Conductive layer Used/ Not used | Undercoat layer Type | Charge generation layer Charge generation material | Charge transport layer: Resin Type | Resin Mw | Charge transport material(s) Type | Mass ratio | Charge transport material(s)/resin in parts | Solvent(s) Type | Solvent(s) Parts |
|---|---|---|---|---|---|---|---|---|---|---|
| Example 2-101 | ○ | UCL-2 | Ga-7 | 1021 | 50000 | 102/205 | 9/1 | 9/10 | Xy/DMM | 70/20 |
| Example 2-102 | — | UCL-3 | Ga-7 | 1021 | 50000 | 102/205 | 9/1 | 9/10 | Xy/DMM | 70/20 |

TABLE 17-continued

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-103 | ○ | UCL-1 | CGM-1 | 1021 | 50000 | 603 | — | 9/10 | Xy/DMM | 70/20 |
| Example 2-104 | ○ | UCL-1 | CGM-2 | 1021 | 50000 | 304 | — | 9/10 | Xy/DMM | 70/20 |
| Example 2-105 | ○ | UCL-1 | Ga-7 | 1021 | 50000 | 102/205 | 9/1 | 9/10 | THF | 90 |
| Example 2-106 | ○ | UCL-1 | Ga-7 | 1113 | 56000 | 102/205 | 9/1 | 9/10 | Xy/DMM | 70/20 |
| Example 2-107 | ○ | UCL-1 | Ga-7 | 1045 | 52000 | 102/205 | 9/1 | 9/10 | Xy/DMM | 70/20 |
| Example 2-108 | ○ | UCL-1 | Ga-7 | 1045 | 52000 | 102/205 | 9/1 | 9/10 | Xy/DMM | 70/20 |
| Example 2-109 | ○ | UCL-1 | Ga-7 | 1045 | 52000 | 102/205 | 9/1 | 9/10 | Xy/DMM | 70/20 |
| Example 2-110 | ○ | UCL-1 | Ga-7 | 1045 | 52000 | 102/205 | 9/1 | 9/10 | Xy/DMM | 70/20 |
| Example 2-111 | ○ | UCL-1 | Ga-7 | 1046 | 58000 | 102/205 | 9/1 | 9/10 | Xy/DMM | 70/20 |
| Example 2-112 | ○ | UCL-1 | Ga-7 | 1046 | 58000 | 102/205 | 9/1 | 9/10 | Xy/DMM | 70/20 |
| Example 2-113 | ○ | UCL-1 | Ga-7 | 1046 | 58000 | 102/205 | 9/1 | 9/10 | Xy/DMM | 70/20 |
| Example 2-114 | ○ | UCL-1 | Ga-7 | 1046 | 58000 | 102/205 | 9/1 | 9/10 | Xy/DMM | 70/20 |
| Example 2-115 | ○ | UCL-1 | Ga-7 | 1047 | 58000 | 102/205 | 9/1 | 9/10 | Xy/DMM | 70/20 |
| Example 2-116 | ○ | UCL-1 | Ga-7 | 1047 | 58000 | 102/205 | 9/1 | 9/10 | Xy/DMM | 70/20 |
| Example 2-117 | ○ | UCL-1 | Ga-7 | 1047 | 58000 | 102/205 | 9/1 | 9/10 | Xy/DMM | 70/20 |
| Example 2-118 | ○ | UCL-1 | Ga-7 | 1047 | 58000 | 102/205 | 9/1 | 9/10 | Xy/DMM | 70/20 |
| Example 2-119 | ○ | UCL-1 | Ga-7 | 1045 | 52000 | 102/205 | 9/1 | 6/10 | Xy/DMM | 70/20 |
| Example 2-120 | ○ | UCL-1 | Ga-7 | 1045 | 52000 | 211 | — | 9/10 | Xy/DMM | 70/20 |
| Example 2-121 | ○ | UCL-1 | Ga-7 | 1045 | 52000 | 211 | — | 6/10 | Xy/DMM | 70/20 |
| Example 2-122 | ○ | UCL-1 | Ga-7 | 1045 | 52000 | 211 | — | 4/10 | Xy/DMM | 70/20 |
| Example 2-123 | ○ | UCL-1 | Ga-7 | 1045 | 52000 | 307 | — | 9/10 | Xy/DMM | 70/20 |
| Example 2-124 | ○ | UCL-1 | Ga-7 | 1045 | 52000 | 307 | — | 6/10 | Xy/DMM | 70/20 |
| Example 2-125 | ○ | UCL-1 | Ga-7 | 1045 | 52000 | 307 | — | 4/10 | Xy/DMM | 70/20 |
| Example 2-126 | ○ | UCL-1 | CGM-1 | 1045 | 52000 | 602 | — | 9/10 | Xy/DMM | 70/20 |
| Example 2-127 | ○ | UCL-1 | Ga-7 | 1045 | 52000 | 602 | — | 9/10 | THF | 90 |
| Example 2-128 | ○ | UCL-1 | Ga-7 | 1048 | 58000 | 602 | — | 9/10 | THF | 90 |
| Example 2-129 | ○ | UCL-1 | Ga-7 | 1137 | 53000 | 102/205 | 9/1 | 9/10 | Xy/DMM | 70/20 |
| Example 2-130 | ○ | UCL-1 | Ga-7 | 1065 | 50000 | 102/205 | 9/1 | 9/10 | Xy/DMM | 70/20 |
| Example 2-131 | ○ | UCL-1 | Ga-7 | 1065 | 54000 | 102/205 | 9/1 | 9/10 | Xy/DMM | 70/20 |
| Example 2-132 | ○ | UCL-1 | Ga-7 | 1065 | 54000 | 102/205 | 9/1 | 9/10 | Xy/DMM | 70/20 |
| Example 2-133 | ○ | UCL-1 | Ga-7 | 1065 | 54000 | 102/205 | 9/1 | 9/10 | Xy/DMM | 70/20 |
| Example 2-134 | ○ | UCL-1 | Ga-7 | 1065 | 54000 | 102/205 | 9/1 | 9/10 | Xy/DMM | 70/20 |
| Example 2-135 | ○ | UCL-1 | Ga-7 | 1066 | 52000 | 102/205 | 9/1 | 9/10 | Xy/DMM | 70/20 |
| Example 2-136 | ○ | UCL-1 | Ga-7 | 1066 | 52000 | 102/205 | 9/1 | 9/10 | Xy/DMM | 70/20 |
| Example 2-137 | ○ | UCL-1 | Ga-7 | 1066 | 52000 | 102/205 | 9/1 | 9/10 | Xy/DMM | 70/20 |
| Example 2-138 | ○ | UCL-1 | Ga-7 | 1066 | 52000 | 102/205 | 9/1 | 9/10 | Xy/DMM | 70/20 |
| Example 2-139 | ○ | UCL-1 | Ga-7 | 1067 | 52000 | 102/205 | 9/1 | 9/10 | Xy/DMM | 70/20 |
| Example 2-140 | ○ | UCL-1 | Ga-7 | 1067 | 52000 | 102/205 | 9/1 | 9/10 | Xy/DMM | 70/20 |
| Example 2-141 | ○ | UCL-1 | Ga-7 | 1067 | 52000 | 102/205 | 9/1 | 9/10 | Xy/DMM | 70/20 |
| Example 2-142 | ○ | UCL-1 | Ga-7 | 1067 | 52000 | 102/205 | 9/1 | 9/10 | Xy/DMM | 70/20 |
| Example 2-143 | ○ | UCL-1 | Ga-7 | 1065 | 54000 | 102/205 | 9/1 | 6/10 | Xy/DMM | 70/20 |
| Example 2-144 | ○ | UCL-1 | Ga-7 | 1065 | 54000 | 603 | — | 9/10 | Xy/DMM | 70/20 |
| Example 2-145 | ○ | UCL-1 | Ga-7 | 1065 | 54000 | 603 | — | 6/10 | Xy/DMM | 70/20 |
| Example 2-146 | ○ | UCL-1 | Ga-7 | 1065 | 54000 | 603 | — | 4/10 | Xy/DMM | 70/20 |
| Example 2-147 | ○ | UCL-1 | Ga-7 | 1065 | 54000 | 605 | — | 9/10 | Xy/DMM | 70/20 |
| Example 2-148 | ○ | UCL-1 | Ga-7 | 1065 | 54000 | 605 | — | 6/10 | Xy/DMM | 70/20 |
| Example 2-149 | ○ | UCL-1 | Ga-7 | 1065 | 54000 | 605 | — | 4/10 | Xy/DMM | 70/20 |
| Example 2-150 | ○ | UCL-1 | Ga-7 | 1065 | 54000 | 201 | — | 9/10 | THF | 90 |

TABLE 18

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-151 | ○ | UCL-1 | Ga-7 | 1068 | 56000 | 201 | — | 9/10 | THF | 90 |
| Example 2-152 | ○ | UCL-1 | Ga-7 | 1157 | 57000 | 102/205 | 9/1 | 9/10 | Xy/DMM | 70/20 |
| Example 2-153 | ○ | UCL-1 | Ga-7 | 1049 | 56000 | 102/205 | 9/1 | 9/10 | Xy/DMM | 70/20 |
| Example 2-154 | ○ | UCL-1 | Ga-7 | 1049 | 56000 | 102/205 | 9/1 | 9/10 | Xy/DMM | 70/20 |

TABLE 18-continued

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-155 | ○ | UCL-1 | Ga-7 | 1049 | 56000 | 102/205 | 9/1 | 9/10 | Xy/DMM | 70/20 |
| Example 2-156 | ○ | UCL-1 | Ga-7 | 1049 | 56000 | 102/205 | 9/1 | 9/10 | Xy/DMM | 70/20 |
| Example 2-157 | ○ | UCL-1 | Ga-7 | 1050 | 52000 | 102/205 | 9/1 | 9/10 | Xy/DMM | 70/20 |
| Example 2-158 | ○ | UCL-1 | Ga-7 | 1050 | 52000 | 102/205 | 9/1 | 9/10 | Xy/DMM | 70/20 |
| Example 2-159 | ○ | UCL-1 | Ga-7 | 1050 | 52000 | 102/205 | 9/1 | 9/10 | Xy/DMM | 70/20 |
| Example 2-160 | ○ | UCL-1 | Ga-7 | 1050 | 52000 | 102/205 | 9/1 | 9/10 | Xy/DMM | 70/20 |
| Example 2-161 | ○ | UCL-1 | Ga-7 | 1051 | 52000 | 102/205 | 9/1 | 9/10 | Xy/DMM | 70/20 |
| Example 2-162 | ○ | UCL-1 | Ga-7 | 1051 | 52000 | 102/205 | 9/1 | 9/10 | Xy/DMM | 70/20 |
| Example 2-163 | ○ | UCL-1 | Ga-7 | 1051 | 52000 | 102/205 | 9/1 | 9/10 | Xy/DMM | 70/20 |
| Example 2-164 | ○ | UCL-1 | Ga-7 | 1051 | 52000 | 102/205 | 9/1 | 9/10 | Xy/DMM | 70/20 |
| Example 2-165 | ○ | UCL-1 | Ga-7 | 1049 | 54000 | 102/205 | 9/1 | 6/10 | Xy/DMM | 70/20 |
| Example 2-166 | ○ | UCL-1 | Ga-7 | 1049 | 54000 | 309 | — | 9/10 | Xy/DMM | 70/20 |
| Example 2-167 | ○ | UCL-1 | Ga-7 | 1049 | 54000 | 309 | — | 6/10 | Xy/DMM | 70/20 |
| Example 2-168 | ○ | UCL-1 | Ga-7 | 1049 | 54000 | 309 | — | 4/10 | Xy/DMM | 70/20 |
| Example 2-169 | ○ | UCL-1 | Ga-7 | 1049 | 54000 | 405 | — | 9/10 | Xy/DMM | 70/20 |
| Example 2-170 | ○ | UCL-1 | Ga-7 | 1049 | 54000 | 405 | — | 6/10 | Xy/DMM | 70/20 |
| Example 2-171 | ○ | UCL-1 | CGM-1 | 1049 | 54000 | 705 | — | 9/10 | Xy/DMM | 70/20 |
| Example 2-172 | ○ | UCL-1 | Ga-7 | 1049 | 54000 | 705 | — | 9/10 | THF | 90 |
| Example 2-173 | ○ | UCL-1 | Ga-7 | 1052 | 58000 | 705 | — | 9/10 | THF | 90 |
| Example 2-174 | ○ | UCL-1 | Ga-7 | 1141 | 51000 | 102/205 | 9/1 | 9/10 | Xy/DMM | 70/20 |
| Example 2-175 | ○ | UCL-1 | Ga-7 | 1073 | 55000 | 102/205 | 9/1 | 9/10 | Xy/DMM | 70/20 |
| Example 2-176 | ○ | UCL-1 | Ga-7 | 1073 | 37000 | 102/205 | 9/1 | 9/10 | Xy/DMM | 70/20 |
| Example 2-177 | ○ | UCL-1 | Ga-7 | 1073 | 76000 | 102/205 | 9/1 | 9/10 | Xy/DMM | 70/20 |
| Example 2-178 | ○ | UCL-1 | Ga-7 | 1073 | 98000 | 102/205 | 9/1 | 9/10 | Xy/DMM | 70/20 |
| Example 2-179 | ○ | UCL-1 | Ga-7 | 1074 | 51000 | 102/205 | 9/1 | 9/10 | Xy/DMM | 70/20 |
| Example 2-180 | ○ | UCL-1 | Ga-7 | 1074 | 38000 | 102/205 | 9/1 | 9/10 | Xy/DMM | 70/20 |
| Example 2-181 | ○ | UCL-1 | Ga-7 | 1074 | 70000 | 102/205 | 9/1 | 9/10 | Xy/DMM | 70/20 |
| Example 2-182 | ○ | UCL-1 | Ga-7 | 1074 | 92000 | 102/205 | 9/1 | 9/10 | Xy/DMM | 70/20 |
| Example 2-183 | ○ | UCL-1 | Ga-7 | 1075 | 58000 | 102/205 | 9/1 | 9/10 | Xy/DMM | 70/20 |
| Example 2-184 | ○ | UCL-1 | Ga-7 | 1075 | 36000 | 102/205 | 9/1 | 9/10 | Xy/DMM | 70/20 |
| Example 2-185 | ○ | UCL-1 | Ga-7 | 1075 | 78000 | 102/205 | 9/1 | 9/10 | Xy/DMM | 70/20 |
| Example 2-186 | ○ | UCL-1 | Ga-7 | 1075 | 94000 | 102/205 | 9/1 | 9/10 | Xy/DMM | 70/20 |
| Example 2-187 | ○ | UCL-1 | Ga-7 | 1081 | 56000 | 102/205 | 9/1 | 9/10 | Xy/DMM | 70/20 |
| Example 2-188 | ○ | UCL-1 | Ga-7 | 1165 | 55000 | 102/205 | 9/1 | 9/10 | Xy/DMM | 70/20 |
| Example 2-189 | ○ | UCL-1 | Ga-7 | 1173 | 56000 | 102/205 | 9/1 | 9/10 | Xy/DMM | 70/20 |
| Example 2-190 | ○ | UCL-1 | Ga-7 | 1461 | 72000 | 102/205 | 9/1 | 9/10 | Xy/DMM | 70/20 |
| Example 2-191 | ○ | UCL-1 | Ga-7 | 1461 | 54000 | 102/205 | 9/1 | 9/10 | Xy/DMM | 70/20 |
| Example 2-192 | ○ | UCL-1 | Ga-7 | 1461 | 36000 | 102/205 | 9/1 | 9/10 | Xy/DMM | 70/20 |
| Example 2-193 | ○ | UCL-1 | Ga-7 | 1461 | 77000 | 102/205 | 9/1 | 9/10 | Xy/DMM | 70/20 |
| Example 2-194 | ○ | UCL-1 | Ga-7 | 1462 | 56000 | 102/205 | 9/1 | 9/10 | Xy/DMM | 70/20 |
| Example 2-195 | ○ | UCL-1 | Ga-7 | 1462 | 30000 | 102/205 | 9/1 | 9/10 | Xy/DMM | 70/20 |
| Example 2-196 | ○ | UCL-1 | Ga-7 | 1462 | 70000 | 102/205 | 9/1 | 9/10 | Xy/DMM | 70/20 |
| Example 2-197 | ○ | UCL-1 | Ga-7 | 1465 | 51000 | 102/205 | 9/1 | 9/10 | Xy/DMM | 70/20 |
| Example 2-198 | ○ | UCL-1 | Ga-7 | 1469 | 54000 | 102/205 | 9/1 | 9/10 | Xy/DMM | 70/20 |
| Example 2-199 | ○ | UCL-1 | Ga-7 | 1553 | 57000 | 102/205 | 9/1 | 9/10 | Xy/DMM | 70/20 |
| Example 2-200 | ○ | UCL-1 | Ga-7 | 1557 | 59000 | 102/205 | 9/1 | 9/10 | Xy/DMM | 70/20 |

TABLE 19

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-201 | ○ | UCL-1 | Ga-7 | 1561 | 57000 | 102/205 | 9/1 | 9/10 | Xy/DMM | 70/20 |
| Example 2-202 | ○ | UCL-1 | Ga-7 | 1481 | 56000 | 102/205 | 9/1 | 9/10 | Xy/DMM | 70/20 |
| Example 2-203 | ○ | UCL-1 | Ga-7 | 1481 | 30000 | 102/205 | 9/1 | 9/10 | Xy/DMM | 70/20 |
| Example 2-204 | ○ | UCL-1 | Ga-7 | 1481 | 78000 | 102/205 | 9/1 | 9/10 | Xy/DMM | 70/20 |
| Example 2-205 | ○ | UCL-1 | Ga-7 | 1482 | 56000 | 102/205 | 9/1 | 9/10 | Xy/DMM | 70/20 |
| Example 2-206 | ○ | UCL-1 | Ga-7 | 1482 | 31000 | 102/205 | 9/1 | 9/10 | Xy/DMM | 70/20 |

TABLE 19-continued

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-207 | ○ | UCL-1 | Ga-7 | 1482 | 71000 | 102/205 | 9/1 | 9/10 | Xy/DMM | 70/20 |
| Example 2-208 | ○ | UCL-1 | Ga-7 | 1573 | 57000 | 102/205 | 9/1 | 9/10 | Xy/DMM | 70/20 |
| Example 2-209 | ○ | UCL-1 | Ga-7 | 1505 | 52000 | 211 | — | 9/10 | Xy/DMM | 70/20 |
| Example 2-210 | ○ | UCL-1 | Ga-7 | 1505 | 37000 | 211 | — | 9/10 | Xy/DMM | 70/20 |
| Example 2-211 | ○ | UCL-1 | Ga-7 | 1505 | 70000 | 211 | — | 9/10 | Xy/DMM | 70/20 |
| Example 2-212 | ○ | UCL-1 | Ga-7 | 1506 | 59000 | 211 | — | 9/10 | Xy/DMM | 70/20 |
| Example 2-213 | ○ | UCL-1 | Ga-7 | 1506 | 33000 | 211 | — | 9/10 | Xy/DMM | 70/20 |
| Example 2-214 | ○ | UCL-1 | Ga-7 | 1506 | 73000 | 211 | — | 9/10 | Xy/DMM | 70/20 |
| Example 2-215 | ○ | UCL-1 | Ga-7 | 1597 | 50000 | 211 | — | 9/10 | Xy/DMM | 70/20 |
| Example 2-216 | ○ | UCL-1 | Ga-7 | 1525 | 59000 | 603 | — | 9/10 | Xy/DMM | 70/20 |
| Example 2-217 | ○ | UCL-1 | Ga-7 | 1525 | 39000 | 603 | — | 9/10 | Xy/DMM | 70/20 |
| Example 2-218 | ○ | UCL-1 | Ga-7 | 1525 | 70000 | 603 | — | 9/10 | Xy/DMM | 70/20 |
| Example 2-219 | ○ | UCL-1 | Ga-7 | 1526 | 53000 | 603 | — | 9/10 | Xy/DMM | 70/20 |
| Example 2-220 | ○ | UCL-1 | Ga-7 | 1526 | 31000 | 603 | — | 9/10 | Xy/DMM | 70/20 |
| Example 2-221 | ○ | UCL-1 | Ga-7 | 1526 | 71000 | 603 | — | 9/10 | Xy/DMM | 70/20 |
| Example 2-222 | ○ | UCL-1 | Ga-7 | 1617 | 50000 | 603 | — | 9/10 | Xy/DMM | 70/20 |
| Example 2-223 | ○ | UCL-1 | Ga-7 | 1509 | 59000 | 309 | — | 9/10 | Xy/DMM | 70/20 |
| Example 2-224 | ○ | UCL-1 | Ga-7 | 1509 | 33000 | 309 | — | 9/10 | Xy/DMM | 70/20 |
| Example 2-225 | ○ | UCL-1 | Ga-7 | 1509 | 79000 | 309 | — | 9/10 | Xy/DMM | 70/20 |
| Example 2-226 | ○ | UCL-1 | Ga-7 | 1510 | 56000 | 309 | — | 9/10 | Xy/DMM | 70/20 |
| Example 2-227 | ○ | UCL-1 | Ga-7 | 1510 | 39000 | 309 | — | 9/10 | Xy/DMM | 70/20 |
| Example 2-228 | ○ | UCL-1 | Ga-7 | 1510 | 74000 | 309 | — | 9/10 | Xy/DMM | 70/20 |
| Example 2-229 | ○ | UCL-1 | Ga-7 | 1601 | 50000 | 309 | — | 9/10 | Xy/DMM | 70/20 |
| Example 2-230 | ○ | UCL-1 | Ga-7 | 1533 | 59000 | 102/205 | 9/1 | 9/10 | Xy/DMM | 70/20 |
| Example 2-231 | ○ | UCL-1 | Ga-7 | 1533 | 30000 | 102/205 | 9/1 | 9/10 | Xy/DMM | 70/20 |
| Example 2-232 | ○ | UCL-1 | Ga-7 | 1533 | 73000 | 102/205 | 9/1 | 9/10 | Xy/DMM | 70/20 |
| Example 2-233 | ○ | UCL-1 | Ga-7 | 1534 | 50000 | 102/205 | 9/1 | 9/10 | Xy/DMM | 70/20 |
| Example 2-234 | ○ | UCL-1 | Ga-7 | 1534 | 39000 | 102/205 | 9/1 | 9/10 | Xy/DMM | 70/20 |
| Example 2-235 | ○ | UCL-1 | Ga-7 | 1534 | 74000 | 102/205 | 9/1 | 9/10 | Xy/DMM | 70/20 |
| Example 2-236 | ○ | UCL-1 | Ga-7 | 1541 | 54000 | 102/205 | 9/1 | 9/10 | Xy/DMM | 70/20 |
| Example 2-237 | ○ | UCL-1 | Ga-7 | 1625 | 52000 | 102/205 | 9/1 | 9/10 | Xy/DMM | 70/20 |
| Example 2-238 | ○ | UCL-1 | Ga-7 | 1633 | 50000 | 102/205 | 9/1 | 9/10 | Xy/DMM | 70/20 |
| Example 2-239 | ○ | UCL-1 | Ga-7 | 2281 | 69000 | 102/205 | 9/1 | 9/10 | Xy/DMM | 70/20 |
| Example 2-240 | ○ | UCL-1 | Ga-7 | 2281 | 55000 | 102/205 | 9/1 | 9/10 | Xy/DMM | 70/20 |
| Example 2-241 | ○ | UCL-1 | Ga-7 | 2281 | 30000 | 102/205 | 9/1 | 9/10 | Xy/DMM | 70/20 |
| Example 2-242 | ○ | UCL-1 | Ga-7 | 2281 | 78000 | 102/205 | 9/1 | 9/10 | Xy/DMM | 70/20 |
| Example 2-243 | ○ | UCL-1 | Ga-7 | 2282 | 57000 | 102/205 | 9/1 | 9/10 | Xy/DMM | 70/20 |
| Example 2-244 | ○ | UCL-1 | Ga-7 | 2282 | 35000 | 102/205 | 9/1 | 9/10 | Xy/DMM | 70/20 |
| Example 2-245 | ○ | UCL-1 | Ga-7 | 2282 | 77000 | 102/205 | 9/1 | 9/10 | Xy/DMM | 70/20 |
| Example 2-246 | ○ | UCL-1 | Ga-7 | 2285 | 51000 | 102/205 | 9/1 | 9/10 | Xy/DMM | 70/20 |
| Example 2-247 | ○ | UCL-1 | Ga-7 | 2289 | 55000 | 102/205 | 9/1 | 9/10 | Xy/DMM | 70/20 |
| Example 2-248 | ○ | UCL-1 | Ga-7 | 2373 | 55000 | 102/205 | 9/1 | 9/10 | Xy/DMM | 70/20 |
| Example 2-249 | ○ | UCL-1 | Ga-7 | 2377 | 54000 | 102/205 | 9/1 | 9/10 | Xy/DMM | 70/20 |
| Example 2-250 | ○ | UCL-1 | Ga-7 | 2381 | 58000 | 102/205 | 9/1 | 9/10 | Xy/DMM | 70/20 |

TABLE 20

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-251 | ○ | UCL-1 | Ga-7 | 2301 | 50000 | 102/205 | 9/1 | 9/10 | Xy/DMM | 70/20 |
| Example 2-252 | ○ | UCL-1 | Ga-7 | 2301 | 33000 | 102/205 | 9/1 | 9/10 | Xy/DMM | 70/20 |
| Example 2-253 | ○ | UCL-1 | Ga-7 | 2301 | 73000 | 102/205 | 9/1 | 9/10 | Xy/DMM | 70/20 |
| Example 2-254 | ○ | UCL-1 | Ga-7 | 2302 | 52000 | 102/205 | 9/1 | 9/10 | Xy/DMM | 70/20 |
| Example 2-255 | ○ | UCL-1 | Ga-7 | 2302 | 31000 | 102/205 | 9/1 | 9/10 | Xy/DMM | 70/20 |
| Example 2-256 | ○ | UCL-1 | Ga-7 | 2302 | 72000 | 102/205 | 9/1 | 9/10 | Xy/DMM | 70/20 |
| Example 2-257 | ○ | UCL-1 | Ga-7 | 2393 | 53000 | 102/205 | 9/1 | 9/10 | Xy/DMM | 70/20 |
| Example 2-258 | ○ | UCL-1 | Ga-7 | 2325 | 53000 | 211 | — | 9/10 | Xy/DMM | 70/20 |

TABLE 20-continued

| Conditions for the manufacture of photosensitive members | | | | | | | | | | |
|---|---|---|---|---|---|---|---|---|---|---|
| | | | Charge generation layer | Charge transport layer | | | | | | |
| | Conductive layer | Undercoat layer | Charge generation material | Resin | | Charge transport material(s) | | Charge transport material(s)/resin | Solvent(s) | |
| Example No. | Used/ Not used | Type | | Type | Mw | Type | Mass ratio | in parts | Type | Parts |
| Example 2-259 | ○ | UCL-1 | Ga-7 | 2325 | 35000 | 211 | — | 9/10 | Xy/DMM | 70/20 |
| Example 2-260 | ○ | UCL-1 | Ga-7 | 2325 | 71000 | 211 | — | 9/10 | Xy/DMM | 70/20 |
| Example 2-261 | ○ | UCL-1 | Ga-7 | 2326 | 51000 | 211 | — | 9/10 | Xy/DMM | 70/20 |
| Example 2-262 | ○ | UCL-1 | Ga-7 | 2326 | 32000 | 211 | — | 9/10 | Xy/DMM | 70/20 |
| Example 2-263 | ○ | UCL-1 | Ga-7 | 2326 | 76000 | 211 | — | 9/10 | Xy/DMM | 70/20 |
| Example 2-264 | ○ | UCL-1 | Ga-7 | 2417 | 50000 | 211 | — | 9/10 | Xy/DMM | 70/20 |
| Example 2-265 | ○ | UCL-1 | Ga-7 | 2345 | 51000 | 603 | — | 9/10 | Xy/DMM | 70/20 |
| Example 2-266 | ○ | UCL-1 | Ga-7 | 2345 | 34000 | 603 | — | 9/10 | Xy/DMM | 70/20 |
| Example 2-267 | ○ | UCL-1 | Ga-7 | 2345 | 75000 | 603 | — | 9/10 | Xy/DMM | 70/20 |
| Example 2-268 | ○ | UCL-1 | Ga-7 | 2346 | 59000 | 603 | — | 9/10 | Xy/DMM | 70/20 |
| Example 2-269 | ○ | UCL-1 | Ga-7 | 2346 | 39000 | 603 | — | 9/10 | Xy/DMM | 70/20 |
| Example 2-270 | ○ | UCL-1 | Ga-7 | 2346 | 74000 | 603 | — | 9/10 | Xy/DMM | 70/20 |
| Example 2-271 | ○ | UCL-1 | Ga-7 | 2437 | 52000 | 603 | — | 9/10 | Xy/DMM | 70/20 |
| Example 2-272 | ○ | UCL-1 | Ga-7 | 2329 | 50000 | 309 | — | 9/10 | Xy/DMM | 70/20 |
| Example 2-273 | ○ | UCL-1 | Ga-7 | 2329 | 32000 | 309 | — | 9/10 | Xy/DMM | 70/20 |
| Example 2-274 | ○ | UCL-1 | Ga-7 | 2329 | 74000 | 309 | — | 9/10 | Xy/DMM | 70/20 |
| Example 2-275 | ○ | UCL-1 | Ga-7 | 2330 | 52000 | 309 | — | 9/10 | Xy/DMM | 70/20 |
| Example 2-276 | ○ | UCL-1 | Ga-7 | 2330 | 35000 | 309 | — | 9/10 | Xy/DMM | 70/20 |
| Example 2-277 | ○ | UCL-1 | Ga-7 | 2330 | 73000 | 309 | — | 9/10 | Xy/DMM | 70/20 |
| Example 2-278 | ○ | UCL-1 | Ga-7 | 2421 | 59000 | 309 | — | 9/10 | Xy/DMM | 70/20 |
| Example 2-279 | ○ | UCL-1 | Ga-7 | 2353 | 55000 | 102/205 | 9/1 | 9/10 | Xy/DMM | 70/20 |
| Example 2-280 | ○ | UCL-1 | Ga-7 | 2353 | 37000 | 102/205 | 9/1 | 9/10 | Xy/DMM | 70/20 |
| Example 2-281 | ○ | UCL-1 | Ga-7 | 2353 | 71000 | 102/205 | 9/1 | 9/10 | Xy/DMM | 70/20 |
| Example 2-282 | ○ | UCL-1 | Ga-7 | 2354 | 56000 | 102/205 | 9/1 | 9/10 | Xy/DMM | 70/20 |
| Example 2-283 | ○ | UCL-1 | Ga-7 | 2354 | 38000 | 102/205 | 9/1 | 9/10 | Xy/DMM | 70/20 |
| Example 2-284 | ○ | UCL-1 | Ga-7 | 2354 | 77000 | 102/205 | 9/1 | 9/10 | Xy/DMM | 70/20 |
| Example 2-285 | ○ | UCL-1 | Ga-7 | 2361 | 50000 | 102/205 | 9/1 | 9/10 | Xy/DMM | 70/20 |
| Example 2-286 | ○ | UCL-1 | Ga-7 | 2445 | 52000 | 102/205 | 9/1 | 9/10 | Xy/DMM | 70/20 |
| Example 2-287 | ○ | UCL-1 | Ga-7 | 2453 | 56000 | 102/205 | 9/1 | 9/10 | Xy/DMM | 70/20 |
| Example 2-288 | ○ | UCL-1 | Ga-2 | 1001 | 63000 | 102/205 | 9/1 | 9/10 | Xy/DMM | 70/20 |
| Example 2-289 | ○ | UCL-1 | Ga-5 | 1001 | 63000 | 102/205 | 9/1 | 9/10 | Xy/DMM | 70/20 |
| Comparative Example 2-1 | ○ | UCL-1 | Ga-7 | 3001 | 63000 | 102/205 | 9/1 | 9/10 | Xy/DMM | 70/20 |
| Comparative Example 2-2 | ○ | UCL-1 | Ga-7 | 3001 | 63000 | 102/205 | 9/1 | 9/10 | THF | 90 |
| Comparative Example 2-3 | ○ | UCL-1 | Ga-7 | 3002 | 53000 | 102/205 | 9/1 | 9/10 | Xy/DMM | 70/20 |
| Comparative Example 2-4 | ○ | UCL-1 | Ga-7 | 3002 | 53000 | 102/205 | 9/1 | 9/10 | THF | 90 |
| Comparative Example 2-5 | ○ | UCL-1 | Ga-7 | 3003 | 36000 | 102/205 | 9/1 | 9/10 | Xy/DMM | 70/20 |
| Comparative Example 2-6 | ○ | UCL-1 | Ga-7 | 1001 | 56000 | 102/205 | 9/1 | 4/10 | Xy/DMM | 70/20 |
| Comparative Example 2-7 | ○ | UCL-1 | Ga-7 | 1573 | 11000 | 102/205 | 9/1 | 9/10 | Xy/DMM | 70/20 |
| Comparative Example 2-8 | ○ | UCL-1 | Ga-7 | 1573 | 128000 | 102/205 | 9/1 | 9/10 | Xy/DMM | 70/20 |

Testing

The following tests were performed on the produced. electrophotographic photosensitive members or coating liquids for the formation of a charge transport layer. The test results are summarized in Tables 21 to 26.

Testing of Coating Liquids for the Formation of a Charge Transport Layer

Storage Stability

After 24 hours of stirring following preparation, the coating liquid for the formation of a charge transport layer was stored for 1 month in a tightly sealed container under the conditions of a temperature of 23° C. and a relative humidity of 50%. The stored coating liquid for the formation of a charge transport layer was visually inspected, and the storage stability was evaluated according to the following criteria.

A: There were no undissolved solids, and the coating liquid was transparent.

B: There were no undissolved solids, but the coating liquid was slightly opaque.

C: There were no undissolved solids, but the coating liquid was noticeably opaque.

D: There were undissolved solids.

For the coating liquids for the formation of a charge transport layer with grade D storage stability, the following testing of an electrophotographic photosensitive member was impossible.

Testing of Electrophotographic Photosensitive Members

Effect in the Reduction of Fog

A CP-4525 laser beam printer (Hewlett Packard) was used as test apparatus after modifications to allow for the adjustment of the charging potential (dark-area potential) for the electrophotographic photosensitive member used therewith. The charging potential (dark-area potential) setting was −600 V.

The produced electrophotographic photosensitive members were each installed in a process cartridge (cyan) of the test apparatus. A test chart having a 1% image-recorded area was continuously printed on 10,000 sheets of A4 plain paper under the conditions of a temperature of 23° C. and a relative humidity of 50%, in 3-sheet batches with 6-second. pauses between batches.

After this 30,000-sheet durability test, reflectometry was performed using a reflectometer (TC-6DS reflectometer, Tokyo Denshoku Co., Ltd.) to determine the worst reflection density within the white background of the image, F1, and the mean baseline reflection density on plain paper, F0. The difference F1-F0 was defined as the fog level, with smaller fog levels meaning more effective reduction of fog. In these examples of the invention, grades AA to F in the criteria constituted favorable levels, whereas F and G unacceptable levels.

AA: The fog level was less than 1.0.

A: The fog level was 1.0 or more and less than 1.5.

B: The fog level was 1.5 or more and less than 2.0.

C: The fog level was 2.0 or more and less than 2.5.

D: The fog level was 2.5 or more and less than 3.0.

E: The fog level was 3.0 or more and less than 4.0.

F: The fog level was 4.0 or more and less than 5.0.

G: The fog level was 5.0 or more.

Sensitivity and Electrical Characteristics after Repeated Use

A. CP-4525 laser beam printer (Hewlett Packard) was used as test apparatus after modifications to allow for the adjustment of the charging potential (dark-area potential) and the amount of exposure to light for the electrophotographic photosensitive member used therewith.

The produced electrophotographic photosensitive members were each installed in a process cartridge (cyan) of the test apparatus. A test chart having a 4% image-recorded. area was continuously printed on 10,000 sheets of A4 plain paper under the conditions of a temperature of 23° C. and a relative humidity of 50%. The charging bias was adjusted so that the electrophotographic photosensitive member would be charged to −600 V (dark-area potential). The exposure conditions were adjusted so that the amount of exposure to light would be 0.4 μJ/cm$^2$.

Before and after this process of repeated use, the light-area potential of the electrophotographic photosensitive member was measured as follows. The developing element was removed from the process cartridge of the test apparatus, and the light-area potential of the electrophotographic photosensitive member was measured using a surface potentiometer (Model 344, Trek) with a potential measurement prone (trade name, Model 6000B-8; Trek) placed at the point of development. The potential measurement probe was positioned in the middle of the longitudinal direction of the electrophotographic photosensitive member with a clearance of 3 mm between its measuring surface and the surface of the photosensitive member.

The obtained light-area potential of the electrophotographic photosensitive member be re repeated use was used to evaluate the sensitivity the photosensitive member. The higher the light-area potential of the electrophotographic photosensitive member before repeated use is, the more sensitive the photosensitive member is.

Furthermore, the change the light-area potential of the electrophotographic photosensitive member from before to after repeated use (difference) was used to evaluate the electrical characteristics of the electrophotographic photosensitive member after repeated use The smaller the change in light-area potential is, the better the electrical characteristics of the electrophotographic photosensor member after repeated use are.

Response in Rapid Recording

Two test apparatuses X and Y were prepared. A CP-4525 laser beam printer (Hewlett Packard) was modified to allow for the adjustment of the charging potential (dark-area potential) and the amount of exposure to light for the electrophotographic photosensitive member used therewith and the development bias (test apparatus X). Test apparatus X was further modified to increase its process speed (rotational speed of the electrophotographic photosensitive member) by 1.5 times (test apparatus Y).

The produced electrophotographic photosensitive members were each installed in a process cartridge (cyan) of each of test apparatuses X and Y. The 1-dot "knight move in chess" pattern halftone image illustrated in FIG. 4 was printed on A4 plain paper under the conditions of a temperature of 23° C. and a relative humidity of 50%, producing test images X and Y, respectively. The charging bias was adjusted so that the electrophotographic photosensitive member would be charged to −600 V (dark-area potential). The exposure conditions were adjusted so that the amount of exposure to light would be 0.4 μJ/cm$^2$. The development conditions were adjusted so that the development bias would be −350 V.

The difference in image density (Macbeth density) between test images X and Y measured with RD-918 densitometer (Macbeth) was used to evaluate response in rapid recording. To be more specific, on each test image, the reflection density in a 5-mm diameter circle was measured using an SPI filter at ten points in an area of image corresponding to one rotation of the electrophotographic photosensitive member, and the average among the ten points was used as the image density of the test image. The smaller the difference in image density is, the faster the response in rapid recording is. The criteria for evaluation were as follows.

A: The difference in image density was less than 0.02.

B: The difference in image density was 0.02 or more and less than 0.04.

C: The difference in image density was 0.04 or more and less than 0.06.

D: The difference in image density was 0.06 or more.

Long-Term Storage Stability

The produced electrophotographic photosensitive members were each installed in a process cartridge (cyan) of a CP-4525 laser beam printer (Hewlett Packard) and stored for 14 days under the conditions of a temperature of 60° C. and a relative humidity of 50%. The surface of the stored electrophotographic photosensitive member was observed using an optical microscope, and a test image was visually inspected. The results were used to evaluate long-term stability. The test image was printed using another CP-4525 laser beam printer, with the stored electrophotographic photosensitive member installed in its process cartridge (cyan). The criteria for evaluation were as follows.

A: No deposits were observed on the surface.

B: Some deposits were observed on the surface, but with no influence on image quality.

C: Many deposits were observed on the surface, but with no influence on image quality.

Effect in the Prevention of Photomemories

A CP-4525 laser beam printer (Hewlett Packard) was used as test apparatus after modifications to allow for the adjustment of the charging potential (dark-area potential) for the electrophotographic photosensitive member used therewith. The charging potential (dark-area potential) setting was −600 V.

The produced electrophotographic photosensitive members were each installed in a process cartridge (cyan) of the test apparatus. A halftone image was continuously printed on 10,000 sheets of A4 plain paper under the conditions of a temperature of 23° C. and a relative humidity of 50%. The electrophotographic photosensitive member was then removed from the process cartridge. The surface of the electrophotographic photosensitive member was then irradiated with light of 2,000 lux using a white fluorescent lamp for 10 minutes, with part of the surface shielded from the light along the circumferential direction. This electrophotographic photosensitive member was installed in another process cartridge (cyan), and the 1-dot "knight move in chess" pattern halftone image illustrated in FIG. 4 was printed 30 minutes after the completion of the irradiation with a fluorescent lamp. The areas of the halftone image corresponding to the light-shielded (unexposed) and non-light-shielded (exposed) portions were visually inspected, and the difference in image density was used to evaluate the effect in the prevention of photomemories. The criteria for evaluation were as follows.

A: No difference in density was observed.

B: There was a slight difference in density.

C: There was a difference in density, but not causing problems in practical use.

D: There was a difference in density, but with no clear boundary between the regions.

E: There was a noticeable difference in density, and the boundary between the regions was clear at least in part.

TABLE 21

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-1 | A | AA | 91 | 44 | A | A | A |
| Example 2-2 | A | A | 105 | 38 | A | A | A |
| Example 2-3 | A | B | 105 | 38 | A | A | A |
| Example 2-4 | A | A | 110 | 46 | A | A | A |
| Example 2-5 | B | B | 108 | 39 | A | A | A |
| Example 2-6 | B | B | 111 | 44 | A | A | B |
| Example 2-7 | B | C | 110 | 39 | A | A | B |
| Example 2-8 | B | B | 111 | 35 | A | A | B |
| Example 2-9 | C | C | 108 | 45 | A | A | B |
| Example 2-10 | A | AA | 111 | 44 | A | A | A |
| Example 2-11 | A | A | 114 | 36 | A | A | A |
| Example 2-12 | A | AA | 111 | 37 | A | A | A |
| Example 2-13 | B | A | 113 | 38 | A | A | A |
| Example 2-14 | B | AA | 122 | 75 | B | A | A |
| Example 2-15 | A | A | 111 | 38 | A | A | A |
| Example 2-16 | A | A | 107 | 47 | A | A | A |
| Example 2-17 | A | B | 111 | 35 | A | A | A |
| Example 2-18 | A | B | 108 | 36 | A | A | A |
| Example 2-19 | A | B | 108 | 38 | A | A | A |
| Example 2-20 | A | A | 91 | 27 | A | B | B |
| Example 2-21 | A | B | 98 | 27 | A | B | B |
| Example 2-22 | A | A | 96 | 26 | A | B | B |
| Example 2-23 | B | B | 100 | 30 | A | B | B |
| Example 2-24 | B | B | 92 | 30 | A | B | B |
| Example 2-25 | B | C | 100 | 30 | A | B | B |
| Example 2-26 | B | B | 90 | 31 | A | B | B |
| Example 2-27 | C | C | 93 | 31 | A | B | B |
| Example 2-28 | A | A | 98 | 28 | A | B | B |
| Example 2-29 | A | B | 91 | 31 | A | B | B |
| Example 2-30 | A | A | 99 | 30 | A | B | B |
| Example 2-31 | B | B | 96 | 33 | A | B | B |
| Example 2-32 | B | AA | 111 | 40 | A | B | B |
| Example 2-33 | C | AA | 110 | 57 | B | A | A |
| Example 2-34 | A | A | 95 | 27 | A | B | B |
| Example 2-35 | A | A | 94 | 28 | A | B | B |
| Example 2-36 | A | A | 94 | 27 | A | B | B |
| Example 2-37 | A | A | 82 | 18 | A | C | C |
| Example 2-38 | A | B | 77 | 21 | A | C | C |
| Example 2-39 | A | A | 82 | 16 | A | C | C |
| Example 2-40 | B | A | 83 | 23 | A | C | C |
| Example 2-41 | B | B | 80 | 19 | A | C | D |
| Example 2-42 | B | C | 80 | 21 | A | C | D |
| Example 2-43 | B | B | 80 | 19 | A | C | D |
| Example 2-44 | C | B | 83 | 18 | A | C | D |
| Example 2-45 | A | AA | 83 | 15 | A | C | C |
| Example 2-46 | A | A | 76 | 17 | A | C | C |
| Example 2-47 | A | AA | 81 | 17 | A | C | C |
| Example 2-48 | B | AA | 79 | 17 | A | C | C |
| Example 2-49 | C | AA | 96 | 26 | A | C | C |
| Example 2-50 | C | AA | 109 | 40 | A | A | C |

TABLE 22

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-51 | A | A | 83 | 15 | A | C | C |
| Example 2-52 | A | A | 78 | 17 | A | C | C |
| Example 2-53 | A | A | 97 | 39 | A | A | A |
| Example 2-54 | A | A | 106 | 43 | A | A | A |
| Example 2-55 | A | A | 77 | 4 | A | A | A |
| Example 2-56 | A | A | 141 | 1 | A | A | A |
| Example 2-57 | A | B | 80 | 44 | A | B | D |
| Example 2-58 | A | B | 123 | 30 | A | C | B |
| Example 2-59 | A | B | 108 | 45 | A | A | A |
| Example 2-60 | A | A | 113 | 35 | A | A | A |
| Example 2-61 | A | A | 111 | 35 | A | A | A |
| Example 2-62 | A | A | 112 | 44 | B | A | B |
| Example 2-63 | A | A | 109 | 37 | A | A | A |
| Example 2-64 | A | A | 114 | 35 | A | A | A |
| Example 2-65 | A | A | 109 | 37 | B | A | B |
| Example 2-66 | A | A | 145 | 45 | A | A | A |
| Example 2-67 | A | B | 143 | 47 | A | A | A |
| Example 2-68 | A | A | 135 | 39 | A | A | A |
| Example 2-69 | B | B | 117 | 47 | A | A | B |
| Example 2-70 | B | C | 124 | 43 | A | A | B |
| Example 2-71 | B | B | 119 | 43 | A | A | B |
| Example 2-72 | B | AA | 155 | 58 | B | A | A |
| Example 2-73 | A | A | 139 | 36 | A | A | A |
| Example 2-74 | A | A | 138 | 40 | A | A | A |
| Example 2-75 | A | B | 141 | 41 | A | A | A |
| Example 2-76 | A | B | 141 | 36 | A | A | A |
| Example 2-77 | A | B | 138 | 36 | A | A | A |
| Example 2-78 | A | A | 129 | 28 | A | B | B |
| Example 2-79 | A | B | 126 | 29 | A | B | B |
| Example 2-80 | A | A | 124 | 27 | A | B | B |
| Example 2-81 | B | B | 106 | 27 | A | B | B |
| Example 2-82 | B | C | 108 | 28 | A | B | B |
| Example 2-83 | B | B | 110 | 31 | A | B | B |
| Example 2-84 | B | AA | 137 | 37 | A | B | B |
| Example 2-85 | C | AA | 160 | 62 | B | A | A |
| Example 2-86 | A | A | 122 | 26 | A | B | B |
| Example 2-87 | A | A | 121 | 30 | A | B | B |
| Example 2-88 | A | A | 125 | 26 | A | B | B |
| Example 2-89 | A | A | 107 | 23 | A | C | C |
| Example 2-90 | A | B | 114 | 19 | A | C | C |
| Example 2-91 | A | A | 108 | 20 | A | C | C |
| Example 2-92 | B | B | 91 | 17 | A | C | D |
| Example 2-93 | B | C | 87 | 19 | A | C | D |
| Example 2-94 | B | B | 89 | 20 | A | C | D |
| Example 2-95 | C | AA | 108 | 32 | A | C | C |
| Example 2-96 | C | AA | 121 | 37 | A | A | C |
| Example 2-97 | A | A | 112 | 21 | A | C | C |
| Example 2-98 | A | A | 107 | 17 | A | C | C |
| Example 2-99 | A | A | 121 | 44 | A | A | A |
| Example 2-100 | A | A | 138 | 38 | A | A | A |

TABLE 23

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-101 | A | A | 115 | 3 | A | A | A |
| Example 2-102 | A | A | 172 | 3 | A | A | A |
| Example 2-103 | A | B | 112 | 46 | A | B | D |
| Example 2-104 | A | B | 150 | 30 | A | C | B |
| Example 2-105 | A | B | 137 | 45 | A | A | A |
| Example 2-106 | A | A | 140 | 37 | A | A | A |
| Example 2-107 | A | B | 128 | 41 | B | A | A |
| Example 2-108 | A | C | 125 | 37 | B | A | A |

TABLE 23-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-109 | A | B | 130 | 38 | B | A | A |
| Example 2-110 | B | C | 130 | 41 | B | A | A |
| Example 2-111 | B | C | 112 | 36 | A | A | B |
| Example 2-112 | B | D | 117 | 45 | A | A | B |
| Example 2-113 | B | C | 117 | 41 | A | A | B |
| Example 2-114 | C | D | 120 | 44 | A | A | B |
| Example 2-115 | A | A | 126 | 46 | B | A | A |
| Example 2-116 | A | B | 127 | 42 | B | A | A |
| Example 2-117 | A | A | 128 | 36 | B | A | A |
| Example 2-118 | B | B | 131 | 39 | B | A | A |
| Example 2-119 | A | A | 138 | 59 | B | A | A |
| Example 2-120 | A | B | 109 | 27 | A | B | B |
| Example 2-121 | B | A | 127 | 37 | B | B | B |
| Example 2-122 | B | AA | 145 | 56 | B | A | A |
| Example 2-123 | A | B | 113 | 31 | A | B | B |
| Example 2-124 | B | A | 125 | 43 | B | B | B |
| Example 2-125 | B | AA | 138 | 67 | B | A | A |
| Example 2-126 | A | C | 113 | 36 | B | A | C |
| Example 2-127 | A | C | 123 | 37 | B | A | A |
| Example 2-128 | A | B | 127 | 43 | B | A | A |
| Example 2-129 | A | B | 127 | 45 | A | A | A |
| Example 2-130 | A | B | 128 | 38 | B | A | A |
| Example 2-131 | A | B | 127 | 35 | B | A | A |
| Example 2-132 | A | C | 128 | 40 | B | A | A |
| Example 2-133 | A | B | 121 | 37 | B | A | A |
| Example 2-134 | B | C | 130 | 39 | B | A | A |
| Example 2-135 | B | C | 121 | 38 | A | A | B |
| Example 2-136 | B | D | 120 | 38 | A | A | B |
| Example 2-137 | B | C | 114 | 47 | A | A | B |
| Example 2-138 | C | D | 114 | 43 | A | A | B |
| Example 2-139 | A | A | 133 | 38 | B | A | A |
| Example 2-140 | A | B | 135 | 36 | B | A | A |
| Example 2-141 | A | A | 127 | 46 | B | A | A |
| Example 2-142 | B | B | 126 | 42 | B | A | A |
| Example 2-143 | A | A | 142 | 52 | B | A | A |
| Example 2-144 | A | B | 109 | 27 | A | B | B |
| Example 2-145 | B | A | 123 | 44 | B | B | B |
| Example 2-146 | B | AA | 135 | 68 | B | A | A |
| Example 2-147 | A | B | 97 | 21 | A | C | C |
| Example 2-148 | B | A | 109 | 32 | A | C | C |
| Example 2-149 | C | AA | 122 | 36 | B | A | C |
| Example 2-150 | A | C | 127 | 38 | B | A | A |

TABLE 24

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-151 | A | B | 128 | 40 | B | A | A |
| Example 2-152 | A | B | 123 | 39 | A | A | A |
| Example 2-153 | A | B | 122 | 46 | B | A | A |
| Example 2-154 | A | C | 125 | 36 | B | A | A |
| Example 2-155 | A | B | 125 | 38 | B | A | A |
| Example 2-156 | B | C | 129 | 45 | B | A | A |
| Example 2-157 | B | C | 114 | 46 | B | A | B |
| Example 2-158 | B | D | 111 | 40 | B | A | B |
| Example 2-159 | B | C | 112 | 45 | B | A | B |
| Example 2-160 | C | D | 116 | 42 | B | A | B |
| Example 2-161 | A | A | 129 | 43 | B | A | A |
| Example 2-162 | A | B | 133 | 46 | B | A | A |
| Example 2-163 | A | A | 130 | 39 | B | A | A |
| Example 2-164 | B | B | 133 | 39 | B | A | A |
| Example 2-165 | A | A | 137 | 55 | B | A | A |
| Example 2-166 | A | B | 107 | 32 | A | B | B |

TABLE 24-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-167 | B | A | 121 | 38 | B | B | B |
| Example 2-168 | B | AA | 139 | 59 | B | A | A |
| Example 2-169 | A | C | 128 | 44 | B | A | A |
| Example 2-170 | A | B | 143 | 74 | B | A | A |
| Example 2-171 | A | C | 106 | 38 | B | A | C |
| Example 2-172 | A | C | 123 | 37 | B | A | A |
| Example 2-173 | A | B | 133 | 42 | B | A | A |
| Example 2-174 | A | B | 122 | 44 | B | A | A |
| Example 2-175 | A | C | 109 | 44 | B | A | A |
| Example 2-176 | A | D | 107 | 41 | B | A | A |
| Example 2-177 | A | C | 111 | 38 | B | A | A |
| Example 2-178 | A | C | 109 | 40 | B | A | A |
| Example 2-179 | A | C | 106 | 38 | B | A | B |
| Example 2-180 | A | D | 109 | 41 | B | A | B |
| Example 2-181 | A | C | 110 | 45 | B | A | B |
| Example 2-182 | B | D | 110 | 36 | B | A | B |
| Example 2-183 | A | B | 111 | 40 | C | A | B |
| Example 2-184 | A | C | 106 | 36 | C | A | B |
| Example 2-185 | A | B | 113 | 37 | C | A | B |
| Example 2-186 | A | B | 107 | 36 | C | A | B |
| Example 2-187 | A | C | 108 | 47 | C | A | B |
| Example 2-188 | A | C | 112 | 36 | B | A | A |
| Example 2-189 | A | C | 114 | 45 | C | A | B |
| Example 2-190 | A | B | 125 | 39 | A | A | A |
| Example 2-191 | A | B | 125 | 45 | A | A | A |
| Example 2-192 | A | C | 127 | 47 | A | A | A |
| Example 2-193 | A | B | 127 | 45 | A | A | A |
| Example 2-194 | A | C | 139 | 44 | A | A | A |
| Example 2-195 | A | D | 133 | 45 | A | A | A |
| Example 2-196 | A | C | 138 | 38 | A | A | A |
| Example 2-197 | A | B | 137 | 36 | A | A | A |
| Example 2-198 | A | B | 138 | 45 | B | A | A |
| Example 2-199 | A | B | 143 | 37 | B | A | A |
| Example 2-200 | A | B | 136 | 43 | C | A | B |

TABLE 25

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-201 | A | B | 138 | 41 | B | A | A |
| Example 2-202 | A | B | 152 | 40 | A | A | A |
| Example 2-203 | A | C | 155 | 36 | A | A | A |
| Example 2-204 | A | B | 151 | 35 | A | A | A |
| Example 2-205 | A | C | 148 | 36 | A | A | A |
| Example 2-206 | A | D | 150 | 41 | A | A | A |
| Example 2-207 | A | C | 149 | 39 | A | A | A |
| Example 2-208 | A | B | 172 | 41 | C | A | B |
| Example 2-209 | A | C | 122 | 30 | A | B | A |
| Example 2-210 | A | D | 120 | 27 | A | B | A |
| Example 2-211 | A | C | 126 | 28 | A | B | A |
| Example 2-212 | A | D | 121 | 30 | A | B | A |
| Example 2-213 | A | D | 126 | 31 | A | B | A |
| Example 2-214 | A | D | 126 | 29 | A | B | A |
| Example 2-215 | A | C | 142 | 30 | B | B | A |
| Example 2-216 | A | C | 129 | 27 | A | B | A |
| Example 2-217 | A | D | 128 | 26 | A | B | A |
| Example 2-218 | A | C | 128 | 26 | A | B | A |
| Example 2-219 | A | D | 125 | 30 | A | B | A |
| Example 2-220 | A | D | 124 | 27 | A | B | A |
| Example 2-221 | A | D | 121 | 30 | A | B | A |
| Example 2-222 | A | C | 135 | 30 | B | B | A |
| Example 2-223 | A | C | 126 | 33 | A | B | A |
| Example 2-224 | A | D | 122 | 27 | A | B | A |

TABLE 25-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-225 | A | C | 122 | 31 | A | B | A |
| Example 2-226 | A | D | 121 | 28 | A | B | A |
| Example 2-227 | A | D | 129 | 29 | A | B | A |
| Example 2-228 | A | D | 126 | 25 | A | B | A |
| Example 2-229 | A | C | 135 | 33 | B | B | B |
| Example 2-230 | A | C | 128 | 38 | B | A | A |
| Example 2-231 | A | D | 128 | 36 | B | A | A |
| Example 2-232 | A | C | 122 | 47 | B | A | A |
| Example 2-233 | A | D | 130 | 36 | B | A | A |
| Example 2-234 | A | E | 139 | 37 | B | A | A |
| Example 2-235 | A | D | 134 | 42 | B | A | A |
| Example 2-236 | A | C | 120 | 47 | C | A | A |
| Example 2-237 | A | D | 135 | 46 | C | A | A |
| Example 2-238 | A | D | 137 | 41 | C | A | A |
| Example 2-239 | A | C | 159 | 35 | A | A | A |
| Example 2-240 | A | C | 158 | 41 | A | A | A |
| Example 2-241 | A | D | 159 | 36 | A | A | A |
| Example 2-242 | A | C | 150 | 38 | A | A | A |
| Example 2-243 | A | D | 187 | 42 | A | A | A |
| Example 2-244 | A | D | 187 | 38 | A | A | A |
| Example 2-245 | A | D | 181 | 46 | A | A | A |
| Example 2-246 | A | C | 156 | 45 | A | A | A |
| Example 2-247 | A | C | 159 | 38 | B | A | A |
| Example 2-248 | A | C | 151 | 44 | A | A | A |
| Example 2-249 | A | C | 152 | 37 | A | A | A |
| Example 2-250 | A | C | 159 | 44 | B | A | A |

TABLE 26

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-251 | A | C | 184 | 36 | A | A | A |
| Example 2-252 | A | D | 187 | 46 | A | A | A |
| Example 2-253 | A | C | 186 | 37 | A | A | A |
| Example 2-254 | B | D | 197 | 39 | A | A | A |
| Example 2-255 | B | D | 189 | 43 | A | A | A |
| Example 2-256 | B | D | 190 | 38 | A | A | A |
| Example 2-257 | A | C | 189 | 43 | A | A | A |
| Example 2-258 | A | D | 159 | 30 | A | B | A |
| Example 2-259 | A | D | 158 | 27 | A | B | A |
| Example 2-260 | A | D | 152 | 31 | A | B | A |
| Example 2-261 | A | D | 173 | 26 | A | B | A |
| Example 2-262 | A | E | 175 | 32 | A | B | A |
| Example 2-263 | A | D | 175 | 26 | A | B | A |
| Example 2-264 | A | D | 150 | 26 | A | B | A |
| Example 2-265 | A | D | 154 | 30 | A | B | A |
| Example 2-266 | A | D | 150 | 28 | A | B | A |
| Example 2-267 | A | D | 159 | 32 | A | B | A |
| Example 2-268 | A | D | 175 | 33 | A | B | A |
| Example 2-269 | A | E | 173 | 32 | A | B | A |
| Example 2-270 | A | D | 178 | 32 | A | B | A |
| Example 2-271 | A | D | 150 | 27 | A | B | A |
| Example 2-272 | A | D | 160 | 32 | A | B | A |
| Example 2-273 | A | D | 156 | 26 | A | B | A |
| Example 2-274 | A | D | 155 | 30 | A | B | A |
| Example 2-275 | A | D | 172 | 27 | A | B | A |
| Example 2-276 | A | E | 169 | 33 | A | B | A |
| Example 2-277 | A | D | 171 | 26 | A | B | A |
| Example 2-278 | A | D | 157 | 31 | A | B | A |
| Example 2-279 | A | D | 160 | 45 | B | A | A |
| Example 2-280 | A | E | 152 | 44 | B | A | A |
| Example 2-281 | A | D | 150 | 42 | B | A | A |
| Example 2-282 | A | E | 182 | 45 | B | A | A |

TABLE 26-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 2-283 | A | E | 182 | 37 | B | A | A |
| Example 2-284 | A | E | 184 | 42 | B | A | A |
| Example 2-285 | A | D | 151 | 45 | C | A | A |
| Example 2-286 | A | D | 156 | 37 | B | A | A |
| Example 2-287 | A | D | 156 | 39 | C | A | A |
| Example 2-288 | A | AA | 95 | 37 | A | A | A |
| Example 2-291 | A | AA | 105 | 41 | A | A | A |
| Comparative Example 2-1 | D | — | — | — | — | — | — |
| Comparative Example 2-2 | D | — | — | — | — | — | — |
| Comparative Example 2-3 | D | — | — | — | — | — | — |
| Comparative Example 2-4 | D | — | — | — | — | — | — |
| Comparative Example 2-5 | A | F | 175 | 39 | D | A | E |
| Comparative Example 2-6 | C | AA | 220 | 126 | — | A | — |
| Comparative Example 2-7 | A | F | 173 | 43 | C | A | B |
| Comparative Example 2-8 | D | — | — | — | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039429 filed Feb. 27, 2015, and No. 2016-026328 filed Feb. 15, 2016, which are hereby incorporated by reference herein in their entirety.

What is claimed is:

1. An electrophotographic photosensitive member comprising a support, a charge generation layer, and a charge transport layer In this order, the charge transport layer containing a charge transport material, the charge transport layer being a surface layer of the electrophotographic photosensitive member, the charge transport layer containing a polycarbonate resin having a structural unit selected from group A and a structural unit selected from group B, the group A including structural units represented by formulae (101) and (102):

(101)

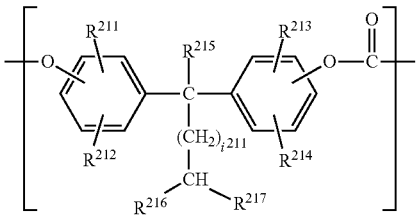

where $R^{211}$ to $R^{214}$ each independently represent a hydrogen atom or an alkyl, aryl, or alkoxy group, $R^{215}$ represents an alkyl, aryl, or alkoxy group, $R^{216}$ and $R^{217}$ each independently represent an alkyl group containing 1 to 9 carbon atoms, $i^{211}$ represents an integer of 0 to 3, and $R^2$ and $(CH_2)_iCHR^{216}R^{217}$ are different croons;

(102)

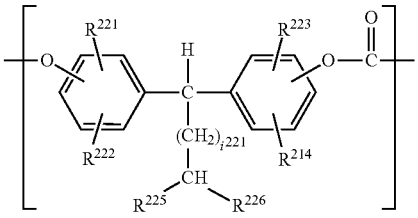

where $R^{221}$ to $R^{224}$ each independently represent a hydrogen atom or an alkyl, aryl, or alkoxy group, $R^{225}$ and $R^{226}$ each independently represent an alkyl group containing 1 to 9 carbon atoms, $R^{225}$ and $R^{226}$ are different croons, and $i^{221}$ represents an integer of 0 to 3;

the group d including structural units represented by formulae (104), (105), and (106):

(104)

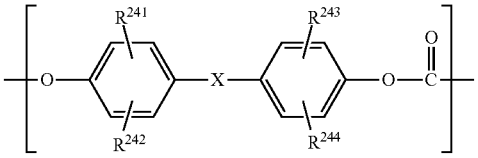

where $R^{242}$ to $R^{244}$ each independently represent a hydrogen atom or an alkyl, aryl, or alkoxy group, and X represents a single bond, an oxygen atom, a sulfur atom, or a sulfonyl group;

(105)

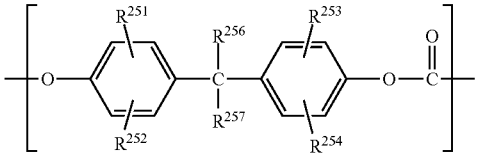

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

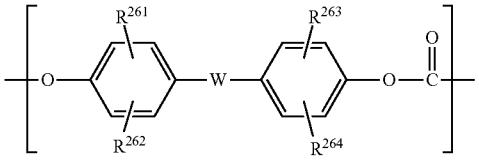

where $R^{261}$ to $R^{264}$ independently represent a hydrogen atom or an alkyl, aryl, or alkoxy group, and W represents a cycloalkylidene group containing 5 to 12 carbon atoms.

2. The electrophotographic photosensitive member according to claim 1, wherein the polycarbonate resin has a weight-average molecular weight of 40,000 or more and 80,000 or less.

3. The electrophotographic photosensitive member according to claim 1, wherein a proportion of the structural unit selected from the group A in the polycarbonate resin is 20 mol % or more and 70 mol % or less.

4. The electrophotographic photosensitive member according to claim 1, wherein in the charge transport layer, a quantity of the charge transport material is 70% by mass or less of a quantity of the polycarbonate resin.

5. A method for manufacturing an electrophotographic photosensitive member, the electrophotographic photosensitive member having a support, a charge generation layer, and a charge transport layer in this order, the charge transport layer containing a charge transport material, the charge transport layer being a surface layer of the electrophotographic photosensitive member, the charge transport layer containing a polycarbonate resin having a structural unit selected from group A and a structural unit selected from group B, the group A including structural units represented by formulae (101) and (102):

(101)

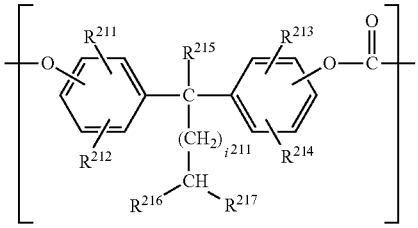

where $R^{211}$ to $R^{214}$ each independently represent a hydrogen atom or an alkyl, aryl, or alkoxy group, $R^{215}$ represents an alkyl, aryl, or alkoxy group, $R^{216}$ and $R^{217}$ each independently represent an alkyl group containing 1 to 9 carbon atoms, $i^{211}$ represents an integer of 0 to 3, and $R^{215}$ and $(CH_2)_iCHR^{216}R^{217}$ are different groups;

(102)

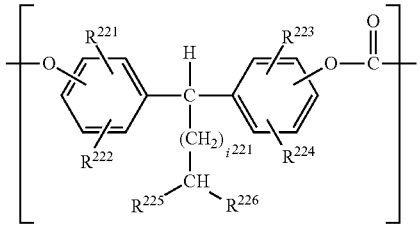

where $R^{221}$ to $R^{224}$ each independently represent a hydrogen atom or an alkyl, aryl, or alkoxy group, $R^{225}$ and $R^{226}$ each independently represent an alkyl group containing 1 to 9 carbon atoms, $R^{225}$ and $R^{226}$ are different groups, and $i^{221}$ represents an integer of 0 to 3;

the group B including structural units represented by formulae (104) (105), and (106):

(104)

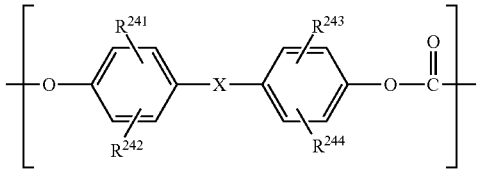

where $R^{241}$ to $R^{244}$ to each independently represent a hydrogen atom or an alkyl, aryl, or alkoxy group, and X represents a single bond, an oxygen atom, a sulfur atom, or a sulfonyl group;

(105)

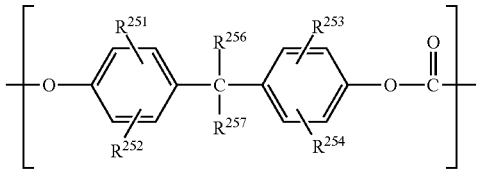

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

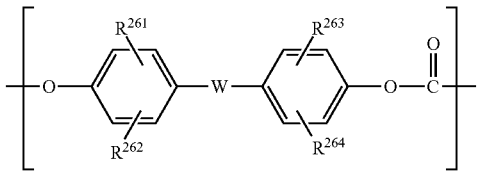

where $R^{261}$ to $R^{264}$ each independently represent a hydrogen atom or an alkyl, aryl, or alkoxy group, and W represents a cycloalkylidene group containing 5 to 12 carbon atoms, the method comprising:

producing the charge transport layer by forming a wet coating of a coating liquid configured to form the charge transport layer, the coating liquid containing the charge transport material, the polycarbonate resin, and a solvent having a dipole moment of 1.0 D or less; and drying the wet coating.

6. The method according to claim 5 for manufacturing an electrophotographic photosensitive member, wherein the solvent having a dipole moment of 1.0 D or less is one selected from xylene and methylal.

7. A process cartridge comprising an electrophotographic photosensitive member and at least one unit selected from the group consisting of a charging unit, a development unit, a transfer unit, and a cleaning unit, the process cartridge integrally holding the electrophotographic photosensitive member and the at least one unit and configured to be detachably attached to a main body of an electrophotographic apparatus, the electrophotographic photosensitive member having a support, a charge generation layer, and a charge transport layer in this order, the charge transport layer containing a charge transport material, the charge transport layer being a surface layer of the electrophotographic photosensitive member, the charge transport layer containing a polycarbonate resin having a structural unit selected from group A and a structural unit selected from group B, the group A including structural units represented by formulae (101) and (102):

(101)

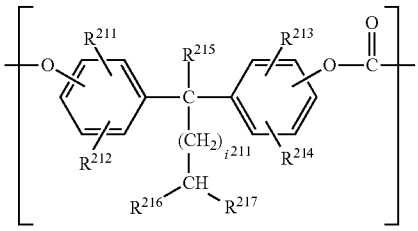

where $R^{211}$ to $R^{214}$ each independently represent a hydrogen atom or an alkyl, aryl, or alkoxy group, $R^{215}$ represents an alkyl, aryl, or alkoxy group, $R^{216}$ and $R^{217}$ each independently represent an alkyl group containing 1 to 9 carbon atoms, $i^{211}$ represents an integer of 0 to 3, and $R^{215}$ and $(CH_2)_1CHR^{216}R^{217}$ are different groups;

(102)

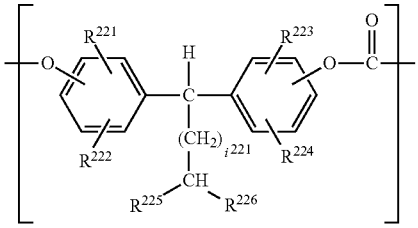

where $R^{221}$ to $R^{224}$ each independently represent a hydrogen atom or an alkyl, aryl, or alkoxy group, $R^{225}$ and $R^{226}$ each independently represent an alkyl group containing 1 to 9 carbon atoms, $R^{225}$ and $R^{226}$ are different groups, and $i^{221}$ represents an integer of 0 to 3;

the group B including structural units represented by formulae (104) (105), and (106):

(104)

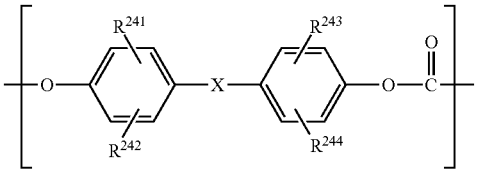

Where $R^{241}$ and $R^{244}$ each independently represent a hydrogen atom or an alkyl, aryl, or alkoxy group, and X represents a single bond, an oxygen atom, a sulfur atom, or a sulfonyl group;

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

where $B^{261}$ to $R^{264}$ each independently represent a hydrogen atom or an alkyl, aryl, or alkoxy group, and W represents a cycloalkylidene group containing 5 to 12 carbon atoms.

8. An electrophotographic apparatus comprising an electrophotographic photosensitive member and a charging unit, an exposure unit, a development unit, and a transfer unit, the electrophotographic photosensitive member having a support, a charge generation layer, and a charge transport layer in this order, the charge transport layer containing a charge transport material, the charge transport layer being a surface layer of the electrophotographic photosensitive member, the charge transport layer containing a polycarbonate resin having a structural unit selected from group A and a structural unit selected from group B, the group A including structural units represented by formulae (101) and (102)

(101)

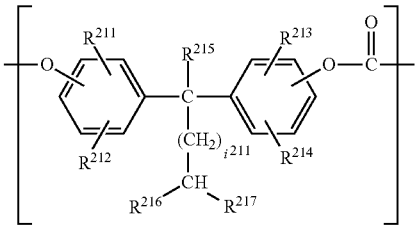

where $R^{211}$ to $R^{214}$ each independently represent a represents a single bond, an oxygen atom, a sulfur atom, or a sulfonyl group;

(105)

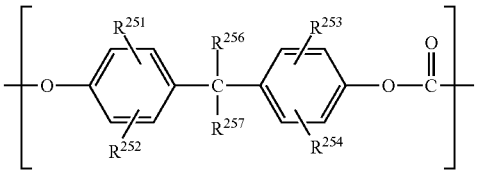

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

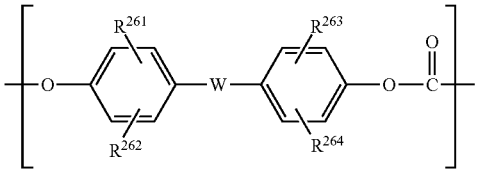

where $R^{261}$ to $R^{264}$ each independently represent a hydrogen atom or an alkyl, aryl, or alkoxy group, and W represents a cycloalkylidene group containing 5 to 12 carbon atoms.

hydrogen atom or an alkyl, aryl, or alkoxy group, $R^{215}$ represents an alkyl, aryl, or alkoxy group, $R^{216}$ and $R^{217}$ each independently represent an alkyl group containing 1 to 9 carbon atoms, $i^{211}$ represents an integer of 0 to 3, and $R^{215}$ and $(CH_2)_iCHR^{216}R^{217}$ are different groups;

(102)

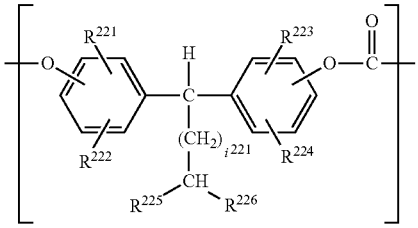

where $R^{221}$ to $R^{224}$ each independently represent a hydrogen atom or an alkyl, aryl, or alkoxy group, $R^{225}$ and $R^{226}$ each independently represent an alkyl group containing 1 to 9 carbon atoms, $R^{225}$ and $R^{226}$ are different groups, and $i^{221}$ represents an integer of 0 to 3;

the group B including structural units represented by formulae (104), (105), and (106):

(104)

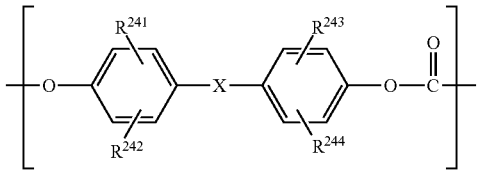

where $R^{241}$ to $R^{244}$ each independently represent a hydrogen atom or an alkyl, aryl, or alkoxy group, and X represents a single bond, an oxygen atom, a sulfur atom, or a sulfonyl group;

(105)

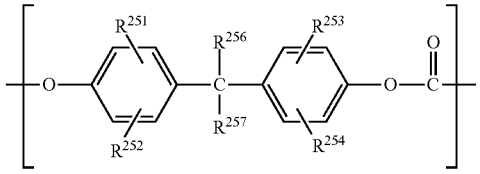

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

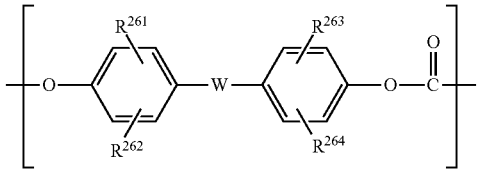

where $R^{261}$ to $R^{264}$ each independently represent a hydrogen atom or an alkyl, aryl, or alkoxy group, and W represents a cycloalkylidene group containing 5 to 12 carbon atoms.

* * * * *